US010189038B2

(12) United States Patent
Buckalter et al.

(10) Patent No.: US 10,189,038 B2
(45) Date of Patent: Jan. 29, 2019

(54) INDUCTIVELY HEATABLE FLUID RESERVOIR FOR VARIOUS FLUID TYPES

(71) Applicant: Toaster Labs, Inc., Seattle, WA (US)

(72) Inventors: Amy Carol Buckalter, Seattle, WA (US); David Oscar Iverson, Seattle, WA (US); Garet Glenn Nenninger, Seattle, WA (US); Roland David Horth, Seattle, WA (US)

(73) Assignee: Toaster Labs, Inc., Seattle, WA (US)

( * ) Notice: Subject to any disclaimer, the term of this patent is extended or adjusted under 35 U.S.C. 154(b) by 304 days.

(21) Appl. No.: 14/879,014

(22) Filed: Oct. 8, 2015

(65) Prior Publication Data

US 2016/0228897 A1 Aug. 11, 2016

Related U.S. Application Data

(63) Continuation-in-part of application No. 14/530,479, filed on Oct. 31, 2014, which is a continuation-in-part of application No. 14/137,130, filed on Dec. 20, 2013.

(51) Int. Cl.
*B05B 11/00* (2006.01)
*B05B 11/04* (2006.01)
(Continued)

(52) U.S. Cl.
CPC ..... *B05B 11/0002* (2013.01); *A47K 5/1204* (2013.01); *A47K 5/1205* (2013.01);
(Continued)

(58) Field of Classification Search
CPC ..... B05C 5/001; B05C 11/1042; B05C 17/00523; B05C 17/00546;
(Continued)

(56) References Cited

U.S. PATENT DOCUMENTS 1,537,552 A 2/1923 Rotunno
3,813,012 A 5/1974 Laird
(Continued)

FOREIGN PATENT DOCUMENTS

DE 1654872 A1 4/1971
DE 10122337 A1 12/2002
(Continued)

OTHER PUBLICATIONS

International Search Report; dated Oct. 2, 2016; 4 Pages.
International Search Report; pp. 19; dated Nov. 22, 2016.
International Search Report; pp. 5; dated Nov. 22, 2016.

*Primary Examiner* — Nicholas J Weiss
(74) *Attorney, Agent, or Firm* — Lowe Graham Jones PLLC

(57) ABSTRACT

In various embodiments, a fluid delivery pod includes a first surface, a second surface that opposes the first surface, a reservoir body, an outlet port, a heating structure, and a valve assembly. The reservoir body is between the first and the second surfaces. The reservoir body is configured to house a fluid. The outlet port is positioned on a surface of the pod. The surface is between the first and the second surfaces. The heating structure is thermally coupled to the fluid housed within the reservoir body. The heating structure wirelessly receives energy from an energy source that is external to the fluid delivery pod. The wirelessly received energy heats the fluid housed within the reservoir body. In response to an application of compression forces on the first and the second surfaces, the valve assembly dispenses the heated fluid through the outlet port and out of the fluid delivery pod.

29 Claims, 43 Drawing Sheets

(51) Int. Cl.

| | |
|---|---|
| ***H05B 6/10*** | (2006.01) |
| ***B05B 11/02*** | (2006.01) |
| ***B05B 9/00*** | (2006.01) |
| ***B05B 9/08*** | (2006.01) |
| ***B05B 12/12*** | (2006.01) |
| ***A47K 5/12*** | (2006.01) |

(52) U.S. Cl.
CPC ..... *A47K 5/1217* (2013.01); *B05B 9/002* (2013.01); *B05B 9/0838* (2013.01); *B05B 11/02* (2013.01); *B05B 11/048* (2013.01); *B05B 12/122* (2013.01); *H05B 6/108* (2013.01)

(58) Field of Classification Search
CPC ... B05B 11/0002; B05B 11/02; B05B 11/048; B05B 9/002; B05B 9/0838; B05B 12/122; H05B 6/108; B67D 3/0022; B67D 7/80; Y10T 137/6606; A47K 5/1204; A47K 5/1205; A47K 5/1217; B65D 83/0033
See application file for complete search history.

(56) References Cited

U.S. PATENT DOCUMENTS

| | | | | |
|---|---|---|---|---|
| 3,826,224 | A * | 7/1974 | Baker | B05C 9/14 118/410 |
| 3,880,331 | A | 4/1975 | Perkins | |
| 4,258,864 | A | 3/1981 | Vahl et al. | |
| 4,426,024 | A | 1/1984 | Hogan et al. | |
| 4,809,878 | A | 3/1989 | Rainey | |
| 4,875,604 | A | 10/1989 | Czech | |
| 4,967,937 | A | 11/1990 | von Schuckmann | |
| 5,015,233 | A | 5/1991 | McGough et al. | |
| 5,024,656 | A | 6/1991 | Gasaway et al. | |
| 5,096,092 | A | 3/1992 | Devine | |
| 5,100,025 | A | 3/1992 | McGraw | |
| 5,104,004 | A | 4/1992 | von Schuckmann | |
| 5,150,820 | A | 9/1992 | McGill | |
| 5,240,144 | A | 8/1993 | Feldman | |
| 5,452,824 | A | 9/1995 | Danek et al. | |
| 5,520,892 | A | 5/1996 | Bowen | |
| 5,636,922 | A | 6/1997 | Clark | |
| 5,700,991 | A | 12/1997 | Osbern | |
| 5,788,124 | A | 9/1998 | Bougamont et al. | |
| 5,810,201 | A | 9/1998 | Besse et al. | |
| 5,836,482 | A | 11/1998 | Ophardt et al. | |
| 5,918,767 | A | 7/1999 | McGill | |
| 6,013,270 | A | 1/2000 | Hargraves et al. | |
| 6,131,766 | A | 10/2000 | King et al. | |
| 6,209,751 | B1 | 4/2001 | Goodin et al. | |
| 6,209,752 | B1 | 4/2001 | Mitchell et al. | |
| 6,216,911 | B1 | 4/2001 | Kreitemier et al. | |
| 6,279,777 | B1 | 8/2001 | Goodin et al. | |
| 6,302,304 | B1 | 10/2001 | Spencer | |
| 6,311,868 | B1 | 11/2001 | Kreitemier et al. | |
| 6,416,534 | B1 | 7/2002 | Montagnino et al. | |
| 6,454,127 | B1 | 9/2002 | Suomela et al. | |
| 6,467,651 | B1 | 10/2002 | Muderlak et al. | |
| 6,607,103 | B2 | 8/2003 | Gerenraich et al. | |
| 6,820,765 | B2 | 11/2004 | Pahl | |
| 6,866,163 | B2 | 3/2005 | McGill | |
| 6,978,912 | B2 | 12/2005 | Taylor et al. | |
| 7,033,004 | B2 | 4/2006 | Ghisalberti et al. | |
| 7,163,130 | B2 | 1/2007 | Lafond | |
| 7,337,920 | B2 | 3/2008 | Duck et al. | |
| 7,527,178 | B2 | 5/2009 | Lewis | |
| 7,687,744 | B2 | 3/2010 | Walter et al. | |
| 8,056,764 | B2 | 11/2011 | Paasch et al. | |
| 8,061,918 | B2 | 11/2011 | Skalitzky et al. | |
| 8,087,543 | B2 | 1/2012 | Yang et al. | |
| 8,096,445 | B2 | 1/2012 | Yang et al. | |
| 8,104,982 | B2 | 1/2012 | Duru | |
| 8,109,411 | B2 | 2/2012 | Yang et al. | |
| 8,240,933 | B2 | 8/2012 | Skalitzky et al. | |
| 8,336,738 | B2 | 12/2012 | Bouix et al. | |
| 8,453,877 | B2 | 6/2013 | Ionidis | |
| 8,757,454 | B2 | 6/2014 | Dong et al. | |
| 8,783,511 | B2 | 7/2014 | Snodgrass | |
| 8,792,781 | B1 | 7/2014 | Randall et al. | |
| 8,882,378 | B2 | 11/2014 | Bylsma et al. | |
| 8,921,746 | B2 | 12/2014 | Baarman et al. | |
| 8,998,036 | B2 | 4/2015 | Zhou et al. | |
| 9,237,831 | B1 | 1/2016 | Luu et al. | |
| 9,271,613 | B2 | 3/2016 | Rosko et al. | |
| 2002/0108965 | A1 | 8/2002 | Hill et al. | |
| 2004/0129722 | A1 | 7/2004 | Pahl | |
| 2004/0226962 | A1 | 11/2004 | Mazursky et al. | |
| 2005/0053368 | A1 | 3/2005 | Pesu et al. | |
| 2006/0054641 | A1 | 3/2006 | Evers | |
| 2006/0113326 | A1 | 6/2006 | Taylor et al. | |
| 2007/0000941 | A1 | 1/2007 | Hadden et al. | |
| 2008/0011784 | A1 | 1/2008 | Schneider et al. | |
| 2008/0078780 | A1 | 4/2008 | Sanger et al. | |
| 2008/0142551 | A1 | 6/2008 | Strobel-Schmidt | |
| 2009/0038685 | A1 | 2/2009 | Hill et al. | |
| 2009/0134139 | A1 | 5/2009 | Quartararo | |
| 2009/0140004 | A1 | 6/2009 | Scorgie | |
| 2011/0127815 | A1 | 6/2011 | Nickerson | |
| 2011/0303695 | A1 | 12/2011 | Fern | |
| 2012/0085784 | A1 | 4/2012 | Bakris | |
| 2012/0111885 | A1 | 5/2012 | Binderbauer et al. | |
| 2012/0125950 | A1 | 5/2012 | Bouix et al. | |
| 2012/0168459 | A1 | 7/2012 | D'Onofrio | |
| 2012/0305605 | A1 | 12/2012 | Vassaux et al. | |
| 2013/0020350 | A1 | 1/2013 | Gardos et al. | |
| 2013/0264328 | A1 | 10/2013 | Ulvr | |
| 2013/0264355 | A1 | 10/2013 | Jodoin | |
| 2014/0091083 | A1 | 4/2014 | McGarvey | |
| 2014/0138402 | A1 | 5/2014 | Warren et al. | |
| 2014/0197198 | A1 | 7/2014 | Paetow et al. | |
| 2014/0219701 | A1 | 8/2014 | Eberlein | |
| 2014/0263440 | A1 | 9/2014 | Burns | |
| 2014/0353335 | A1 | 12/2014 | Van Diepen | |
| 2014/0361002 | A1 | 12/2014 | Cable | |
| 2015/0078799 | A1 | 3/2015 | Baarman et al. | |
| 2015/0083754 | A1 | 3/2015 | Proper et al. | |
| 2015/0223292 | A1 | 8/2015 | Duffield et al. | |
| 2015/0245421 | A1 | 8/2015 | Heczko | |
| 2015/0273513 | A1 | 10/2015 | Buckalter et al. | |

FOREIGN PATENT DOCUMENTS

| | | | |
|---|---|---|---|
| DE | 202012000728 | U1 | 4/2012 |
| EP | 0333093 | A1 | 9/1989 |
| EP | 0914055 | B1 | 1/2000 |
| EP | 1076810 | A1 | 2/2001 |
| EP | 1240480 | A1 | 9/2002 |
| EP | 1345840 | A2 | 9/2003 |
| EP | 1991095 | A2 | 11/2008 |
| EP | 2033555 | A1 | 3/2009 |
| EP | 2108106 | A1 | 10/2009 |
| EP | 2074906 | B1 | 4/2010 |
| EP | 2274211 | A1 | 1/2011 |
| EP | 2364623 | A2 | 9/2011 |
| EP | 2579831 | A2 | 4/2013 |
| EP | 2865307 | A1 | 4/2015 |
| EP | 2637539 | B1 | 5/2015 |
| EP | 2640221 | A4 | 5/2015 |
| EP | 2451330 | B1 | 7/2015 |
| JP | 2001109943 | A | 4/2001 |
| WO | 0214211 | A1 | 2/2002 |
| WO | 2005002283 | A1 | 1/2005 |
| WO | 2007120791 | A2 | 10/2007 |
| WO | 2007120791 | A3 | 10/2007 |

* cited by examiner $\ell_1 > \ell_2 > \ell_3$

INDUCTIVELY HEATABLE FLUID RESERVOIR FOR VARIOUS FLUID TYPES

PRIORITY CLAIM

This patent application is a Continuation-in-Part of U.S. patent application Ser. No. 14/530,479, entitled INDUCTIVELY HEATABLE FLUID RESERVOIR, filed on Oct. 31, 2014, which is a Continuation-in-Part of U.S. patent application Ser. No. 14/137,130, entitled AUTOMATIC FLUID DISPENSER, filed on Dec. 20, 2013. The contents of both above referenced U.S. patent applications are hereby incorporated by reference.

FIELD OF THE INVENTION

This application relates to reservoirs for viscous fluids and, more particularly, to fluid reservoirs that include heating structures to inductively heat the fluid housed within the reservoir.

BACKGROUND OF THE INVENTION

Various dispensers for automatically heating and dispensing various fluid types, such as water-based and silicone-based lubricants, are described in U.S. patent application Ser. No. 14/530,447, entitled AUTOMATIC HEATED FLUID DISPENSER, filed on Oct. 31, 2014, the contents of which are hereby incorporated. Reservoirs that house the various fluid types and are received by the various dispensers are described in U.S. patent application Ser. No. 14/530,479, entitled INDUCTIVELY HEATABLE FLUID RESERVOIR.

In some of the embodiments described in these applications, the fluid is inductively heated. In such embodiments, the reservoirs include an inductive element that is thermally coupled to the fluid within. Conductive coils in the dispenser induce an electrical current in the inductive element, which heats the housed fluid.

The various fluid types are of various specific heat capacities. For instance, the specific heat capacity of a fluid depends upon, among other factors, the viscosity of the fluid. Thus, the total amount of energy required to heat the fluid by a predetermined temperature varies with the type fluid. It is for these and other concerns that the following disclosure is presented.

SUMMARY OF THE INVENTION

In one aspect of the invention, a dispenser includes a housing having a base configured to stably rest on a support surface. The housing includes a top portion positioned above the base such that a gap between the base and top portion is sized to receive a human hand. The top portion defines a cavity sized to receive a fluid reservoir and an opening extending directly through a lower surface of the top portion to the cavity. A pressing member is positioned within the cavity and an actuator is coupled to the pressing member and configured to urge the pressing member toward and away from the opening. A fluid reservoir may be positioned within the cavity, the fluid reservoir including a neck having a pressure actuated opening at a distal end thereof, the neck extending through the opening. In some embodiments, no portion of the dispenser, other than the base, is positioned in a flow path vertically beneath the pressure actuated opening.

In another aspect, the dispenser includes a controller mounted within the housing and operably coupled to the actuator, the controller configured to selectively activate the actuator. The dispenser may include a proximity sensor mounted in the housing and configured to detect movement within the gap. Alternatively, the sensor may be a motion detector or other sensor. In the preferred embodiment, the proximity sensor is operably coupled to the controller and the controller configured to activate the actuator in response to an output of the proximity sensor. In some embodiments, the proximity sensor is mounted within the top portion and the controller is mounted within the base. The dispenser may further include a light emitting device mounted within a portion of the housing, preferably within the top portion. The top portion in such embodiment includes a downward facing translucent panel positioned below the light emitting device. In at least some other embodiments, the top portion includes a thinner section of housing positioned below the light emitting device, such that at least a portion of the light may pass through the thinner section. The controller may be configured to activate the actuator to move between positions of a plurality of discrete positions including a start position and an end position in response to detecting of movement in the gap by the proximity sensor. The controller may also be configured to activate the actuator to move to the start position in response to detecting positioning of the actuator in the end position. The dispenser may additionally include a temperature-control element in thermal contact with the cavity or otherwise placed to heat the fluid reservoir. The temperature-control element is preferably a heating element, such as a resistance heater.

In another aspect, the actuator is configured to urge the pressing member in a first direction and the top portion includes a stop face arranged substantially transverse to the first direction (i.e., substantially normal to the first direction) and offset to a first side of the opening. The pressing member may include a pressing face extending upward from the opening and having a normal substantially parallel to the first direction. The pressing member may be positioned on a second side of the opening opposite the first side. The actuator is configured to urge the pressing member perpendicular to the first direction. In some embodiments, the top portion defines rails extending perpendicular to the first direction, the pressing member being configured to slidingly receive the rails. The fluid reservoir may be collapsible and positioned within the cavity having a first surface in contact with the stop face and a second surface in contact with the pressing face, the neck abutting the first surface, the body of the collapsible reservoir may have a substantially constant cross section along substantially an entire extent of the body between the first and second surfaces.

In another aspect, the pressing member includes a roller rotatably coupled to the actuator and defining an axis of rotation. The actuator is configured to move the roller in a first direction perpendicular to the axis of rotation across the cavity toward and away from the opening. The pressing member may include an axle extending through the roller, the top portion defining guides engaging end portions of the axle. The actuator may be coupled to the end portions of the axis by means of a flexible but substantially inextensible line. Springs may be coupled to the end portions of the axle and configured to urge the roller to a starting position offset from the opening.

In another aspect, the opening extends in a first direction through the lower surface of the top portion and the pressing member is positionable at a starting position having the cavity positioned between the opening and the pressing member. The actuator is configured to urge the pressing member from the starting position toward the opening along the first direction. In some embodiments, the lower surface of the top portion defines an aperture and a lid is hingedly secured to the lower surface and is selectively positionable over the aperture, the opening being defined in the lid. In some embodiments, one or more members extend from the cavity to a position offset from the cavity, each member of the one or more members being pivotally mounted to the top portion and including a first arm extending over the pressing member having the pressing member positioned between the first arm and the opening; and a second arm engaging the actuator.

In another aspect first and second rods are each pivotally coupled at a first end to one side of the cavity and having a second end positioned on an opposite side of the cavity. The actuator engages the first and second rods and is configured to draw the first and second rods through the cavity toward the opening.

In various embodiments, a dispenser includes a housing, an aperture in the housing, a receptacle within the housing, a heating element, and an actuator. The aperture may be a dispensing aperture. The receptacle or cavity is configured and arranged to removably receive a reservoir. When the reservoir is received by the receptacle, an outlet port of the reservoir is exposed through the aperture. The heating element is configured and arranged to energize or heat fluid housed within the reservoir. When the actuator is actuated, the actuator provides a dispensing force that induces a flow of a predetermined volume of energized fluid within the reservoir through the exposed outlet port of the reservoir. Accordingly, the dispenser dispenses the energized predetermined volume through the aperture.

The actuator includes a convertor that converts electrical energy to provide the dispensing force. In at least one embodiment, the convertor is a stepper motor, such as an electric stepper motor. The dispensing force translates a piston in the reservoir a predetermined distance to induce the flow of and dispense the predetermined volume of energized fluid.

In some embodiments, the predetermined distance is linearly proportional to the predetermined volume of dispensed energized fluid. The heating element may be configured and arranged to induce an electrical current in a heating structure. The heating structure is thermally coupled to the fluid housed in the reservoir. The induced current in the heating structure energizes or heats the fluid.

In various embodiments, the dispenser further includes a sensor that generates a signal when an object is positioned proximate to the aperture in the housing or the object is moving relative to the aperture. The signal actuates the actuator. The dispenser also includes a source that emits electromagnetic energy, such as photons or waves, in a frequency band. The frequency band is within the visible spectrum. The emitted electromagnetic energy illuminates at least a portion of the dispenser. The frequency band is based on a user selection. An intensity of emitted electromagnetic energy is based on a user selection. The illuminated portion of the dispenser includes at least a region of the housing that is disposed underneath the aperture. In some embodiments, the source is a light emitting diode (LED).

In some embodiments, the housing includes a base portion underneath the aperture. The housing is configured and arranged to receive a user's hand between the base portion and aperture. The base portion may include a containment depression or recess positioned directly below the aperture. The containment depression is configured and arranged to contain the dispensed volume of fluid.

The aperture is configured and arranged such that when the predetermined volume of fluid flows through the outlet port of the reservoir, the predetermined volume of fluid is dispensed without contacting a perimeter of the aperture. The predetermined volume may be based on a user selection. The heating element may surround at least a portion of the receptacle, such that the heating element is configured and arranged to substantially uniformly energize at least a portion of the fluid housed with the reservoir. In at least some embodiments, the receptacle is a pivoting receptacle that is configured and arranged to pivot to an open position and a closed position. The dispenser may include a pivot assembly that is configured and arranged to pivotally rotate at least one of the receptacle, the heating element, and the actuator.

In some embodiments, a fluid dispenser includes a housing, an aperture in the housing, a receptacle within the housing, an actuator, and a power source. The aperture may be a dispensing aperture. The receptacle is configured and arranged to receive a reservoir. When the reservoir is received by the receptacle, an outlet port of the reservoir is exposed through the aperture. When actuated, the actuator provides a dispensing force that induces a flow of a volume of fluid within the reservoir through the outlet port of the reservoir and dispenses the volume of fluid through the aperture. The power source provides power to the actuator. The power source includes an alternating current source.

In at least one embodiment, the dispenser further includes a heating element. The alternating current source provides alternating current to the heating source. The heating element may be proximate to the receptacle. The dispenser may further include a motor that provides the dispensing force. The alternating current source provides alternating current to the motor. The dispenser may also include at least one touch sensitive sensor. The at least one touch sensitive sensor is enabled to detect a user's touch through the housing.

A fluid reservoir includes a reservoir body, a heating structure, a piston, and an outlet port disposed on the reservoir body. The reservoir body includes a first end, a second end, a cross section, and a translation axis. The translation axis is substantially orthogonal to the cross section. The translation axis is defined by the first end and the second end. The cross section is substantially uniform along the translation axis. When fluid is housed in the reservoir, the heating structure is thermally coupled to the fluid. The heating structure is configured and arranged to energize or heat at least a portion of the fluid housed in the reservoir. The piston is configured and arranged to translate along the translation axis. An available volume of the reservoir to house the fluid is defined by a distance between the piston and the second end of the reservoir body. The second end of the reservoir may be a closed end of the reservoir. When the piston is translated along the translation axis toward the second end, a volume of the fluid that has been energized by the heating structure flows from the reservoir and through the outlet port. The volume of energized fluid is linearly proportional to a length of the translation of the piston.

In some embodiments, the heating structure is a conductive disk that includes a cross section that substantially matches the cross section of the reservoir body. The heating structure may be disposed proximate to the second end of the reservoir body. In a preferred embodiment, the reservoir further includes in-use tabs configured and arranged to indicate if the piston has been translated from an initial position. The first end of the reservoir body is an open end to receive the piston. The second end of the reservoir body is a closed end. The reservoir body may be a cylindrical body. The second end is a cylinder base.

In at least one embodiment, the outlet port includes a valve configured and arranged such that the fluid housed in the reservoir flows through the valve in response to a translation of the piston towards the second end of the reservoir body. The valve is further configured and arranged to retain the fluid within the reservoir when the piston has not been translated. The outlet port includes a valve retainer configured and arrange to mate with an aperture of a dispenser when the reservoir is received by a cavity within a dispenser. The valve retainer includes a retainer perimeter that is configured and arranged such that when the fluid housed in the reservoir flows through the outlet port, the flowing fluid flows without contacting the retainer perimeter.

In various embodiments, a cross section of the outlet port is oriented substantially perpendicular to the translation axis. In other embodiments, a cross section of the outlet port is oriented substantially parallel to the translation axis. The outlet port may disposed proximate to the heating structure, such that the fluid that flows through the outlet port is proximate the heating structure prior to flowing through outlet port. The piston includes a driven structure configured and arranged to mate with a driveshaft driven by a motor. In at least one embodiment, the piston includes a driven structure configured and arranged to mate with a driveshaft driven by pressurized gas.

In some embodiments, a fluid reservoir includes a reservoir body, a heating structure, a piston, a nozzle, and at least a first valve. Some embodiments include a second valve. The reservoir body includes a longitudinal axis and a volume that is configured and arranged to house at least a portion of the fluid housed in the reservoir. When fluid is housed in the volume of the reservoir body, the heating structure is thermally coupled to the fluid housed in the body and configured and arranged to energize at least a portion of the fluid housed within the body. The piston is configured and arranged to translate along at least a portion of the longitudinal axis of the reservoir body. The nozzle disposed on a surface of the reservoir configured and arranged to output the fluid housed within the reservoir. The first valve resists the output of the fluid through the nozzle unless a dispensing force is applied to the reservoir. The dispensing force increases an internal pressure of the fluid to overcome a resistance of the first valve.

In some embodiments, the reservoir includes a bottom cap that includes and aperture to enable a driveshaft to apply the dispensing force to the piston, wherein when the dispensing force is applied to the piston, the piston is translated along the longitudinal axis and the resistance of the first valve is overcome to output a portion of the fluid from the nozzle. The reservoir may further include a nozzle assembly. When a dispensing force is applied to the nozzle assembly, the nozzle assembly is translated relative the reservoir body and the resistance of the first valve is overcome to output a portion of the fluid from the nozzle.

The nozzle may be an angled nozzle. When the reservoir is received by a fluid dispenser, the angled nozzle is oriented substantially vertical At least one embodiment includes an alignment member that enables a proper nozzle alignment when the reservoir is received by a fluid dispenser. The heating structure includes a conductive tube-shaped element that uniformly lines at least a portion of the volume of the reservoir body. In preferred embodiments, the heating structure is a stainless steel heating structure. The first valve may be a ball valve. In other embodiments, the first valve is a spring valve. In some embodiments, the first valve and a second valve work together to selectively inhibit and enable a fluid flow. In some embodiments, the second valve is a ball valve, while in other embodiments the second valve is a spring valve or a needle valve.

Some embodiments of a reservoir include comprising a seal that is configured and arranged to provide a visual indication if the piston has previously been translated from an initial position. The reservoir may be an airless pump reservoir. The reservoir may be a modified or customized bottle, wherein the cosmetic industry utilizes bottles that are similar to the un-customized or unmodified bottle. At least one embodiment includes an over cap that is configured and arranged to prevent an output of fluid from the nozzle when the reservoir is not in use.

In various embodiments, a fluid reservoir, or a fluid delivery pod, includes a first surface, a second surface that opposes the first surface, a reservoir body, an outlet port, a heating structure, and a valve assembly. The reservoir body is between the first and the second surfaces. The reservoir body is configured to house a fluid. The outlet port is in fluid communication with the reservoir and may be positioned on a surface of the reservoir. The surface is between the first and the second surfaces. The heating structure is thermally coupled to the fluid housed within the reservoir body. The heating structure is electrically conductive to wirelessly receive inductive energy from an energy source that is external to the fluid reservoir. The wirelessly received energy heats the fluid housed within the reservoir body. In response to an application of compression forces on the first and the second surfaces, the valve assembly dispenses the heated fluid through the outlet port and out of the fluid reservoir.

A physical dimension of the heating structure is based on a fluid type of the fluid housed within the reservoir body. The physical dimension may be a length, an inner radius, or an outer radius. Another reservoir may house another type of fluid. The other reservoir includes another heating structure. A physical dimension of the other heating structure is based on the other fluid type. In at least one embodiment, the physical dimension of the reservoir and the physical dimension of the other reservoir are different because the two fluid types are different.

In some embodiments, the valve assembly includes a lower chamber. The heating structure is positioned around at least a portion of the lower chamber of the valve assembly. The lower chamber of the valve assembly and the heating structure are coaxial along an axis that extends between the first and the second surfaces.

In various embodiments, the heating structure is a conductive tube that includes a length, an inner radius, and an outer radius. In some embodiments, the length of the heating structure is between 13 and 17 millimeters. In other embodiments, the length of the heating structure is between 3 and 7 millimeters. The lower chamber of the valve assembly slidably receives the heating structure.

In some embodiments, a fluid reservoir includes a reservoir body, a nozzle, a valve assembly, and a heating structure. The reservoir body includes a first end, a second end, and a volume. The volume houses a fluid. The first end includes an aperture or an indent. The aperture or indent receives an actuator. The nozzle communicates with the interior volume of the reservoir. The nozzle outputs the fluid housed within the reservoir. The valve assembly includes a lower chamber and a first valve. The first valve resists the output of the fluid through the nozzle unless a dispensing force is applied to the reservoir. The dispensing force increases an internal pressure of the fluid to overcome a resistance of the first valve. The heating structure is arranged around an outer surface of the lower chamber of the valve assembly. When fluid is housed in the volume of the reservoir body, the heating structure is thermally coupled to the fluid. The heating structure heats the fluid housed within the body.

In some embodiments, the heating structure is a conductive tube. The conductive tube includes a length, an aperture of an inner radius, and an outer radius. The aperture receives the lower chamber of the valve assembly. The length of the heating structure is based on a fluid type of the fluid housed in the volume of the reservoir body. The outer radius or the inner radius of the heating structure is based on a fluid type of the fluid housed in the volume of the reservoir body. The outer radius of the heating structure may be between 6 mm and 10 mm. The tube includes an overlapped region, a welded region, or a gapped region.

The first end of the reservoir body includes the aperture. The reservoir further includes a piston housed within the volume of the reservoir body. The piston translates along a translation axis. When the aperture receives the actuator, the actuator engages the piston. The actuator provides the dispensing forces on the piston.

In another embodiment, a fluid reservoir includes a reservoir body, a heating structure, a nozzle, and a valve assembly. The reservoir body includes a longitudinal axis and forms an enclosure to contain a volume. The volume houses the fluid. When fluid is housed in the volume of the reservoir body, the heating structure is thermally coupled to the fluid. The heating structure energizes the fluid housed within the body. A length of the heating structure is based on a fluid type of the fluid. The nozzle communicates with an interior of the reservoir. The nozzle outputs the housed fluid. The valve assembly resists the output of the fluid through the nozzle unless a compression force is applied to the reservoir along the longitudinal axis.

The reservoir further includes a piston. The piston translates along the longitudinal axis of the reservoir body. The heating structure and a lower chamber of the valve assembly are coaxial with the longitudinal axis. A thickness of the heating structure is based on the fluid type of the housed fluid.

The length of the heating structure is a first length when a first fluid type of a first specific heat capacity is housed within the reservoir body. The length of the heating structure is a second length when a second fluid type of a second specific heat capacity is housed within the reservoir body. The first length is greater than the second length. The first specific heat capacity is greater than the second specific heat capacity.

A method for providing a fluid delivery pod, or fluid reservoir, includes determining a type of fluid to house within the pod. A physical dimension of a heating structure is determined and based on the type of fluid. A variance in the physical dimension varies the electrical conductance of the heating structure. The method further includes providing the heating structure with the pod. The heating structure may be integrated with or otherwise positioned within the pod. The provided heating structure includes the physical dimension that is based on the type of fluid.

In at least one embodiment, the method further includes determining a type of conductive material based on the type of fluid. The heating structure is constructed from the determined type of conductive material. A variance in the type of conductive material varies the electrical conductance of the heating structure.

In some embodiments, the type of conductive material includes stainless steel or surgical steel. The type of fluid may include a water-based lubricant or a silicone-based lubricant. The determined physical dimension of the heating structure may include the length of the heating structure. The length of the heating structure may be between 13 and 17 millimeters. In other embodiments, the length of the heating structure is between 3 and 7 millimeters.

The heating structure may be a cylindrical or tube-shaped heating structure. In at least one embodiment, the physical dimension may include a diameter, such as an inner or an outer diameter. The diameter may be between 6 and 10 millimeters.

BRIEF DESCRIPTION OF THE DRAWINGS

Preferred and alternative examples of the present invention are described in detail below with reference to the following drawings:

In FIG. 26A, the pivoting receptacle assembly is pivoted to a closed position; in FIG. 26B, the pivoting receptacle assembly is pivoted to an open position.

DETAILED DESCRIPTION OF THE PREFERRED EMBODIMENT

Figure 1:
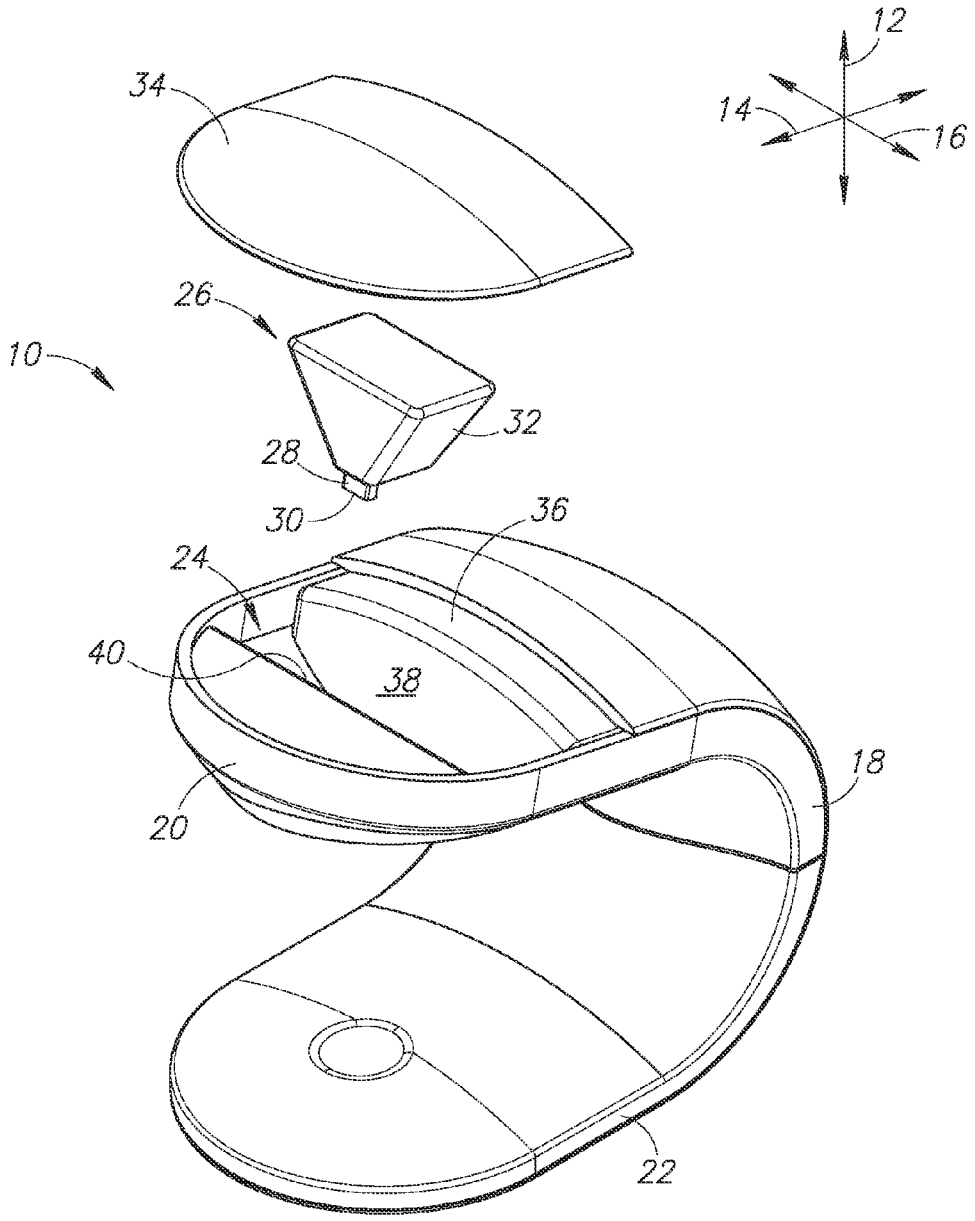
FIG. 1 is an isometric view of a first embodiment of a dispenser incorporating a compressing element in accordance with an embodiment of the invention.

Referring to FIG. 1, a dispenser 10 may be understood with respect to a vertical direction 12, a longitudinal direction 14 perpendicular to the vertical direction 12, and a lateral direction 16 perpendicular to the vertical and longitudinal directions 12, 14. The vertical direction 12 may be perpendicular to a planar surface on which the dispenser 10 rests. Likewise, the lateral and longitudinal directions 14, 16 may be parallel to the support surface.

The dispenser 10 may include a housing 18 that has a C-shape in the longitudinal-vertical plane. Accordingly, the housing 18 may include an upper portion 20 and a base 22 such that a vertical gap is defined between the upper portion 20 and the base 22. The upper portion 20 may define a cavity 24 for receiving a reservoir 26. The reservoir 26 may include a neck 28 defining an opening 30 and a body 32 coupled to the neck 28. The neck 28 may be smaller such that the body 32 can be inserted into an opening through which the body 32 cannot pass, or cannot pass through without deformation. The cavity 24 may be wider than the body 32 in the lateral direction 16 to facilitate removal of the reservoir 26. The opening 30 may be a pressure sensitive opening that is closed in the absence of pressure applied to the body 32, but will permit fluid to pass therethrough in response to an above-threshold pressure at the opening 30. For example, the opening 30 may be any of various "no-drip" systems used in many condiment dispensers known in the art.

The cavity 24 may be accessible by means of a lid 34 covering a portion of the upper portion 20. The lid 34 may secure to the upper portion 20 vertically above the upper portion 20, vertically below the upper portion 20 or to a lateral surface of the upper portion 20. The lid 34 may be completely removable and secure by means of a snap fit or some other means. The lid 34 may also be hingedly secured to the upper portion or slide laterally in and out of a closed position. For example, a slide out drawer defining a portion of the cavity 24 for receiving the reservoir 26 may slide in and out of a lateral surface of the upper portion 20.

A pressing member 36 is slidable into and out of the cavity 24 in order to compress the reservoir 26 and retract to enable insertion of a refill reservoir 26 after an extractable amount of fluid has been pressed out of an original reservoir 26. The pressing member 36 may define a pressing face 38 positioned opposite a stop face 40 defining a wall of the cavity 24.

Figure 2:
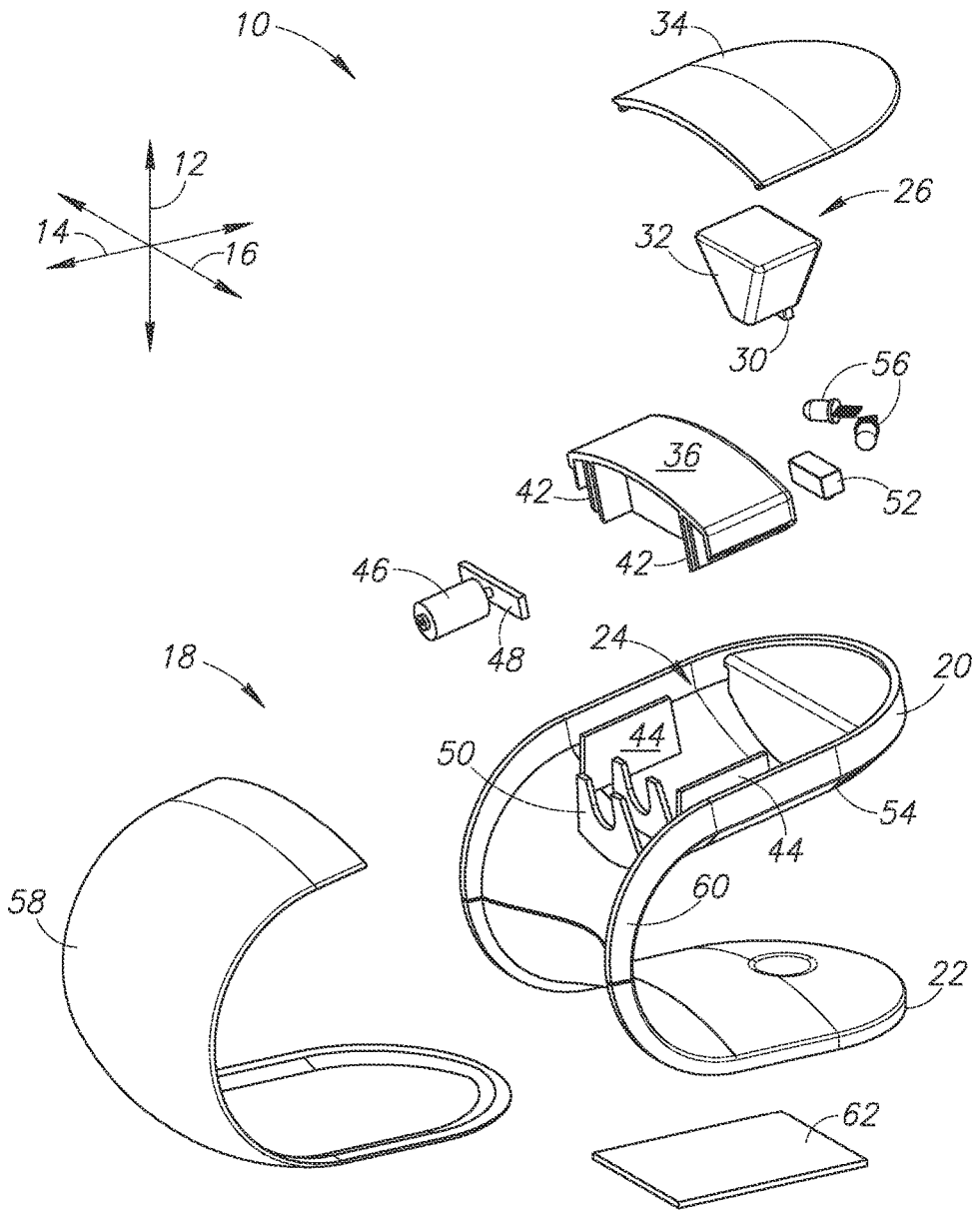
FIG. 2 is an exploded view of the dispenser of FIG. 1.

Referring to FIG. 2, the pressing member 36 may slidably mount to the housing 18. For example, the pressing member 36 may define one or more slots 42 that receive rails 44 secured to the upper portion 20. Alternatively, rails formed on the pressing member 36 may insert within slots defined by the upper portion 20. An actuator 46 may engage the pressing member 36 in order to move the pressing member 36 toward the reservoir 26 in order to force fluid therefrom. The actuator 46 may be any linear actuator, such as a motor driven screw or worm gear, servo, rotating cam, or the like. In particular, the actuator 46 may advantageously maintain its state in the absence of applied power. The actuator 46 may secure within one or more actuator mounts 50 secured to the upper portion 20 or some other portion of the housing 18, including the base 22. In the illustrated embodiment, the actuator 46 engages the pressing member 36 by means of a spreader 48 that distributes the force over a greater area of the pressing member 36.

The dispenser 10 may include a proximity sensor 52 that is configured to sense the presence of a human hand within the gap between the upper and lower portions 20, 22. The mode in which the proximity sensor 52 identifies the presence of a human hand may include various means such as by detecting reflected light, interruption of light incident on the proximity sensor 52, detecting a thermal signature or temperature change, change in inductance or capacitance, or any other modality for detecting movement, proximity, or presence of hand. The proximity sensor 52 may protrude below a lower surface 54 of the upper portion 20 or be exposed through the lower surface 54 to light, air, or thermal energy in the gap between the upper and lower portions 20, 22. Other sensors than proximity sensors may be employed, such as voice-activated sensors. Furthermore, multiple sensors may be employed in the same or various parts of the device.

In some embodiments, one or more light-emitting elements 56 may be mounted in the upper portion 20 and emit light into the gap between the upper and lower portions 20, 22. For example, the lower surface 54 or a portion thereof may be translucent or perforated to allow the light from the light-emitting elements to reach the gap. The light-emitting elements 56 may be light emitting diodes (LED), incandescent bulbs, or other light emitting structure. Alternatively, lighting elements may provide light emitting from the bottom or side.

Various structures or shapes may form the housing 18. In the illustrated embodiment, the housing 18 includes a curved outer portion 58 and a curved inner portion 60 that when engaged define a curved or C-shaped cavity for receiving the components of the dispenser 10. The ends of the curved portions 58, 60 may be planar, or include planar surfaces. In particular, the outer curved portion 58 may include a lower end with a planar lower surface for resting on a flat surface, or three or more points that lie in a common plane for resting on a flat surface.

A controller 62 may mount within the housing 18, such as within the base 22. The controller 62 may be operably coupled to some or all of the actuator 46, proximity sensor 52, and light-emitting elements 56. The controller 62 may be coupled to these elements by means of wires. The controller 62 may also be coupled to a power source (not shown) such as a battery or power adapter. The controller 62 may be embodied as a printed circuit board having electronic components mounted thereon that are effective to perform the functions attributed to the controller 62. The controller 62 may include a processor, memory, or other computing capabilities to perform the functions attributed thereto.

Figure 3:
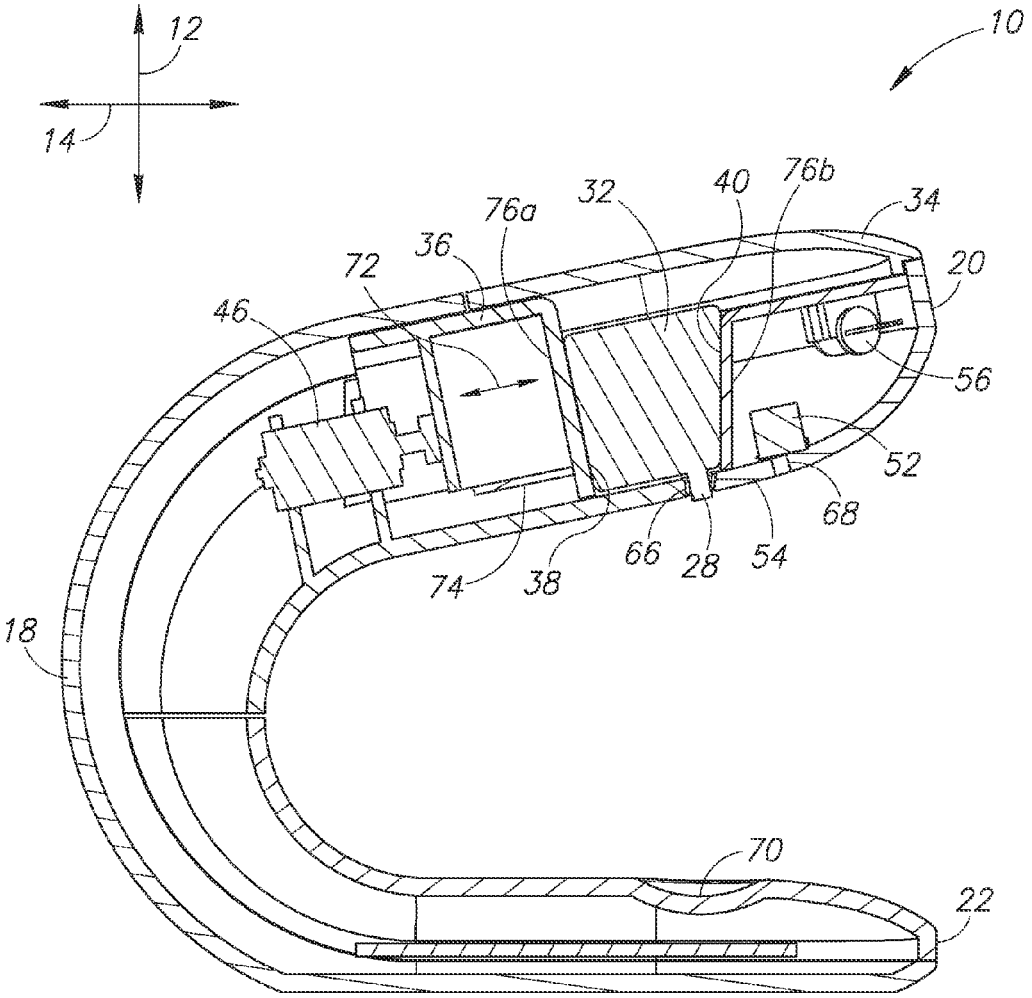
FIG. 3 is a side cross-sectional view of the dispenser of FIG. 1.
Figure 4:
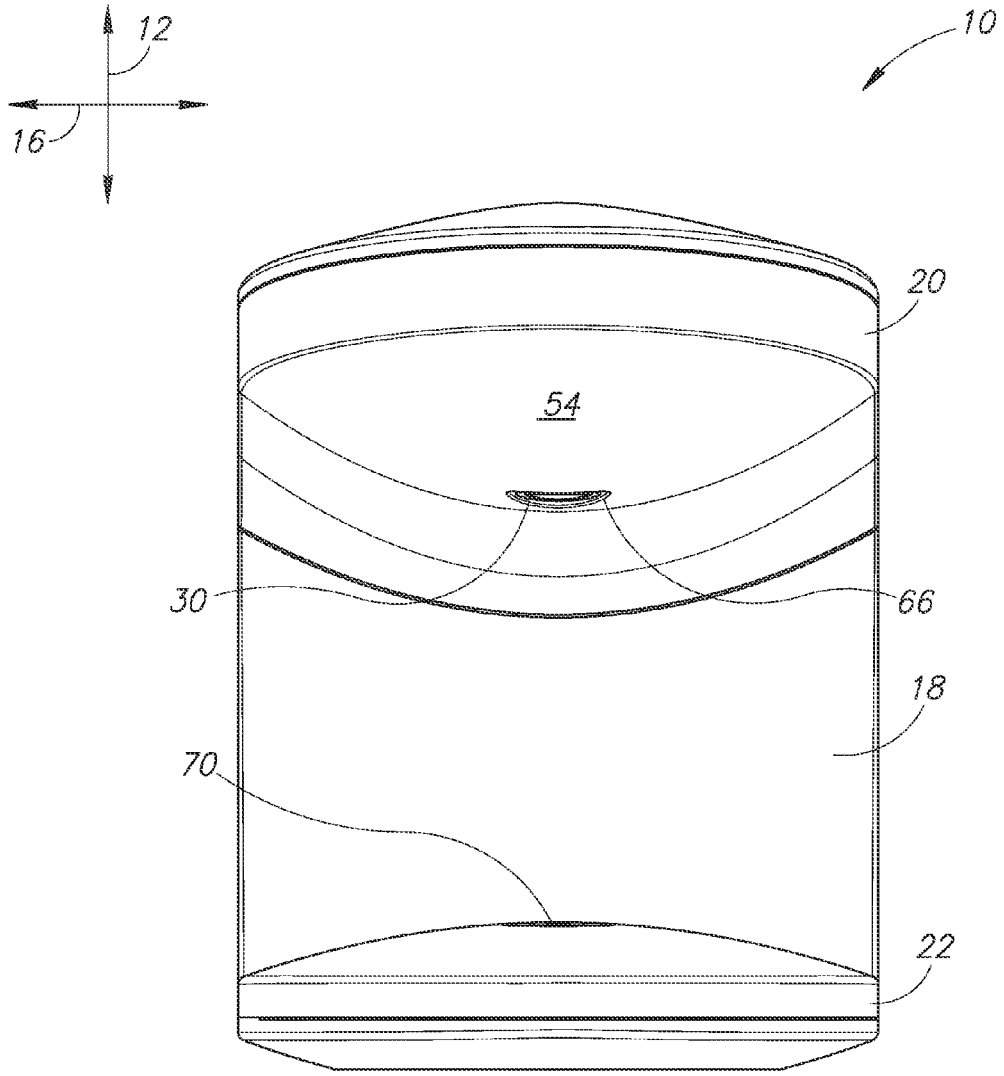
FIG. 4 is a front elevation view of the dispenser of FIG. 1.

Referring to FIGS. 3 and 4, the lower surface 54 of the upper portion 20 may define an opening 66 for receiving the neck 28 of the reservoir 26. As shown, the opening 30 is free to dispense fluid without the fluid being incident on any portion of the dispenser, other than the base 22, if the fluid is not incident on a user's hand. As is also apparent, the opening 30 and the neck 28 are disposed closer to the stop face 40 than to the pressing face 38. In this manner, as the body 32 of the reservoir 26 is collapsed, the neck 38 inserted within the opening 30 does not interfere with advancing of the pressing face 38. The neck 28 may be located as close as possible to the surface of the body 32 engaging the stop face 40. For example, a gap between the stop face 40 and the pressing face 38 above the opening 66, e.g. measured parallel to the surface of the housing supporting the reservoir 26, may be X and the distance between the stop face 40 and the neck 28 and the side of the neck closest the stop face may be less than 10% X, preferably less than 5% X.

The lower surface 54 of the upper portion 20 may additionally define an opening 68 for receiving a portion of the proximity sensor 52 or for allowing light, vibrations, thermal energy, and the like to be incident on the proximity sensor 52. The lower surface 54 may additionally include an opening for allowing light from the light-emitting devices 56 to radiate the gap. Alternatively, the lower surface 54 may be translucent or transparent or include translucent or transparent portions to allow light to pass through the lower surface 54. In some embodiments, a marker 70, such as a depression, painted mark, or other visual indicator may be defined in an upper surface of the base 22 positioned vertically below the opening 66 to indicate where the dispenser 10 will dispense fluid.

The pressing member 36 may slide back and forth in an actuator direction 72 that is generally parallel to the longitudinal direction, e.g. within 20 degrees. The pressing face 38 may be substantially perpendicular to the actuator direction 72, e.g. the normal of the pressing face 38 may be within +/−5, preferably within +/−1, degree of parallel to the actuator direction 72. The stop face 40 may also be substantially perpendicular to the actuator direction (i.e. have a nearly parallel normal). However, in the illustrated embodiment, the stop face 40 is slanted to facilitate insertion of the reservoir 26. For example, the stop face may have a normal that points upward from the actuator direction 72 by between 2 and 10 degrees, or some other non-zero angle.

In some embodiments, the reservoir 26 may be directly or indirectly heated by a heating element 74 that may be operably coupled to the controller 62 or directly to a power source and may include a thermal sensor enabling thermostatic control thereof. In the illustrated embodiment, the heating element 74 is coupled to the pressing member 36, such as to the illustrated lower surface of the pressing member perpendicular to the pressing face 38. Other possible locations include the illustrated location **76*a* immediately opposite the pressing face 38 or location 76*b* immediately opposite the stop face 40. In some embodiments, it may be sufficient to simply heat the air around the reservoir 26 such that thermal contact with the reservoir 26 or structure facing the reservoir 26 is not required. Accordingly, the heating element 74 may be placed at any convenient location within the upper portion 20 or some other part of the housing 18**. Other temperature-control elements may alternatively be used to either heat or cool or maintain a temperature of the fluid.

The controller 62 may be configured to move the pressing member 36 from a starting position shown in FIG. 3 to an end position located closer to the stop face 40. The controller 62 may be configured to move the pressing member 36 between discrete positions between the start and end positions. For example, the controller 62 may be configured to cause the actuator 46 to move the pressing member 36 from one position to a next position responsive to a detecting of movement based on an output of the proximity sensor 52. Upon detecting the pressing member 36 reaching the end position, the controller 62 may be configured to cause the actuator 46 to move the pressing member 36 to the start position. Detecting reaching of the end position may be determined by counting a number of times the pressing member 36 has been advanced from the start position, e.g. upon advancing the pressing member N times, the controller 46 may be configured to return the pressing member to the start position. In one preferred embodiment, the user may adjust the amount of advancement of the pressing member 36 with the controller. In this way an individual user may have more or less fluid delivered to the hand upon placing the hand beneath the opening. A rotatable adjustment knob or other switch (e.g., up & down arrow buttons) may be provided for such purpose.

Figure 5:
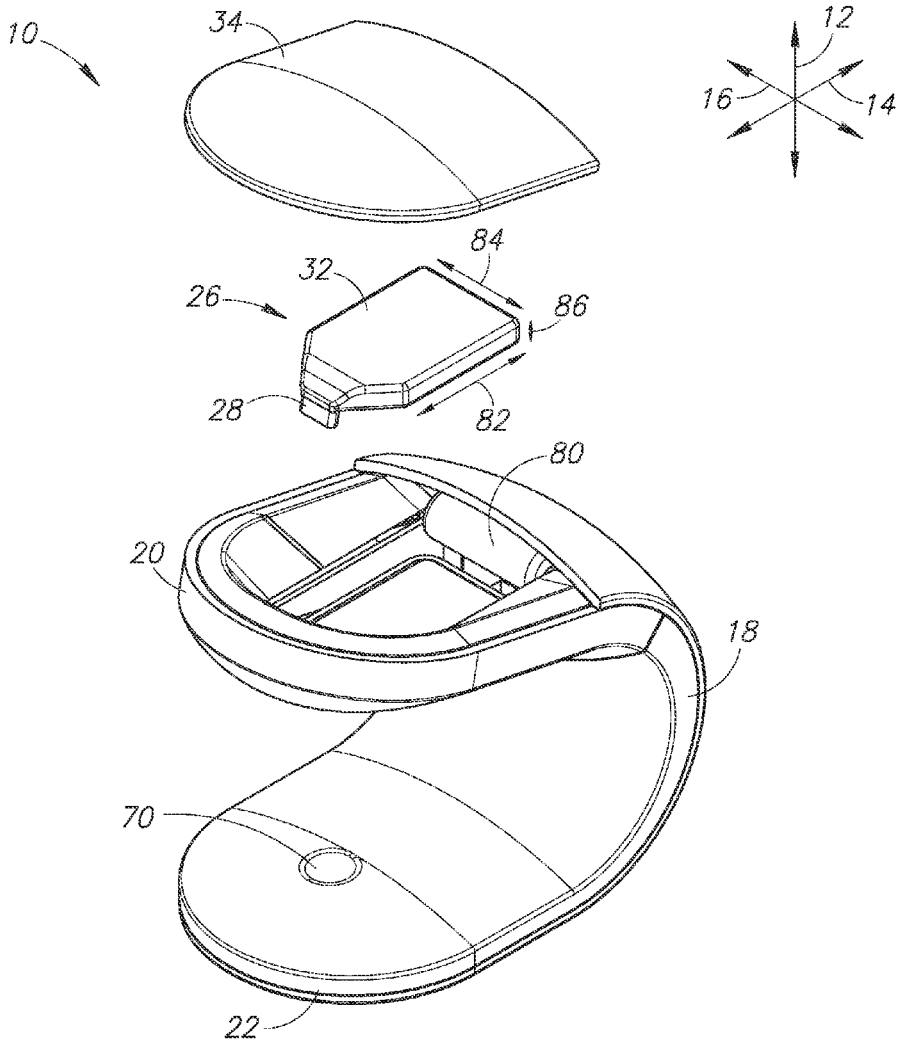
FIG. 5 is an isometric view of a second embodiment of a dispenser incorporating a rolling element in accordance with an embodiment of the invention.

Referring to FIG. 5, in some embodiments, the pressing member 36 may be embodied as a roller 80 that squeezes fluid from the reservoir 26 as it is urged across the reservoir. To facilitate this operation, the body 32 may be flat such that the length 82 and width 84 thereof are substantially greater than a thickness 86 thereof. The width 84 dimension may be parallel to an axis of rotation of the roller 80 when placed within the cavity 24 and the length 82 may be parallel to a direction of travel of the roller 80 in response to actuation thereof. The thickness 86 dimension may be perpendicular to both the length and width 82, 84 dimensions. The neck 28 may be located at or near an end of the body 32 along the length dimension 82 thereof. In particular, to enable insertion of the reservoir 26, the roller 80 may be positioned at a starting position shown in FIG. 5. The neck 28 may be located at an end of the body 32 opposite the end closest the roller 80 when in the illustrated starting position.

Figure 6:
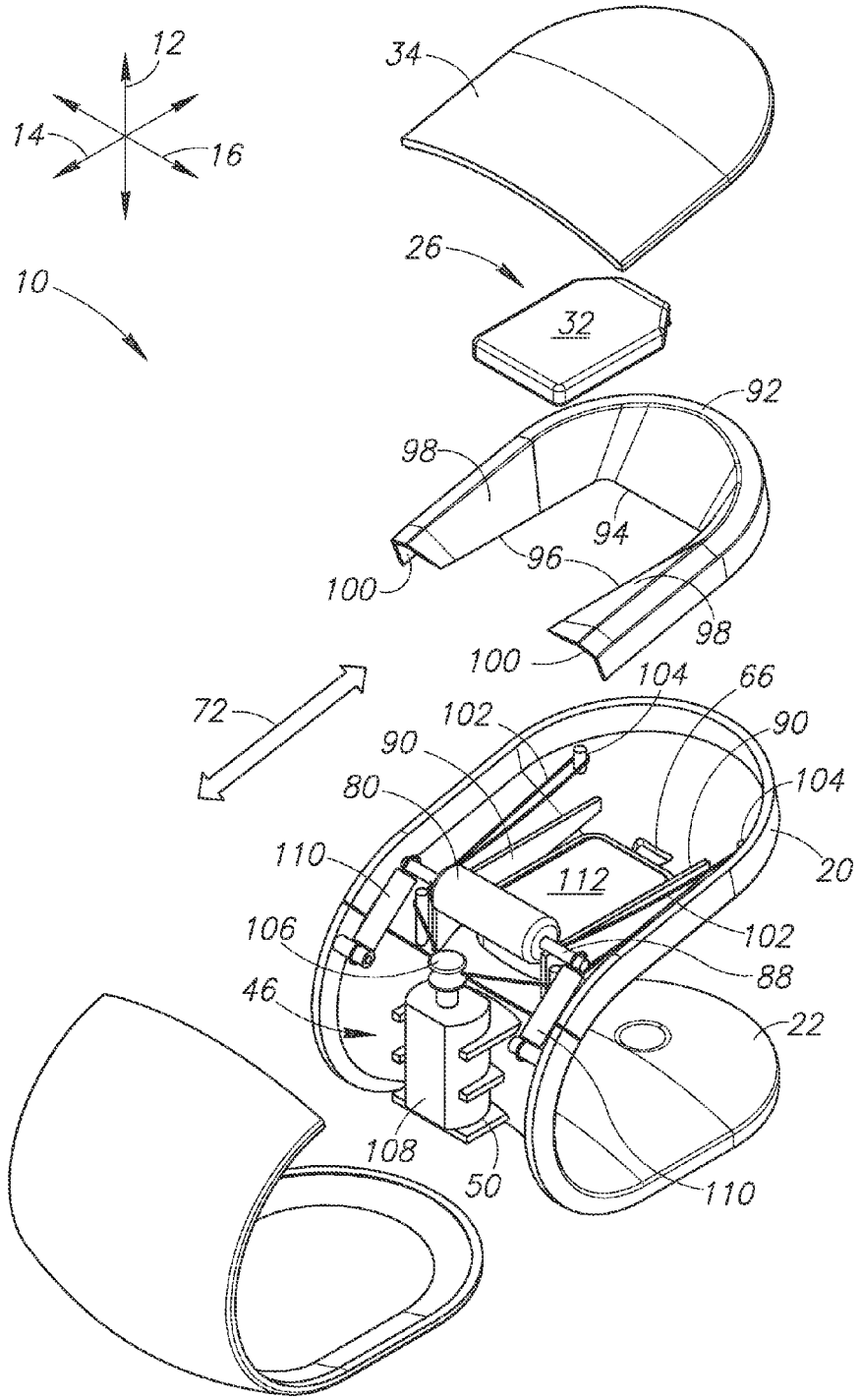
FIG. 6 is a partially exploded view of the dispenser of FIG. 5.
Figure 7:
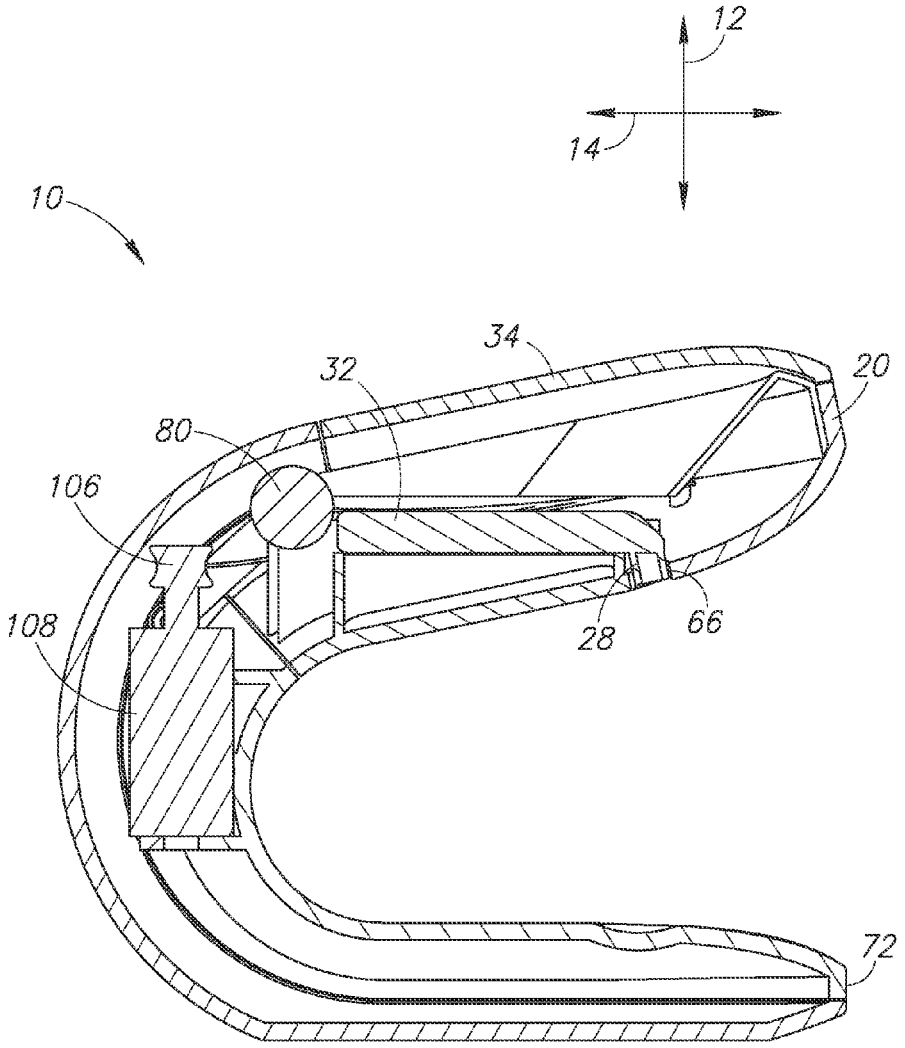
FIG. 7 is a side cross-sectional view of the dispenser of FIG. 5.

Referring to FIGS. 6 and 7, the roller 80 may rotate about one or more axles 88 having ends that protrude out of the roller 80. The axles may rest on ridges 90 that define the actuation direction 72 for the roller 80 and have upper edges parallel to the actuation direction 72. The axles 88 may further be retained on the ridges 90 by means of a U-shaped cover 92. The cover 92 may include a cutout portion 94 having parallel edges 96 between which the roller 80 is permitted to travel. The edges 96 or other portion of the cover 92 may be positioned opposite the ridges 90 in order to provide a slot within which the axles 88 may slide. The cover 92 may have faces 98 that slope upward with distance from the cutout 94 in order to guide the reservoir 26 into the cavity 24. The cover 92 may define channels 100 on either side, or a U-shaped channel extending on both sides, of the cut out portion 94.

In some embodiments, the channels 100 may provide a space for accommodating lines 102 for pulling the axle along the slot between the edges 96 and the ridges 90. In the illustrated embodiment, the lines 102 secure to ends of the axle 88, extend around posts 104, and each couple to a common pulley 106 or spool that is driven by an actuator 46 including a rotational actuator 108. In response to rotation of the rotational actuator 108, the lines are wound onto the pulley 106 thereby drawing the roller 80 toward the posts 104 and the opening 66 through which the neck 28 of the reservoir 26 passes. To return the roller 80 to the starting position, biasing members, such as springs 110 may be coupled to the housing 18 and to the axle 88 on either side of the roller 80. Upon removal of force exerted by the rotational actuator 108, the springs 110 may urge the roller back to the starting position. Alternatively, the springs may bias the roller toward a forward position of compression of the reservoir. In such an alternate embodiment, the lines 102 and actuator 108 serve to allow the roller to advance under the pull of the spring or springs and to pull the roller back against the spring pressure to a non-compressing, starting position.

The rotational actuator may maintain its state, e.g. lock when not changing position, such that the roller 80 may be stepped between various positions between the starting position and a final position nearest the opening 66. As is apparent in FIG. 6, a support surface 112 may support the body 32 of the reservoir 26 such that the body 32 is pinched between the roller 80 and the support surface 112 during movement of the roller.

The embodiment of FIGS. 5 to 7 may likewise include a controller 62, proximity sensor 52, and lights 56 configured similar to those shown in FIGS. 1 to 4. As for other embodiments disclosed herein, the controller 62 may be configured to advance the roller 80 between discrete positions in response to detecting proximity using the proximity sensor 52. Likewise, the controller 62 may be configured to return, or allow the return, of the roller 80 to the start position upon reaching the end position. The embodiments of FIGS. 5 to 7 may likewise include a heating element 74 as for the embodiments of FIGS. 1 to 4 located at a location within the upper portion 20, such as interfacing with the support surface 112 or otherwise positioned to heat air within the upper portion 20.

Figure 8:
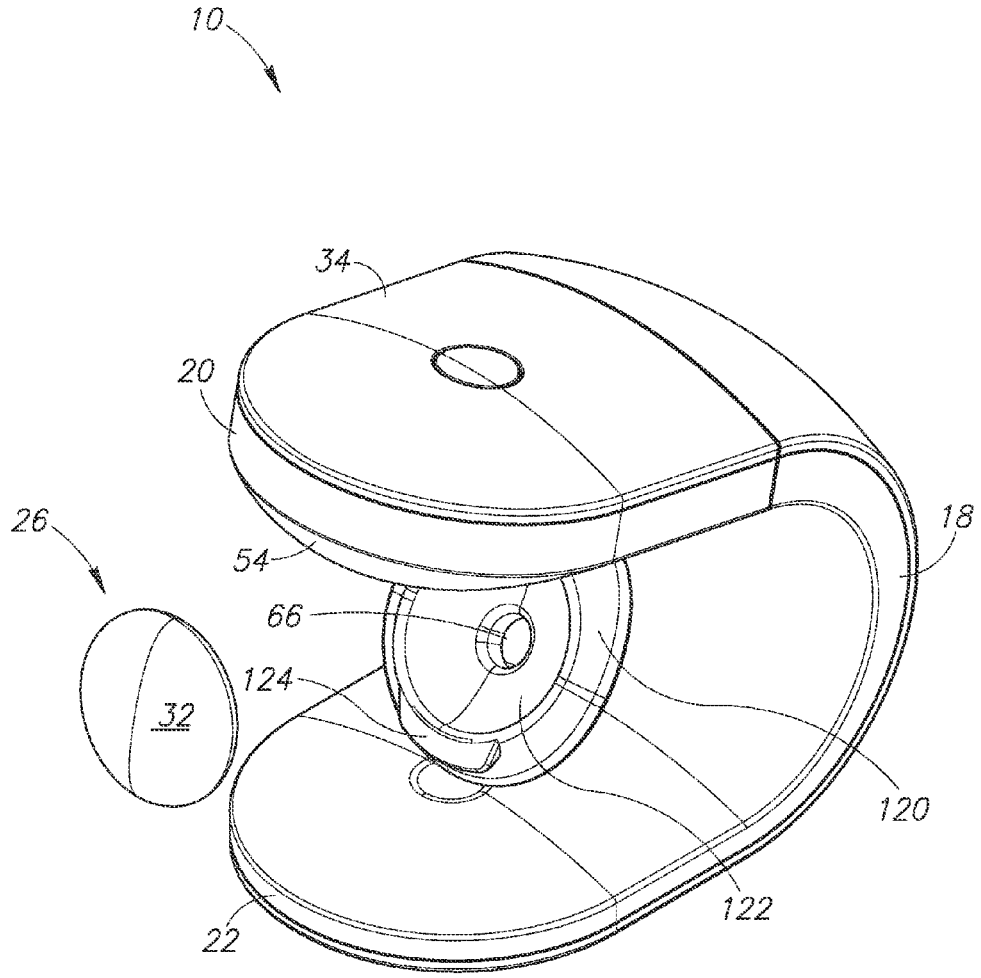
FIG. 8 is an isometric view of a third embodiment of a dispenser incorporating a plunger in accordance with an embodiment of the invention.

Referring to FIG. 8, in some embodiments, a reservoir cover 120 may secure to the lower surface 54 by a hinge or be completely removable and secure by a snap fit or some other means. The opening 66 for receiving the neck 28 of the reservoir 26 may be defined in the reservoir cover 120. Accordingly, in use, the neck 28 (see FIGS. 9-11) may be placed in the opening 66 having the body 32 of the reservoir 26 seated within a seat 122, such as a concave or other surface, and the reservoir cover 120 may then be secured to the lower surface 54.

In the illustrated embodiment, a distal end, e.g. opposite any hingedly secured end, of the cover 120 may include a ridge 124 or lip 124 for engaging a detent mechanism. However, any retention mechanism or detent mechanism may be used to retain the cover 120 in a selectively releasable manner.

Figure 9:
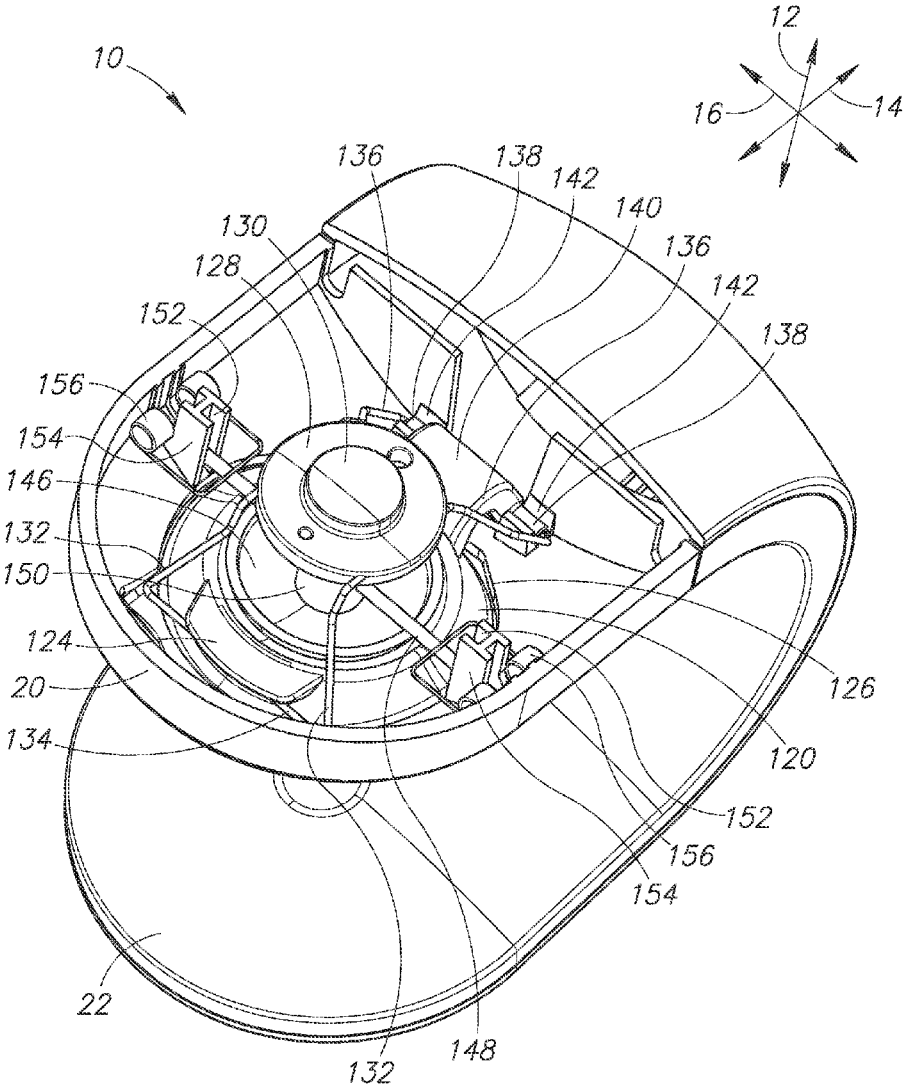
FIG. 9 is an isometric view showing a plunger mechanism of the dispenser of FIG. 8 in accordance with an embodiment of the invention.
Figure 10:
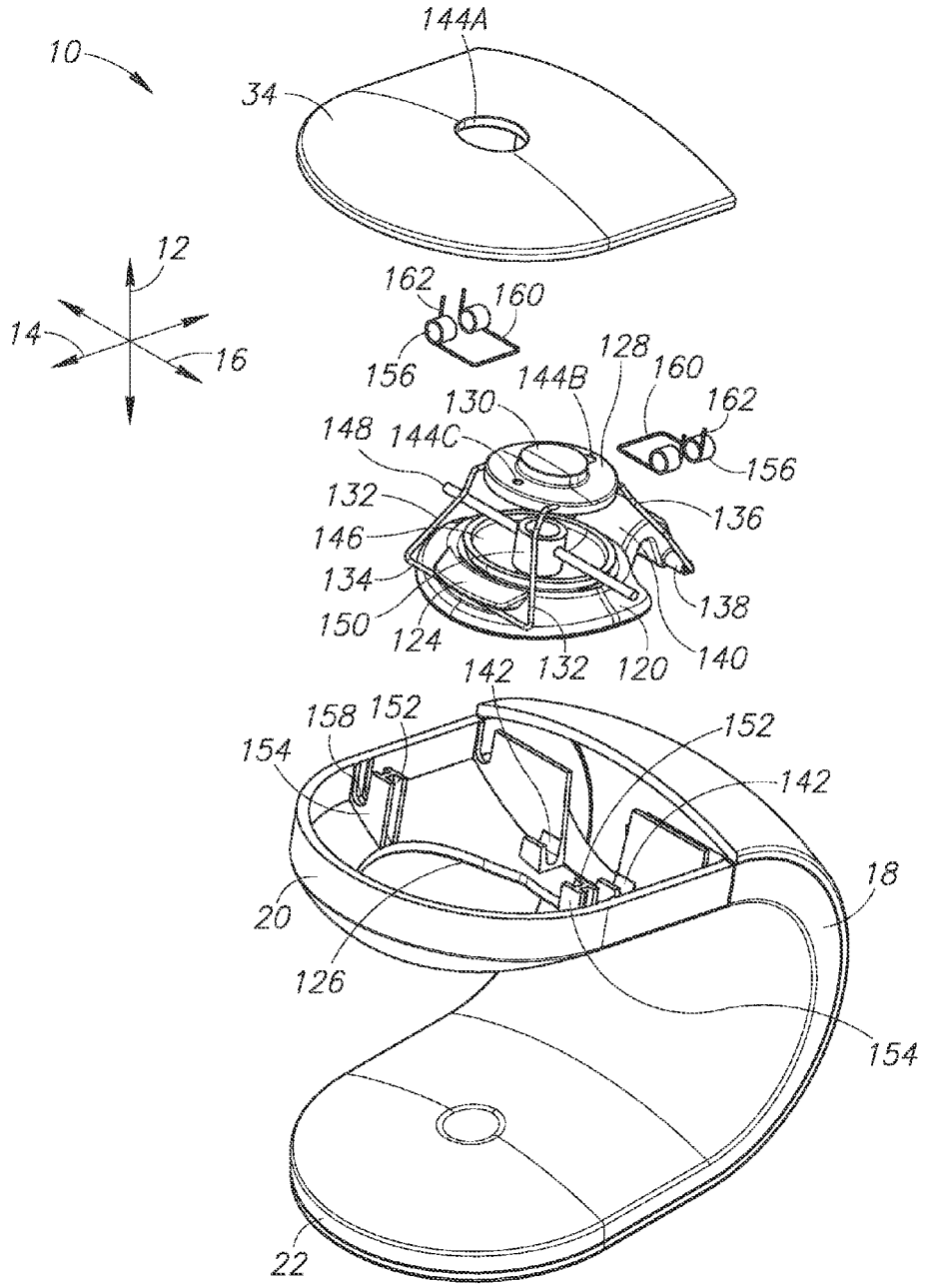
FIG. 10 is a partially exploded view of the dispenser of FIG. 8.
Figure 11:
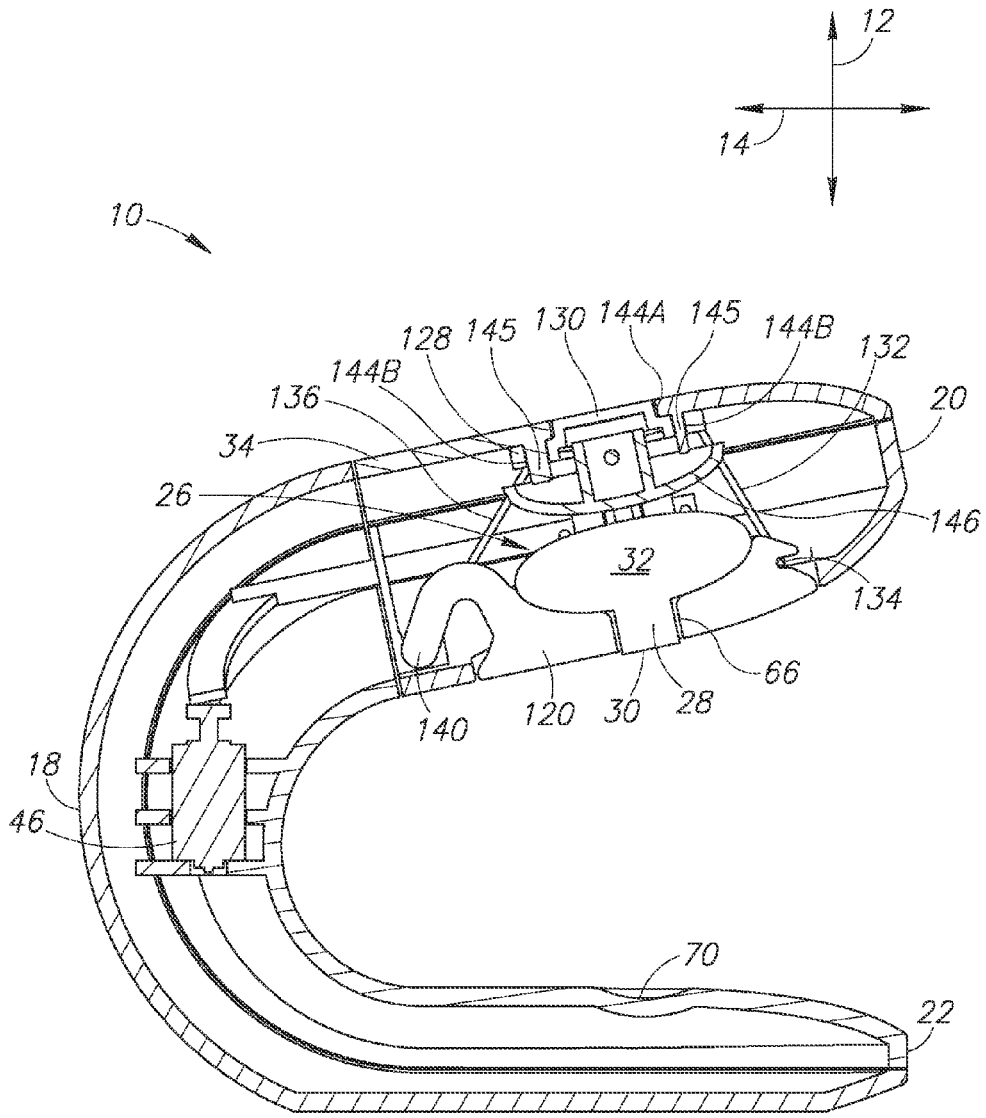
FIG. 11 is a side cross-sectional view of the dispenser of FIG. 8.

Referring to FIGS. 9 to 11, in some embodiments, the reservoir cover 120 may be hingedly secured and releasably secured within an opening 126 covered thereby using the illustrated mechanism. A hub 128 including a registration boss 130 on an upper surface thereof may have front spring arms 132 extending forwardly therefrom in the longitudinal direction 14. The front spring arms 132 may also spread laterally with distance from the hub 128. The spring arms 132 may also be bent downwardly from the hub 128 and secure to a cross bar 134 spanning the distal ends of the front spring arms 132. As shown, the cross bar 134 spans a portion of the opening 126 and engages the ridge 124 in order to retain the cover 120 within the opening 126. The spring arms 132 and cross bar 134 may be made of a resilient material, e.g. spring steel that is capable of deforming to enable the ridge to pass over the cross bar 134. As noted above, the front spring arms 132 may be bent downwardly from the hub 128 such that a vertical gap is present between the bottom of the hub 128, the opening 128, and the upper surface of the cover 120 positioned in the opening 126.

Rear spring arms 136 may secure to the hub 128 and project rearwardly therefrom in the longitudinal direction 14. The rear spring arms 136 may also flair outwardly from one another in lateral direction 16 and be bent downwardly from the hub 128 in the vertical direction 12. The rear spring arms 136 may pivotally secure to axle portions 138 protruding in the lateral direction 16 outwardly from the cover 120. The axle portions 138 may be cylindrical with axes extending in the lateral direction 16. The rear spring arms 136 may include bent end portions insertable within the axle portions 138. The rear spring arms 136 may be retained in engagement with the axle portions 138 due to biasing force of the rear spring arms 136. In some embodiments, the front spring arms 132, rear spring arms 134, and cross bar 134 may be part of a single metal rod or wire bent to the illustrated shape.

The axle portions 138 may be secured to the cover 120 by means of an arm 140 that extends from outside the upper portion 20 to within the upper portion 20. In the illustrated embodiment, the arm 140 is arched such that a concave lower surface thereof spans the edge of the opening 126.

The axle portions 138 may be positioned within seats 142 positioned on either side of the arm 140. As apparent in FIGS. 9 and 10, the seats 142 are open such that insertion and removal of the axle portions 138 from the seats 142. The lid 34 engages the hub 128 and urges the rear spring arms 136 downwardly and accordingly the axle portions 138 into the seats 142. In the illustrated embodiment (see FIG. 10), the lid 34 includes a registration hole 144A receiving the boss 130 formed on the hub 128 in order to maintain the hub 138 in an appropriate location within the cavity 24. In the illustrated embodiment, the registration hole 144A extends completely through the lid 124. In some embodiments, a user may press on the registration boss 130 through the hole 144A in order to depress the hub 128 and urge the cross bar 134 out of engagement with the ridge 124 and allow the reservoir cover 120 to fall out of the opening 126. In some embodiments, the hub 128 may define one or more registration holes 144A, 144B that receive one or more posts 145 (see FIG. 11) secured to an inner surface of the lid 34 or other covering of the upper portion 20.

Pressing of fluid from a reservoir 26 positioned within the cavity 24 may be accomplished by a plunger 146 actuated in substantially the vertical direction 12. In particular, the plunger 146 may move substantially vertically within a gap between the hub 128 and the seat 122 of the cover 120 (see FIGS. 12A and 12B). For example, the plunger may move substantially parallel (e.g. within +/−5 degrees of parallel) to a central axis of the opening 126. In some embodiments, the plunger 146 may be actuated by means of a cross bar 148 that spans the plunger 146 in the lateral direction 16 and may extend laterally outward beyond the plunger 146. In the illustrated embodiment, the cross bar 148 passes through a raised post 150 or tube formed on an upper surface of the plunger 146 (see FIG. 14). The ends of the cross bar 148 may slide within vertical grooves 152 defined in the upper portion 20, one on either side of the opening 126. As is apparent in FIGS. 9-11, the upper portion 20 is at a slight angle, e.g. 2 to 10 degrees, from horizontal. The grooves 152 may likewise be at a similar angle from vertical. The grooves 152 may be understood as parallel to a central axis of the opening 126 or to a direction of travel of the plunger 146. For example, the grooves 152 may be formed in posts 154 positioned on either side of the opening 126. In some embodiments, one or more springs 156 may engage the cross bar 148, or some portion of the plunger 146 or other structure secured thereto (see FIGS. 9 and 10). The springs 156 may bias the plunger toward the opening 126. The springs 156 may include first arms 160 and second arms 162.

Figure 12A:
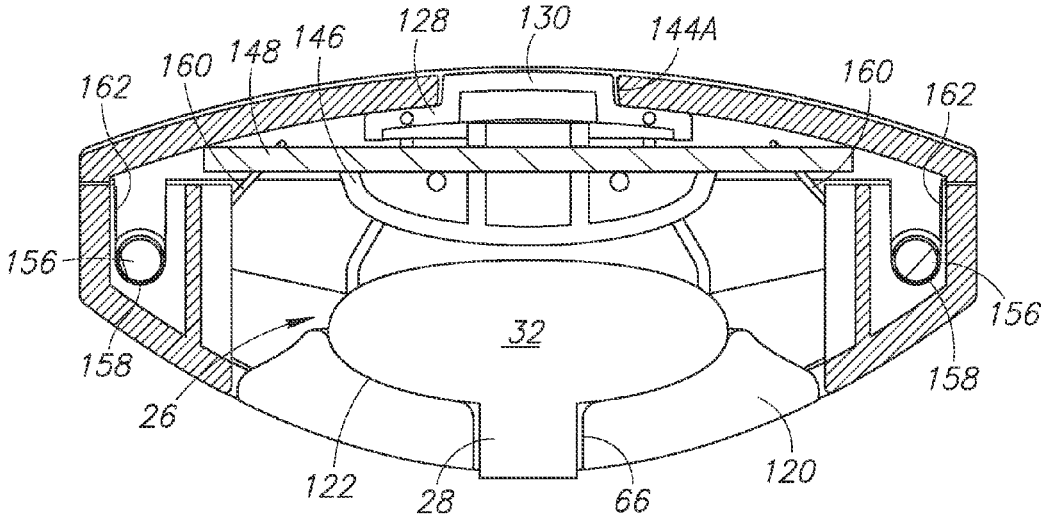
FIGS. 12A and 12B are front cross-sectional views of the dispenser of FIG. 8.
Figure 12B:
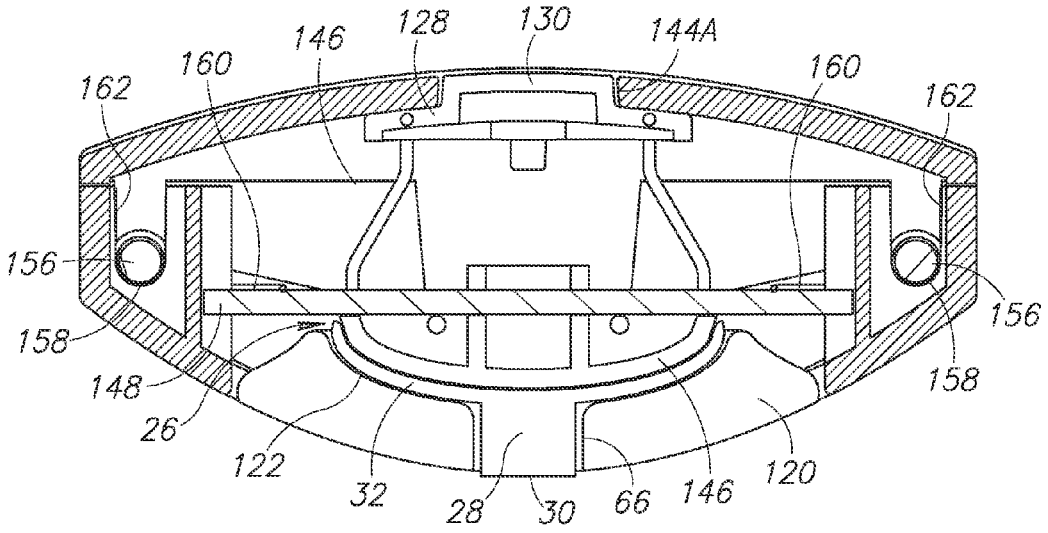

As shown in FIGS. 8 and 12A, when inserting a reservoir 26 within the cavity 24, the user may seat the reservoir 26 on the cover 120 and then urge the cover 120 upward thereby urging the reservoir 26 against the plunger 146. The configuration of FIG. 12A may be a starting position for the plunger 146. As shown in FIG. 12B, upon compression of the plunger 146 toward the cover 120, the body 32 of the reservoir 26 is compressed thereby forcing fluid from the opening 30 until the plunger 146 reaches the end position shown in FIG. 12B. The plunger 146 may be moved between a plurality of discrete positions between the illustrated start and end positions to release discrete amounts of fluid from the reservoir 126 as for other embodiments disclosed herein.

In the illustrated embodiment, the springs 156 may seat within seats 158 positioned laterally outward from the posts 150, however other positions may advantageously be used. As apparent in FIGS. 12A and 12B, the first arms 160 of the springs 156 press against the cross bar 134. The second arm 162 of each spring 156 may engage a portion of the upper portion 20 to counter torque on the arm 160.

Figure 13:
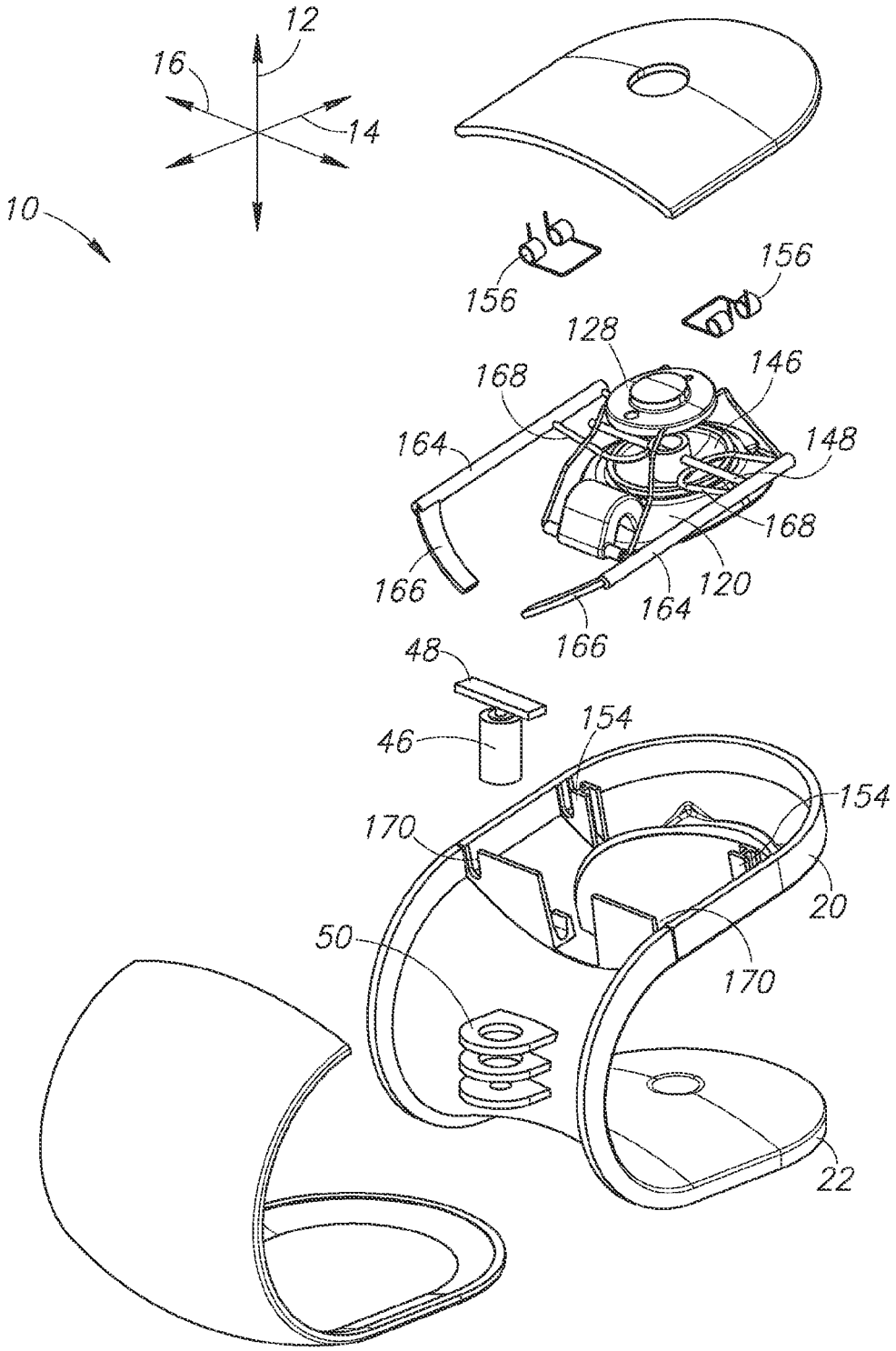
FIG. 13 is another partially exploded view of the dispenser of FIG. 8.
Figure 14:
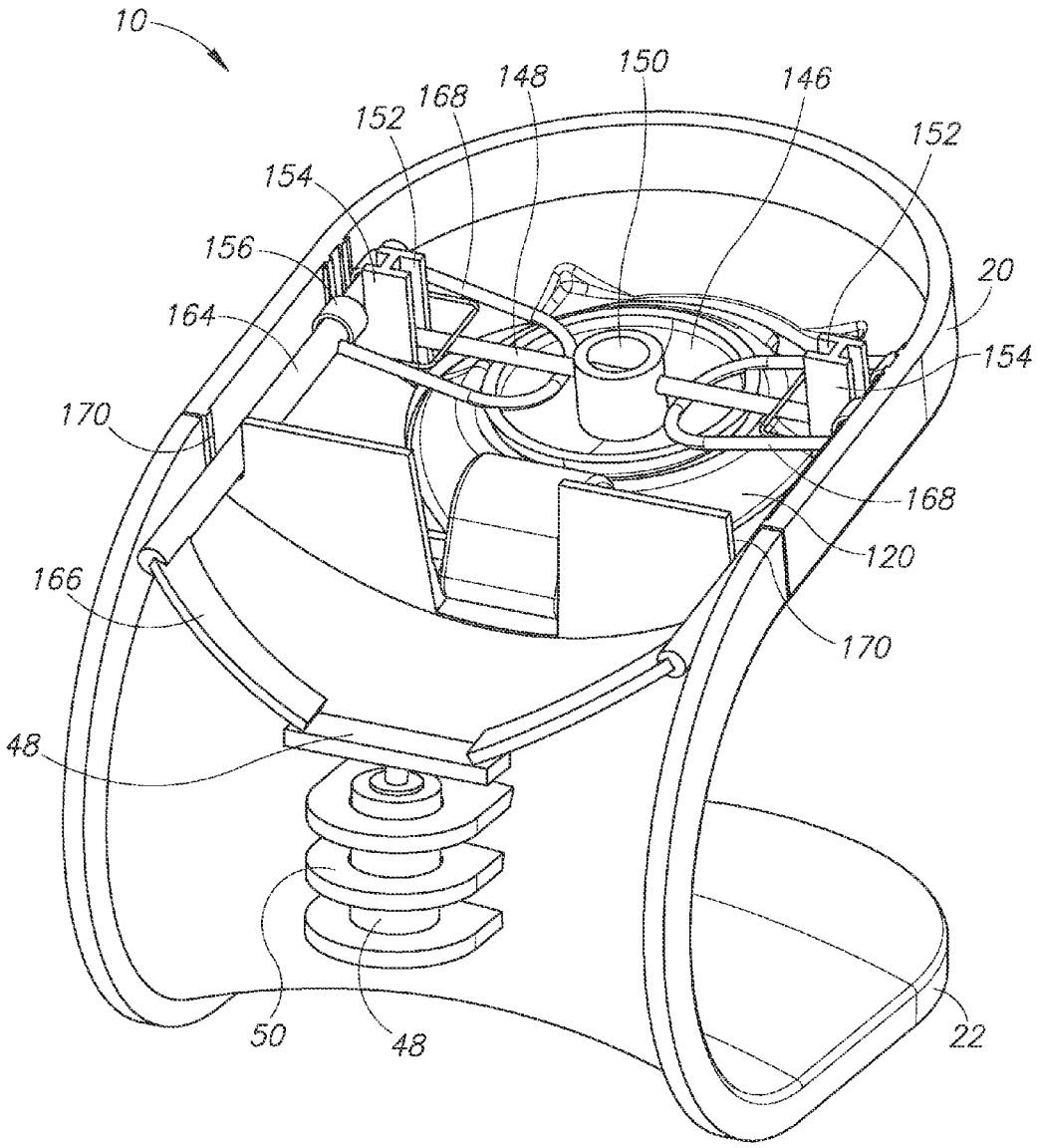
FIG. 14 is an isometric view showing an actuating assembly of the dispenser of FIG. 8 in accordance with an embodiment of the invention.

FIGS. 13 and 14 illustrate an example of an actuation mechanism that may be used to drive the plunger 146. The springs 156 may be considered part of the actuation mechanism. The actuation mechanism may include rods 164 extending along the upper portion such as in a generally longitudinal direction 14 that slopes upward similarly to the upward angle of the upper portion 20. The rods 164 may include first arms 166 secured to first end portions thereof that engage the linear actuator 46, such as by means of the spreader 48 driven up and down by the linear actuator 46. The rods 164 may include second arms 168 secured at second end portions opposite the first end portions. The rods 164 may seat within slots 170 defined by the upper portion 20.

The second arms 168 extend over the plunger 146 such that in response to rising of the arms 166, the arms 168 are also raised. In the illustrated embodiment, the arms 168 are loops that extent around the posts 154 and between the cross bar 134 and the plunger 146. As is apparent, the actuator 46 may only be able to force the arms 166 up. Accordingly, the arms 168 may be operable to counter the force of the biasing springs 156 to enable insertion of a reservoir 26. To dispense fluid, the actuator 46 may lower the spreader 50 to a different position thereby allowing the biasing force of the springs 156 to force fluid from the reservoir 26. In some embodiments, the actuator 46 may be coupled to the arms 166 such that the actuator 46 is able to force both raising and lowering of the arms 166, 168. In still other embodiments, springs 156 may urge the plunger 146 up and the actuator 46 is operable to urge the plunger 146 downward toward the cover 120. As shown in FIG. 14, in some embodiments, the rods 164 may pass through coils of the springs 156.

The embodiment of FIGS. 9 to 14 may likewise include a controller 62, proximity sensor 52, and lights 56 configured similar to the embodiment of FIGS. 1 to 4. As for other embodiments disclosed herein, the controller 62 may be configured to advance the plunger 146 between discrete positions in response to detecting proximity using the proximity sensor 52. Likewise, the controller 62 may be configured to return, or allow the return, of the plunger 146 to the start position upon reaching the end position. The embodiment of FIGS. 9 to 14 may likewise include a heating element 74 in thermal contact with the reservoir 26, cavity 24, or air within the upper portion 20.

Figure 15:
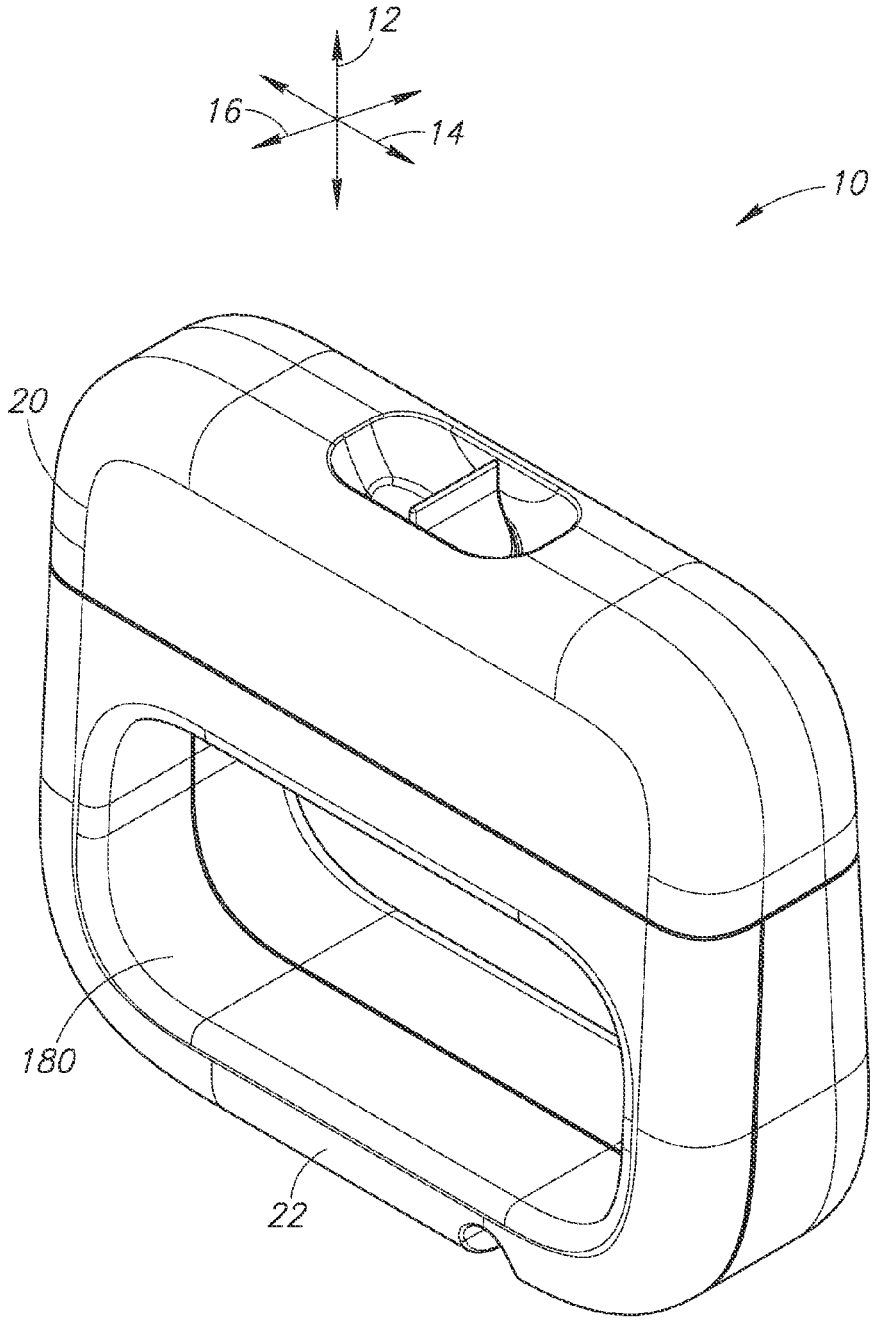
FIG. 15 is an isometric view of a fourth embodiment of a dispenser in accordance with an embodiment of the invention.
Figure 16:
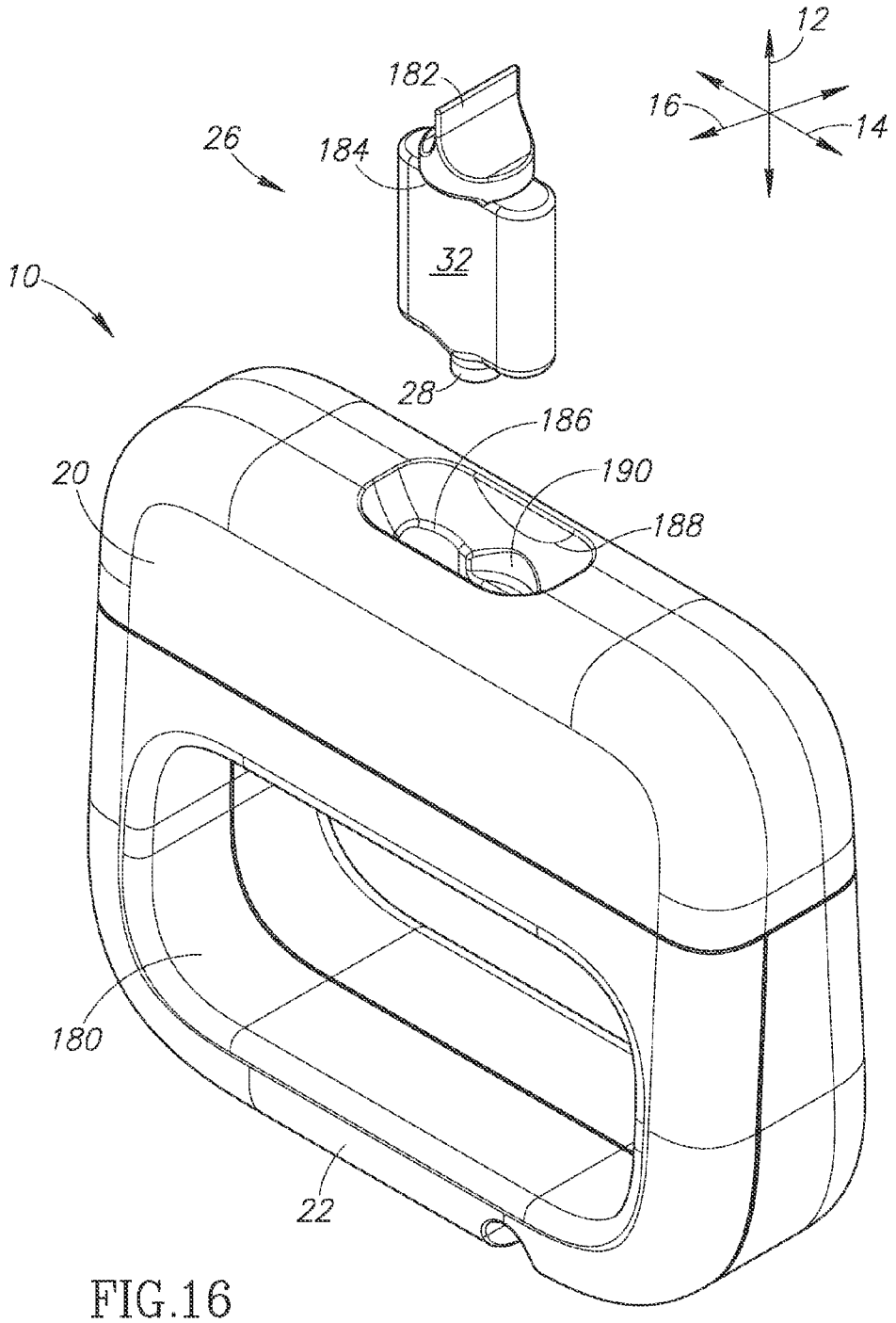
FIG. 16 is an isometric view showing the dispenser of FIG. 16 and a fluid reservoir in accordance with an embodiment of the invention.

Referring to FIGS. 15 and 16, in some embodiments, the upper portion 20 and lower portion 22 may have the illustrated configuration. In particular, rather than having being C-shaped, the upper portion 20 and lower portion 22 may join at both ends to define an opening 180 for receiving a portion of a user's hand. The embodiment of FIGS. 15 and 16 may be used with the illustrated reservoir 26. As shown, the body 32 of the reservoir 26 may have a substantially constant cross section along the height thereof. A handle 182 may be secured to the body 32 opposite the neck 28 to facilitate removal of the reservoir 26. A lip or shoulder 184 may protrude from the handle 182 and extends outwardly from the body 32.

The upper portion 20 may define an opening 186 for receiving the reservoir 26 and include a sloped surface 188 surrounding the opening 186 to guide the reservoir 26 into the opening 186. A seat 190 shaped to engage the shoulder 184 may also be positioned adjacent the opening 186.

Figure 17A:
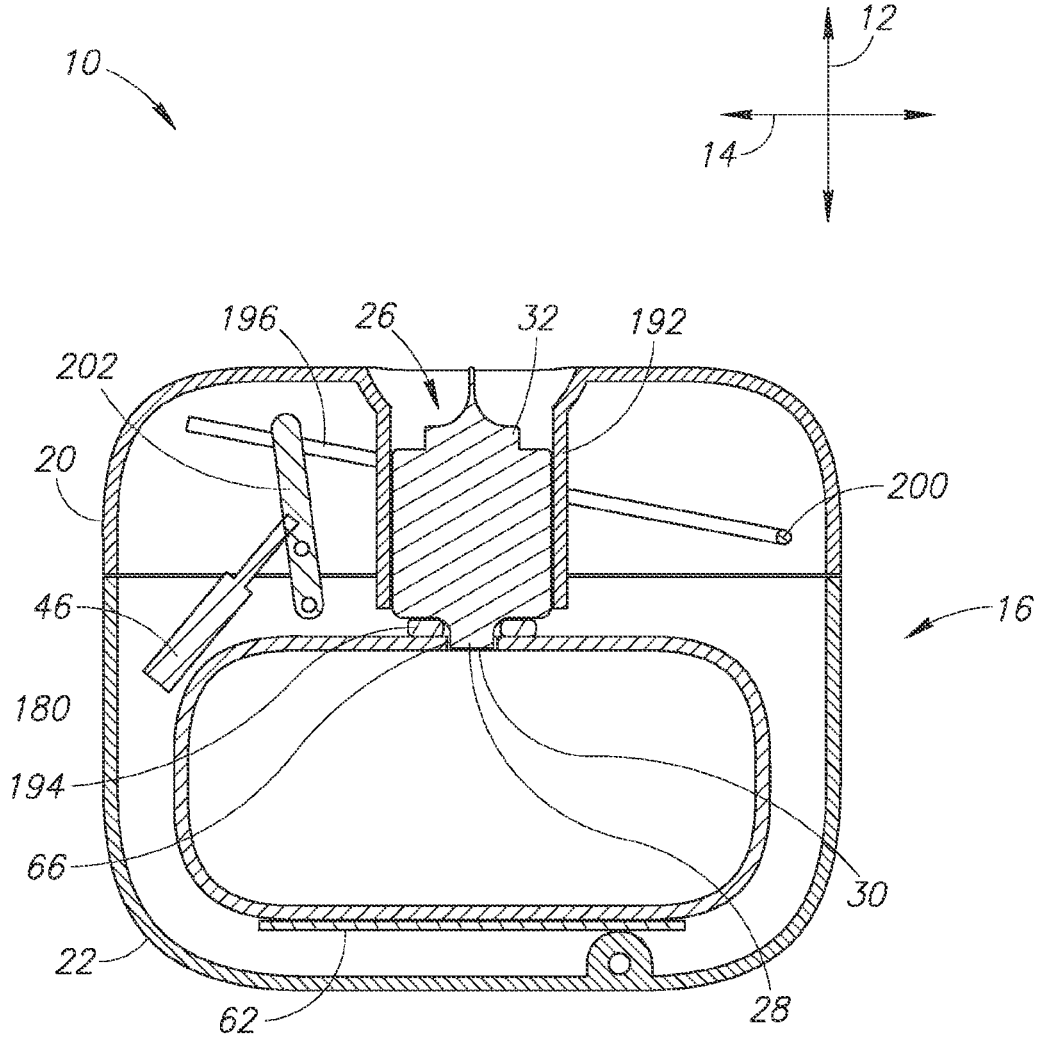
FIGS. 17A to 17C are cross-sectional views of the dispenser of FIG. 16.
Figure 17B:
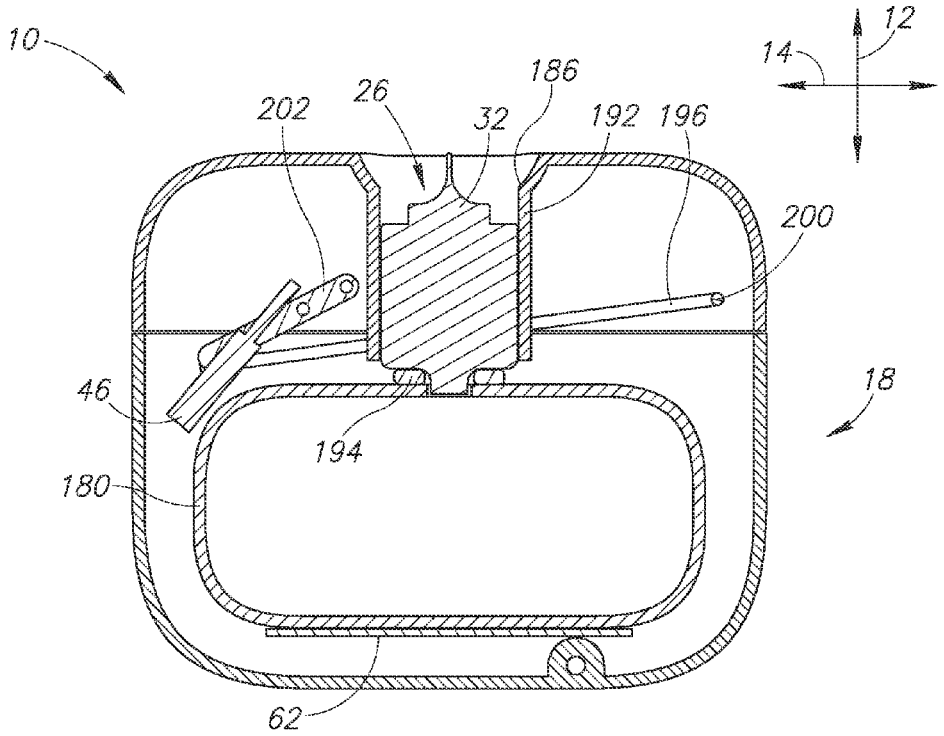
Figure 17C:
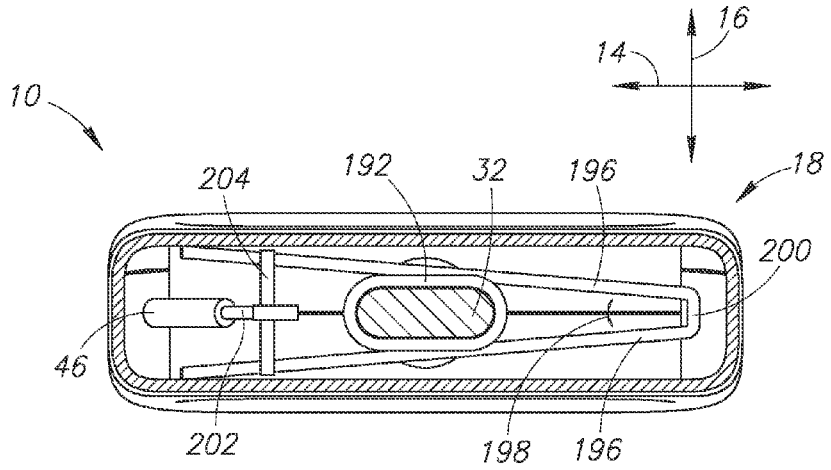

Referring to FIGS. 17A to 17C, in some embodiments the opening 186 may be defined by a flexible sleeve 192 secured to the upper portion 20. The sleeve may be open at both ends such that the neck 28 of the receiver 26 may pass therethrough and insert within the opening 66. In some embodiments, a washer 194 may be positioned above the opening 66 and the neck 28 may insert therethrough.

In the illustrated embodiment, fluid is forced from the reservoir 26 by arms 196 positioned on either side of the flexible sleeve 192. The sleeves may define an angle 198 between them. The sleeves may be pivotally secured at a pivot 200 on one side of the sleeve 192 to the housing 18 and pass on to an opposite side of the sleeve 192 having the sleeve 192 positioned therebetween. The arms 196 may be part of a single metal rod bent to the illustrated shape including a straight portion defining the pivot 200. Opposite the pivot 200, a link 202 may pivotally mount within the housing 18 and to the arms 196, such as by means of a cross bar 204 secured to both bars arms 196. The actuator 46 may pivotally secure to the link 202, such as at a point between the points of securement of the arms 196 to the link 202 and a point of securement of the link 202 to the housing 18. However, the actuator 46 may also be coupled to the link 202 at another point along the link 202. The actuator 46 may be pivotally mounted to the housing 18 as well such that the actuator 46 pivots during actuation thereof.

As shown in FIGS. 17A and 17B, the actuator 46 may shorten thereby drawing the arms 196 down over the flexible sleeve 192 and forcing fluid out of the opening 30. As for other embodiments, the actuator 46 may move the arms 196 between discrete positions from a start position (FIG. 17A) to an end position (FIG. 17B). The controller 62 may cause the actuator 46 to return the arms 196 to the start position upon the arms 196 reaching the end position. In the illustrated embodiment, the controller 62 is positioned below the opening 180.

The embodiment of FIGS. 15 to 17C may likewise include a controller 62, proximity sensor 52, and lights 56 configured similar to the embodiment of FIGS. 1 to 4. As for other embodiments disclosed herein, the controller 62 may be configured to advance the arms 196 between discrete positions in response to detecting proximity using the proximity sensor 52. Likewise, the controller 62 may be configured to return, or allow the return, of the arms 196 to the start position upon reaching the end position. The embodiment of FIGS. 15 to 17C may likewise include a heating element 74 in thermal contact with the reservoir 26, cavity 24, or air within the housing 18.

Figure 18:
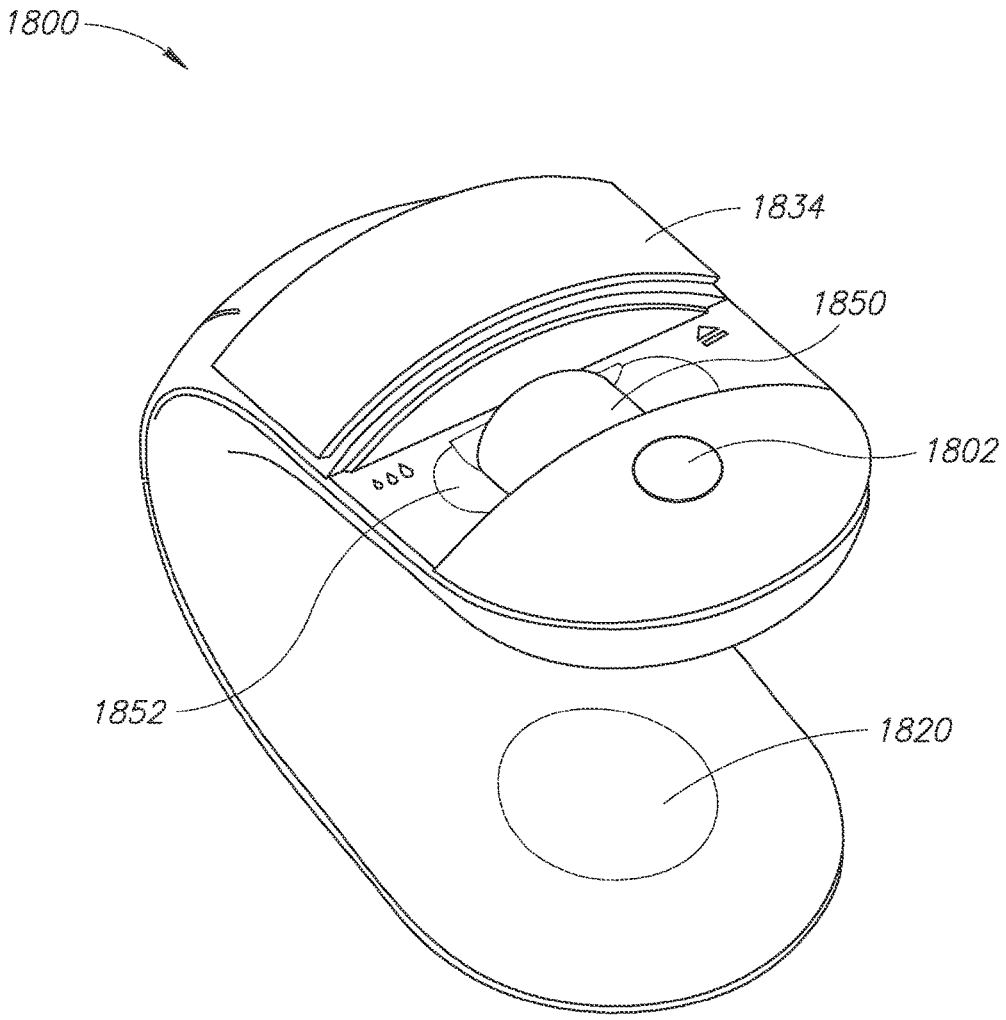
FIG. 18 illustrates an isometric view of another embodiment of a dispenser consistent with the embodiments disclosed herein. The lid is open to reveal a removable fluid reservoir received by the dispenser.

FIG. 18 illustrates an isometric view of another embodiment of a dispenser consistent with the embodiments disclosed herein. Lid 1834 is open to reveal fluid reservoir 1850. Dispenser 1800 removably receives fluid reservoir 1850. Dispenser 1800 energizes and/or warms fluid housed within fluid reservoir 1850 prior to dispensing the fluid. Warming, heating, or otherwise energizing the fluid prior to dispensing may increase the satisfaction of a user of dispenser 1800.

As discussed below, dispenser 1800 efficiently energizes the dispensed fluid because of at least the close proximity of a heating element included in dispenser 1800 to an outlet port of fluid reservoir 1850. The importance of the proximity depends on the properties of the fluid being heated, such as the viscosity and thermal conductivity. Preferably, the fluid is substantially heated throughout the reservoir before dispensing. The positioning of the heating element near the outlet port allows the piston to move within the reservoir 1850 without interfering with the heating element. The heating structure is thermally coupled to the fluid.

In various embodiments, and as further discussed in at least the context of FIGS. 19A-19B and FIGS. 20A-20B, dispenser 1800 increases the energizing efficiency because the heating process is an inductive heating process. Inductive heating enables a greater utilization of the energy used to warm the fluid. For instance, inductive heating of the fluid reduces collateral warming of dispenser 1800. Inductive heating focuses the energy on warming the fluid, rather than warming the housing or other components of dispenser 1800. Inductive heating also allows for heating within the reservoir with ease of reservoir installation within dispenser 1800 without worry about electrical connections between the reservoir 1850 and dispenser 1800.

Furthermore, at least because of the interaction between an actuator included in dispenser 1800 and a displaceable piston included in reservoir 1850, dispenser 1800 fully, or at least almost fully, depletes the fluid housed within reservoir 1850 prior to the need to remove and/or replace reservoir 1850 with a new fluid reservoir. In some embodiments, reservoir 1850 is a rigid body reservoir. A rigid body reservoir enables the complete, or almost complete, depletion of reservoir's 1850 fluid contents by dispenser 1800. Accordingly, dispenser 1800 reduces waste of the fluid product. Various embodiments of reservoir 1850 are discussed at least in the context of FIGS. 19A-19B and FIGS. 24A-24B. Also detailed below, in some embodiments, a motor drives the actuator.

A cavity or receptacle included in the housing of dispenser 1800 removably receives fluid reservoir 1850. In preferred embodiments, the cavity or receptacle includes finger trenches 1852 or depressions to accommodate the fingers of a user when the user inserts or removes reservoir 1850 from dispenser 1800. Finger trenches 1852 provide greater ease of inserting or removing reservoir 1850 from dispenser 1800.

Not shown in FIG. 18, but discussed below in the context of FIGS. 22A 22B and FIG. 23B, the housing of dispenser 1800 includes an aperture to expose an outlet port of reservoir 1850, such as outlet port 1914 of FIGS. 19A-19B. The aperture in the housing is located on an underside surface of the housing and above containment depression 1820. Containment depression 1820 adequately contains any fluid dispensed from the aperture and not received by a hand of a user or otherwise not intercepted. In preferred embodiments, containment depression 1820 is a depressed or recessed portion of the housing of dispenser 1800. Containment depression 1820 may be a circular, elliptical, or any other appropriately shaped depressed or recessed portion. Containment depression 1820 enables the easy clean up of any dispensed fluid not intercepted by the hands of a user.

Dispenser 1800 includes various user controls, such as switch 1802. Switch 1802 may turn on and off various function of dispenser 1800, preferably a nightlight discussed below. In other embodiments, switch 1802 may be a power button or may control the heating function. In some embodiments, switch 1802 is a pressable button. A user presses and/or depresses switch 1802. In at least one embodiment, switch 1802 includes at least one electromagnetic energy source, such as a light emitting diode (LED), to indicate a current state of dispenser 1800.

Switch 1802 may serve as a lock/unlock selector for dispenser 1800. For instance, pressing switch 1802 for a predetermined time, such as 3 seconds, may transition dispenser 1800 into a lock-mode. In lock-mode, dispenser 1800 is locked-out of dispensing fluid. The included LED, or another LED located forward or rearward of switch 1802, illuminates the surrounding environment when a user locks dispenser 1800. A subsequent depression of power switch 1802 for the predetermined time may unlock dispenser 1800, such that dispenser 1800 can now dispense fluid.

As noted above, FIG. 18 illustrates lid 1834 in an open position. A user can insert and/or remove reservoir 1850 from dispenser 1800. In some embodiments, to open and close the compartment that houses reservoir 1850, a user slides and/or translates lid 1834 back and forth on rails embedded in the dispenser housing. In such embodiments, when a user is opening or closing lid 1834, lid 1834 remains attached to the rails embedded in dispenser's 1800 housing. In other embodiments, lid 1834 snaps on an off when a user opens or closes lid 1834. Such snapping may include tactile and/or audio feedback. In alternative embodiments, lid 1834 is a pivotally hinged lid.

In at least one embodiment, magnetic forces at least partially secure lid 1834. One or more magnets embedded in at least one of dispenser's 1800 housing or lid 1834 provide the magnetic forces. In at least one embodiment, magnetic forces secure lid 1834 to the dispenser's 1800 housing when a user has opened lid 1834. Such a feature decreases the likelihood that lid 1834 becomes lost over the lifetime of use of dispenser 1800. In at least one embodiment, dispenser 1800 includes a lid sensor. The lid sensor detects when a user opens or closes lid 1834. The operation of this sensor may be based on the Magnetic Hall Effect. When a user opens lid 1834 is open, the lid sensor triggers the retracting of at least one of a driveshaft, pressing member, or other actuator drive component, such as driveshaft 2148 of FIG. 21B. When dispenser 1800 retracts the drive component, a user may remove reservoir 1850 from dispenser 1800.

Figure 19A:
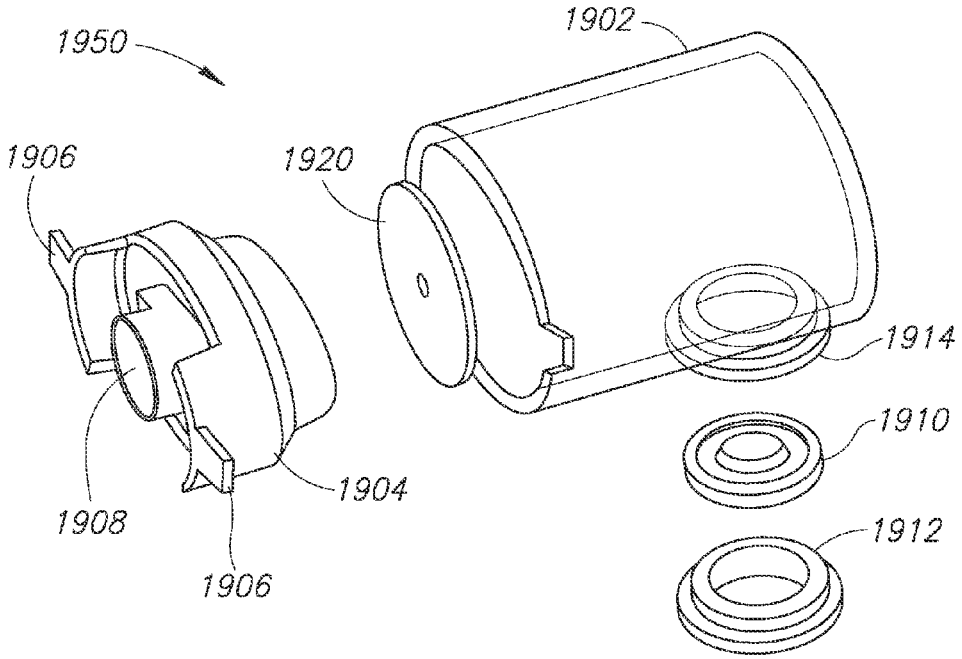
FIG. 19A illustrates an exploded view of a fluid reservoir consistent with embodiments disclosed herein.

FIG. 19A illustrates an exploded view of fluid reservoir 1950 consistent with embodiments disclosed herein. Various fluid dispensers disclosed herein, such as dispenser 1800 of FIG. 18, receive fluid reservoir 1950. In preferred embodiments, fluid reservoir 1950 houses fluid. Dispensers energize and dispense the housed fluid.

Fluid reservoir 1950 includes reservoir body 1902. In a preferred embodiment, reservoir body 1902 is a rigid or at least a semi-rigid body. Other embodiments are not so constrained and reservoir body 1902 may be a flexible body. Reservoir body 1902 includes a first end and a second end. The first and second ends define an axis. Reservoir body 1902 includes a cross section. The axis is substantially perpendicular to the cross section. In preferred embodiments, the cross section is substantially uniform along the axis. The axis may be a translation axis.

In the embodiment illustrated in FIG. 19A, reservoir body 1902 is a cylindrical body. In various embodiments, a cylindrical body may correspond to a circular cylinder, an elliptic cylinder, a parabolic cylinder, a hyperbolic cylinder, or any other such curved cylindrical surface. Thus, the cross section of reservoir body 1902 may be substantially circular, elliptical, parabolic, hyperbolic, or any other such curved shape. In a preferred embodiment, the first and second ends of reservoir body 1902 are the cylindrical bases or end caps of the cylindrical body. The translational axis may be between the cylindrical bases.

In other embodiments, reservoir body 1902 may include a parallelepiped geometry. Thus, the cross section may be substantially a parallelogram shape, such as a rectangular or square shape. In at least one embodiment, the cross section may include fewer or a greater number of sides than four. For instance, the cross section may be triangular or octagonal. Other possible geometries for reservoir body 1902 and the corresponding cross section are possible.

Reservoir body 1902 may be an optically transparent body or at least an optically translucent body. In such an embodiment, a user may visually inspect the amount of remaining fluid in reservoir 1950. In other embodiments, reservoir body 1902 may be optically opaque. In at least one embodiment, reservoir body 1902 is optically opaque except for a window indicating the amount of fluid remaining in reservoir 1950.

The fluid housed within reservoir 1950 may include optical properties such that when an electromagnetic energy source illuminates an optically transparent reservoir body 1902, the fluid disperses the light in such a manner as to appear the frequency or color of the illuminating electromagnetic energy. In at least one embodiment, fluid housed within reservoir 1950 may appear to "glow" when illuminated by an electromagnet energy source included in various fluid dispensers disclosed herein. One or more electromagnetic sources embedded in various dispensers disclosed herein may at least partially illuminate reservoir 1950 and/or fluid housed within reservoir 1950. In at least one embodiment, reservoir body 1902 is at least partially a thermally insulating body. In such embodiments, fluid housed within reservoir 1950 effectively retains thermal energy. Accordingly, these embodiments increase the heating efficiency of a dispenser that receives reservoir 1950.

In some embodiments, fluid reservoir 1950 includes heating structure 1920. Induction, as discussed in the context of FIGS. 20A-20B, may provide energy to heat or warm heating structure. In preferred embodiments, heating structure 1920 is a conductive heating disk. Heating structure 1920 is in thermal contact with the fluid housed in reservoir 1950. In some embodiments, heating structure is in physical contact with the fluid. In at least one embodiment, heating structure 1920 is physically isolated from the fluid by a barrier, such as a chamber wall within reservoir body 1902. In such embodiments, reservoir 1950 includes a chamber to receive heating structure 1920. The receiving chamber isolates heating structure 1920 so that heating structure 1920 does not contaminate the housed fluid.

In some embodiments, a cross section of heating structure 1920 substantially matches the cross section of reservoir body 1902. In other embodiments, the cross section of heating structure 1920 deviates from the cross section of reservoir body 1902. In preferred embodiments, heating structure 1920 is positioned within reservoir body 1902.

Fluid reservoir 1950 includes outlet port 1914. In various embodiments, outlet port 1914 includes valve 1910 and valve retainer 1912. Valve 1910 may be constructed from a flexible material such as a synthetic rubber, plastic, latex, or the like. Valve 1910 includes one or more slits, apertures, or other openings to allow fluid housed in the reservoir to flow out of the reservoir through valve 1910. FIG. 24B illustrates one such configuration of valve slits. In at least some embodiments, outlet port 1914 may be a nozzle. In such embodiments, outlet port 1914 may be included in a nozzle assembly of fluid reservoir 1950.

Valve retainer 1912 retains valve 1910. In a preferred embodiment, valve 1910 is concentric with valve retainer 1912. An outer perimeter of valve 1910 is adjacent or proximate to an inner perimeter of valve retainer 1912. As is discussed in the context of FIG. 23B and FIGS. 24A-24B, valve 1910 and valve retainer 1912 are configured and arranged such that when fluid flows through the one or more slits or openings of valve 1910, the flowing fluid does not contact valve retainer 1912, including the inner perimeter of valve retainer 1912.

Fluid reservoir 1950 additionally includes piston 1904. Piston 1904 is a translatable or displaceable piston. Piston 1904 translates along a translation axis. Piston 1904 includes one or more use tabs 1906 or tongues. As shown in FIG. 19A, the first end of reservoir body 1902 includes one or more trenches, depressions, or other such structures. These trenches or depressions mate with use tabs 1906. As described below in the context of FIG. 19B, use tabs 1906 provide a signal. This signal indicates that piston 1904 has already displaced at least some amount of fluid. In at least one embodiment, piston 1904 includes driven structure 1908. Driven structure 1908 mates with at least a portion of an actuator, such as a pressing member, included in various dispensers disclosed herein. In various embodiments, a pressing member may be a driveshaft.

As described below, a dispenser actuator drives a translation of piston 1904 along the translation axis. When piston 1904 is driven to decrease an available storage volume in fluid reservoir 1950, fluid housed in fluid reservoir 1950 flows out of reservoir 1950 through outlet port 1914. An available storage volume in fluid reservoir 1950 may be based on the cross section of reservoir body 1902 and a distance between piston 1904 and the second end of reservoir body 1902. In preferred embodiments, the second end is a closed end.

Accordingly, a translation of piston 1904 towards the second end of reservoir body 1902 induces a decrease in the available storage volume. The mechanical work that translates piston 1904 displaces the housed fluid and forces a portion of the fluid to flow through outlet port 1914.

Piston 1904 and reservoir body 1902 are configured and arranged such that the interface between piston 1904 and reservoir body 1902 adequately retains fluid housed within reservoir 1950 when piston 1904 is not translated. The physical dimensions of piston 1904, including an effective piston cross section, may be based on at least one of the cross section of the reservoir body 1902 and the viscosity of the housed fluid. In such embodiments, the piston's cross section, or at least an outer perimeter of the piston, substantially matches the cross section of the reservoir body. A gasket, O-ring, or other such structure may provide a seal between the displaceable piston 1904 and the inner walls of reservoir body 1902. The seal is adequate to retain the housed fluid. Accordingly, reservoir 1950 does not leak the housed fluid out of the first end of reservoir body 1902 when a dispensing force translates or otherwise displaces piston 1904.

In preferred embodiments, valve 1910 retains fluid in reservoir 1950 unless a force, such as a dispensing force, translates piston 1904 toward the second end of reservoir body 1902 or the available storage volume of fluid reservoir 1950 is otherwise decreased. The slits or openings of valve 1910 may resemble the slits of a condiment container, such as a squeezable ketchup bottle. The valve is preferably upwardly domed toward the fluid, such that a force to displace the elastic dome downwardly must be employed before the valve will open to dispense. Physical dimensions and configurations of the one or more slits or openings of valve 1910 may be varied. This variability may be based on the viscosity of the fluid to be housed in reservoir 1950 and the material that valve 1910 is constructed from. By adequate choices for the physical dimensions and configurations of the slits, fluid will not flow through the openings unless a dispensing force translates piston 1904 and displaces the housed fluid.

Because valve 1910 is constructed from an elastic rubber-like material, the slits or openings may substantially be closed, or self-sealing, until the dispensing or displacing force forces fluid through the openings. When displaced by the dispensing force, fluid flows through the slits or openings. This effect may be similar to the self-sealing of a rubber nipple on an infant's bottle. The rubber nipple includes slits or holes. Fluid does not flow through the slits or holes on such a rubber nipple unless an infant supplies a vacuum or sucking force or a pressure squeezes the bottle. Thus, valve 1910 resists the output or dispensing of the fluid unless a dispensing force, greater than a dispensing force threshold, increases the internal pressure of the fluid to a pressure greater than a pressure threshold to overcome the resistance of valve 1910.

Figure 19B:
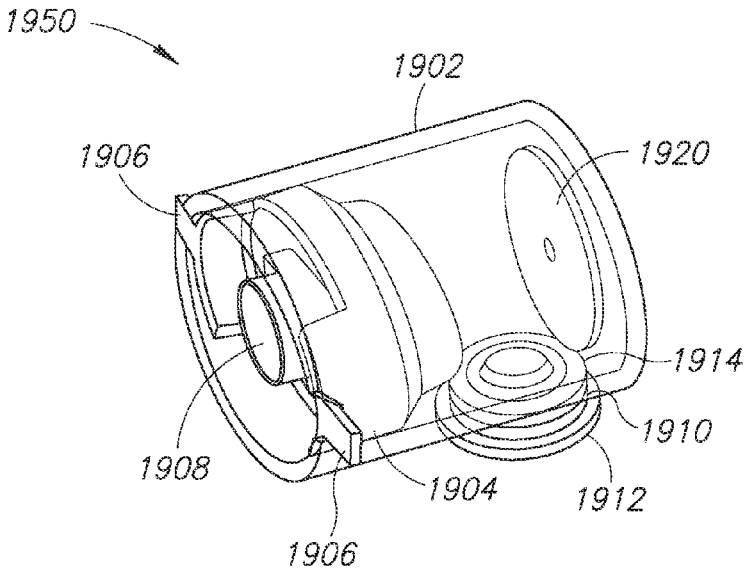
FIG. 19B illustrates an assembled fluid reservoir consistent with embodiments disclosed herein.

FIG. 19B illustrates assembled fluid reservoir 1950 that is consistent with embodiments disclosed herein. In the preferred embodiment shown in FIG. 19B, when assembled, heating structure 1920 is positioned inside reservoir body 1902 and proximate to the second end of reservoir body 1902.

Additionally, as shown in FIG. 19B, outlet port 1914 is positioned on a surface of reservoir body 1902. The surface that includes the outlet port is not positioned on the first or second ends of reservoir body 1902. Rather, outlet port 1914 is positioned on a curved surface of the cylindrical body. The cross section of outlet port 1914 is transverse or substantially orthogonal to the translation axis of reservoir body 1902. However, other embodiments are not so constrained, and outlet port 1914 may be positioned on the second end of reservoir body 1902, such that the cross section of outlet port 1914 is substantially parallel to the translation axis. Outlet port 1914 is shown with valve 1910 and valve retainer 1912 in a concentric configuration. The surface of valve 1910 that includes the one or more slits or openings may be recessed above portions of valve retainer 1912. This configuration provides additional clearance for fluid flowing through valve 1910.

In preferred embodiments, and in order to ensure that an increased portion of the housed fluid will flow out of outlet port 1914, outlet port 1914 is positioned proximate to the second end of reservoir body 1902. Accordingly, fluid will continue to flow through outlet port 1914 with the translation of piston 1904 until piston 1904 makes physical contact with the second end of reservoir body 1902. At this point, all, or at least most, of the housed fluid that is displaceable by piston 1904 has been displaced. Accordingly, reservoir 1950 is adequately depleted.

FIG. 19B illustrates fluid reservoir 1950 in an initial condition prior to dispensing any of the fluid housed within. The initial position of piston 1904 is proximate the first end of reservoir body 1902. The volume defined by reservoir body 1902 and positioned between piston 1904 and the second end of reservoir body 1902 retains the fluid. In some embodiments, the initial position of piston 1904 is such that the use tabs 1906 mate with the trenches or depressions in reservoir body 1902. As an alternative to use tabs, some embodiments employ a fragile, brittle, or otherwise frangible sealing structure to provide an indication of prior use. Various dispenser actuators, discussed herein, may sense an actuating load when translating piston 1904. By sensing the load, the dispenser may detect whether use tabs 1906 or a frangible seal is intact or not intact. Accordingly, the dispenser may determine whether the reservoir 1950 has experienced a prior use, or is otherwise a virgin reservoir.

A driveshaft of a dispenser actuator mates with driven structure 1908. A translation of the driveshaft translates piston 1904 towards the second end of reservoir body 1902. The translation of piston 1904 towards the second end of reservoir body 1902 induces an engagement force between the use tabs 1906 and the trenches or depressions of reservoir body 1902. The engagement force snaps, breaks, bends, or otherwise deforms use tabs 1906.

When use tabs 1906 have been disturbed from the initial position they become deformed. Deformed use tabs 1906 alert a user that reservoir 1950 has already dispensed some amount of fluid housed within reservoir 1950. For example, deformed use tabs 1906 indicate that piston 1904 is not in its initial position. For hygienic or safety reasons, a user may wish to discard or otherwise not use an already somewhat used reservoir 1950. Deformed use tabs 1906 indicate that that another party may have already used reservoir 1950. For hygienic reasons, a user may wish to discard an already partially used reservoir.

Figure 20A:
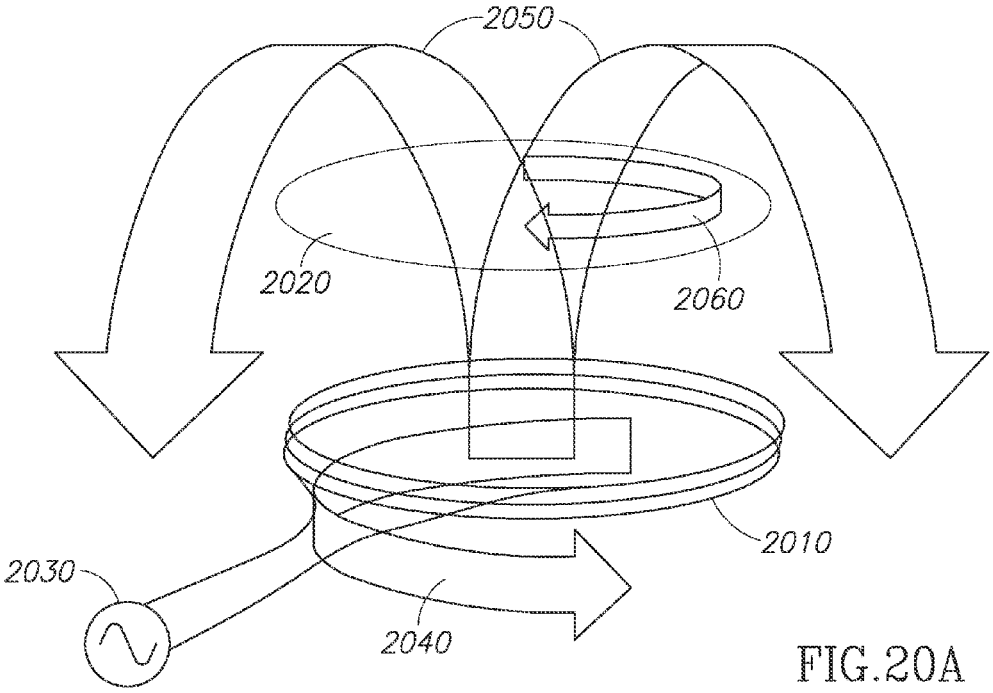
FIG. 20A illustrates an electrical current induced in a heating structure consistent with embodiments disclosed herein.

FIG. 20A illustrates an electrical current induced in heating structure 2020 that is consistent with embodiments disclosed herein. In some embodiments, heating structure 2020 is a conductive heating disk. An alternating current (AC) source 2030 supplies alternating electrical current 2040 to heating element 2010. Heating element 2010 is a conductive element. As shown in FIG. 20A, heating element 2010 includes multiple conducting coils. According to Maxwell's electromagnetic (EM) equations, alternating electrical current 2040 produces a fluctuating magnetic field 2050. Again, according to Maxwell's EM equations, when an electrical conductor, such as heating structure 2020, is exposed to fluctuating magnetic field 2050, a current, such as alternating electrical current 2060 is induced in heating structure 2020. When alternating electrical current 2060 is induced in heating structure 2020, the electrical resistance of heating structure 2020 results in the heating of heating structure 2020.

When a substance, such as fluid housed within a fluid reservoir 1950 of FIGS. 19A-19B, is in thermal contact with or thermally coupled to heating structure 2020 and an electrical current passes through heating structure 2020, heating structure 2020 may energize or heat the substance. The inductive heating of heating structure 2020, as described herein, requires no physical contact between heating element 2010 and heating structure 2020. Accordingly, various dispensers disclosed herein may employ inductive heating to heat or otherwise energize a heating structure 2020 remotely or at a distance. Thus, because heating element 2010 is physically isolated from heating structure 2020 and the substance to be energized by heating structure 2020, heating element 2010 does not come into physical contact with the substance to be energized. Accordingly, contamination paths and user contact with heated elements are reduced.

Figure 20B:
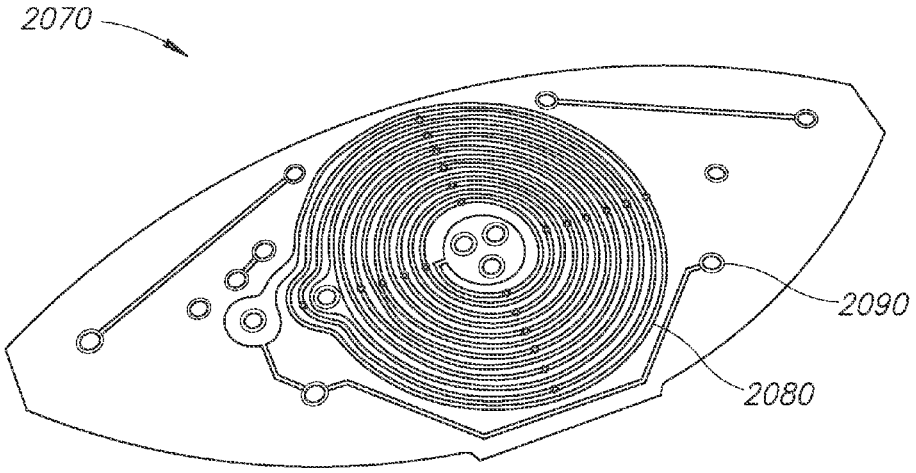
FIG. 20B illustrates an embodiment of a heating element consistent with embodiments disclosed herein.

FIG. 20B illustrates an embodiment of heating element 2070 that is consistent with embodiments disclosed herein. As shown in FIG. 20B, in a preferred embodiment, heating element 2070 is printed by employing printed circuit board (PCB) technology. Heating element 2070 includes a plurality of printed conductive coils 2080. Conductive coils 2080 are relatively inexpensive to implement by employing PCB technology. PCBs may be mass-produced with known techniques. Heating element 2070 also includes at least one terminal 2090 to supply an alternating current to the plurality of conductive coils 2080. Accordingly, algorithms or methods for inductively heating the substance may vary the frequency of the supplied current based on the properties of a substance.

In at least one embodiment, the supplied alternating current is a high frequency alternating current in conductive coils 2080. As heating element, such as heating element 2070, may be employed to energize or heat a heating structure, such as heating structure 2020 of FIG. 20A or heating structure 1920 of FIGS. 19A-19B, at a distance by inductive heating. Various algorithms that vary the frequency of the supplied current or otherwise strategically control an alternating current source, such as alternating current source 2030 of FIG. 20A, may be used to selectively control the temperature or rate of heating of the heating structure and a substance in thermal contact with the heating structure.

Figure 21A:
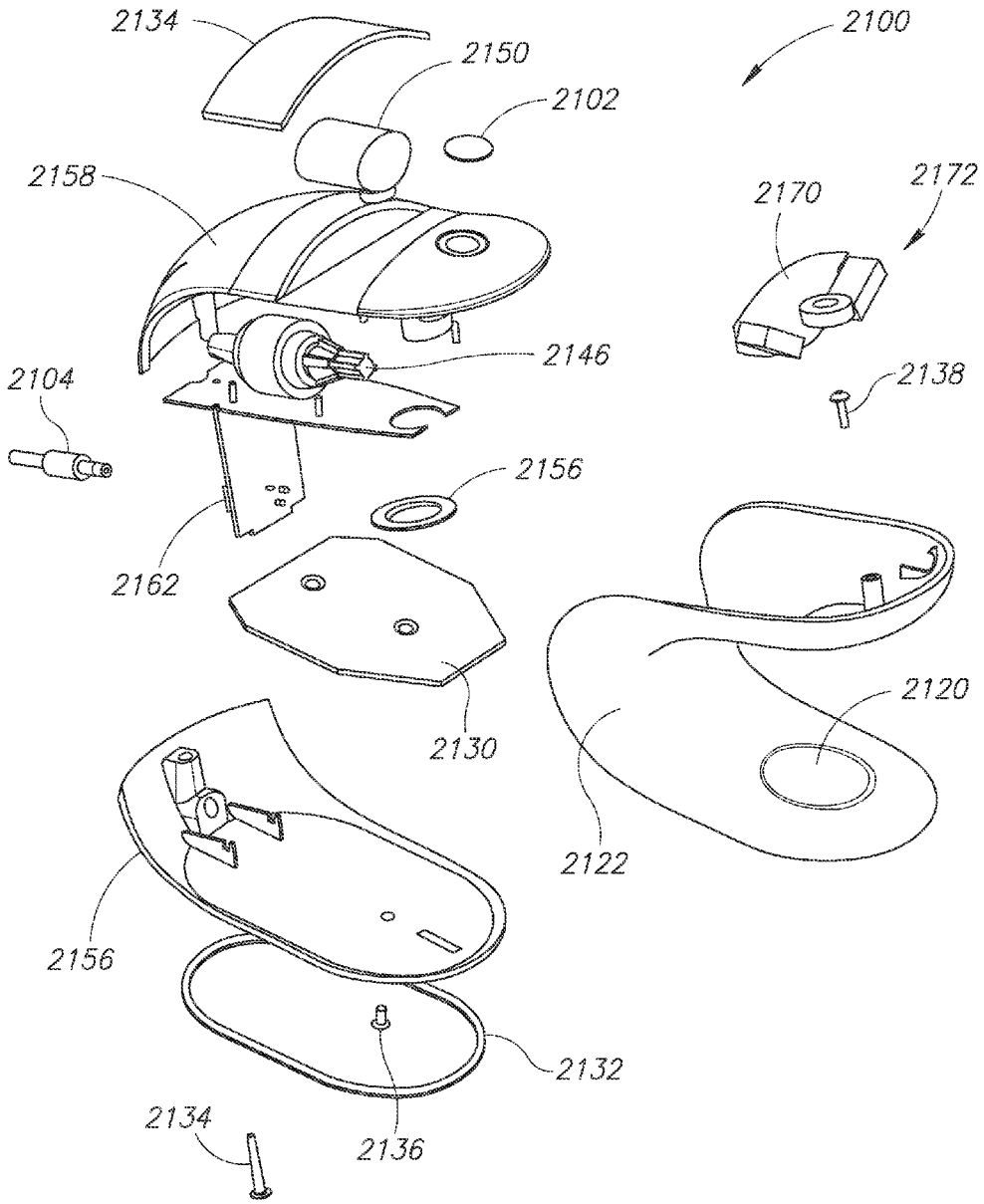
FIG. 21A illustrates an exploded view of the dispenser consistent with the embodiments disclosed herein.

FIG. 21A illustrates an exploded view the dispenser discussed above, consistent with the embodiments disclosed herein. Dispenser 2100 includes a housing. Housing includes front piece 2122, upper piece 2158, and base piece 2156. Front piece 2122 includes a gap to receive at least one hand of a user to intercept the fluid dispensed from dispenser 2100. In some embodiments, dispenser's 2100 housing includes a rubber foot 2132 and a base weight 2130, installed on the base portion to stabilize dispenser 2100 when it is resting on a surface, such as a nightstand or table.

Housing also includes a removable or slidable lid 2134 to conceal the receptacle, cavity, or compartment that removably receives fluid reservoir 2150. Dispenser 2100 includes a removable power cord 2104 to provide electrical power. Heating element 2172 inductively energizes or heats fluid housed within reservoir 2150. Heating element includes a printed circuit board 2170. Printed circuit board 2170 includes conductive coils. Conductive coils provide an inductive current to a heating structure within reservoir 2150. The heating structure and fluid housed within reservoir 2150 are thermally coupled.

Figure 23A:
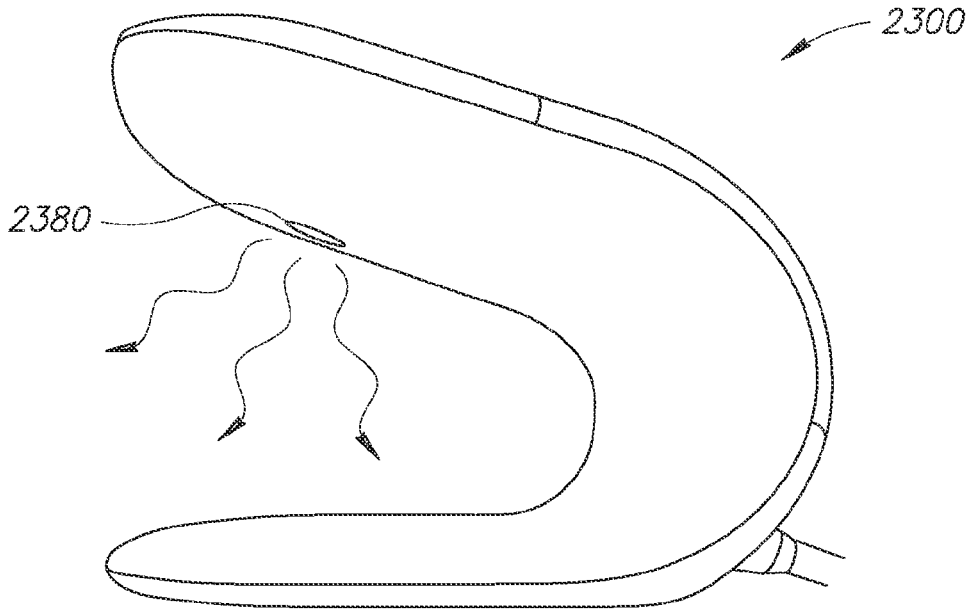
FIG. 23A illustrates a side view of the dispenser consistent with the embodiments disclosed herein. An electromagnetic source included in the dispenser is illuminating the dispenser.

Dispenser 2100 includes circuit board 2162. Circuit board 2162 includes various electronic devices and/or components to enable operation of dispenser 2100. Such devices and/or components may include, but are not limited to processor devices and/or microcontroller devices, diodes, transistors, resistors, capacitors, inductors, voltage regulators, oscillators, memory devices, logic gates, and the like. Dispenser 2100 includes switch 2102. Dispenser 2100 includes a nightlight. In at least one embodiment, the nightlight emits visible light upwards through switch 2102 to indicate a dispensing mode or other user selection. In preferred embodiments, the nightlight illuminates at least a portion of the gap in front piece 2122 where the user inserts their hand to receive a volume of dispensed fluid. As shown in FIG. 23A, in some embodiments, nightlight illuminates visible light downwards from around the dispensing aperture. Ring lens 2156 or a light guide may focus and/or disperse light to obtain the desired illumination effect. Ring lens 2156 may surround or circumscribe an outer perimeter of the dispensing aperture. Dispenser 2100 includes an actuator. In various embodiments, the actuator may include electric motor 2146. However, other embodiments are not so constrained.

Various fasteners and couplers including but not limited to fasteners 2134, 2136, and 2138, couple the components of dispenser 2100. Dispenser 2100 includes containment depression 2120. Containment depression 2120 contains and/or retains any fluid dispensed not intercepted by a user's hand. In a preferred embodiment, containment depression 2120 is included in front piece 2122.

Figure 21B:
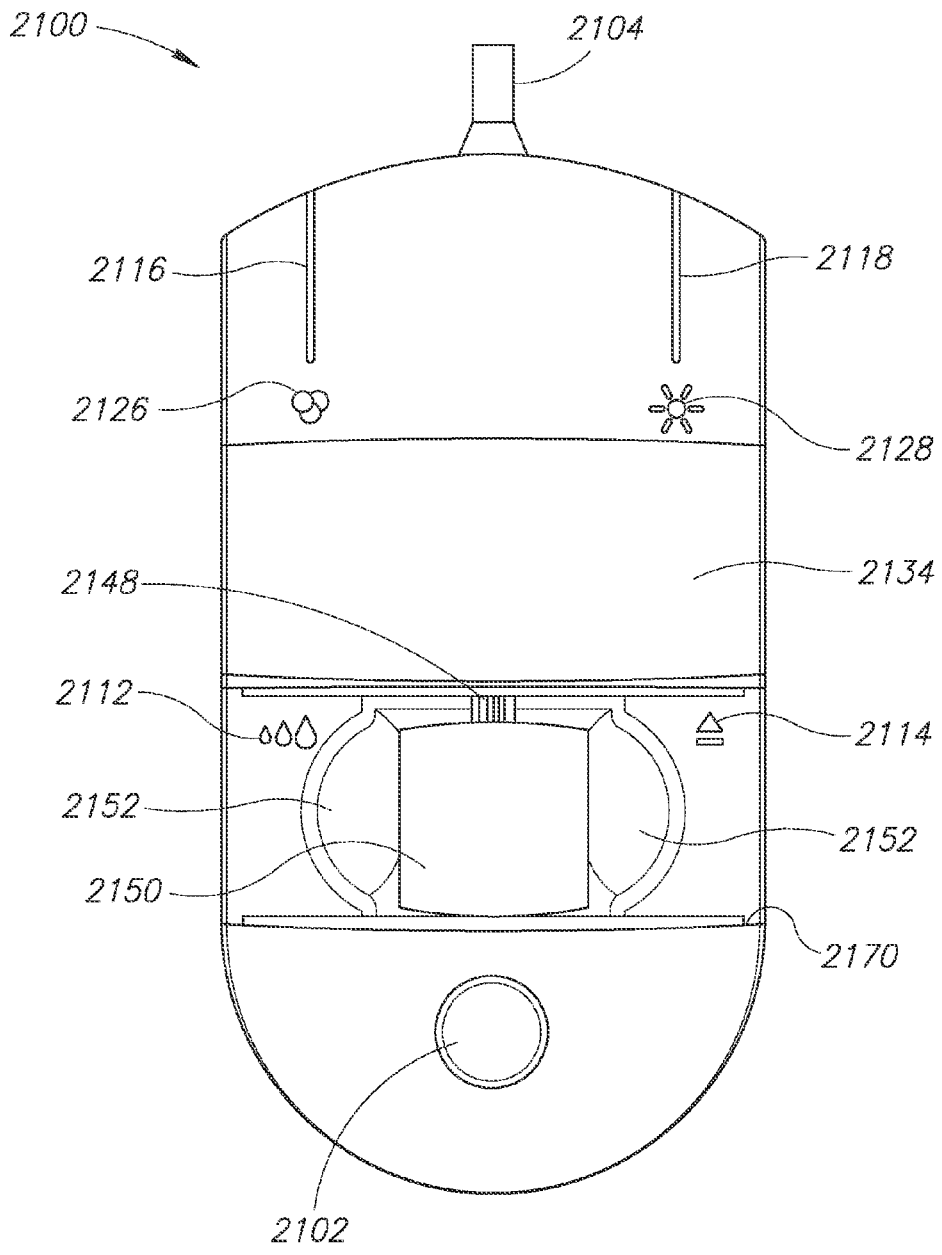
FIG. 21B illustrates a top view of the dispenser consistent with the embodiments disclosed herein. The lid is open to reveal a fluid reservoir, such as the fluid reservoir of FIGS. 19A-19B received by the dispenser.

FIG. 21B illustrates a top view of another embodiment of a dispenser consistent with the embodiments disclosed herein. Lid 2134 is open to reveal a fluid reservoir, such as the fluid reservoir 1950 of FIGS. 19A-19B. Dispenser 2100 removably receives the reservoir. An actuator in dispenser 2100 includes driveshaft 2148 to translate a displaceable piston included in reservoir 2150, such as piston 1904 of FIGS. 19A-19B. In some embodiments, the actuator includes a device that converts electrical energy into mechanical work, such as an electric motor. The mechanical translate drive driveshaft 2148 and/or other actuator components. Other embodiments may employ other mechanisms to drive driveshaft 2148. At least one embodiment employs hydraulics to drive driveshaft 2418.

Dispenser 2100 includes heating element 2170. Heating element 2170 may inductively generate or provide an electrical current in a corresponding heating structure, such as heating structure 1920 of FIGS. 19A-19B, embedded in reservoir 2150. The induced current energizes or heats at least a portion of the fluid housed with reservoir 2150. In preferred embodiments, when dispenser 2100 receives reservoir 2150, the heating structure within reservoir 2150 is proximate to heating element 2170. However, heating element 2170 is physically isolated from the heating structure. The second end of the reservoir's 2150 body acts as a barrier between heating element 2170 and the heating structure. Likewise, the first end of reservoir's 2150 body is positioned such that driveshaft 2148 mates with a driven structure included on a piston of reservoir, such as driven structure 1908 and piston 1904 of FIGS. 19A-19B.

In at least one embodiment, heating element 2170 includes a sensor that detects a fluid type of the fluid housed within reservoir 2150. This sensing may determine a property of the heating structure embedded within the received reservoir 2150, such as but not limited to electrical conductivity or magnetic dipole strength. The determined heating structure property indicates the type of fluid housed with reservoir 2150. Other methods, including optical and/or mechanical methods, are employable to determine one or more properties of the fluid housed within reservoir 2150. For instance, mechanical methods based on the geometry of reservoir and a sensing the loading on an actuator that translates a piston in reservoir 2150, may be employed to determine the fluid properties. Algorithms employed to energize the fluid may be varied based on the properties of the detected fluid.

In other embodiments, received reservoir 2150 may not include a heating structure. For such embodiments, fluid housed within the received reservoir 2150 may be heated by resistive conductive elements embedded within or proximate to the receptacle or cavity that receives reservoir 2150. In such embodiments, direct rather than inductive heating is used to energize the fluid.

In at least one embodiment, dispenser 2100 includes temperature sensors to measure or sense the temperature of fluid within reservoir 2150. Dispenser 2100 may vary operation of heating element 2170 based on a current sensed in the heating structure or detected temperature of the fluid. For instance, when fluid reaches a predetermined maximum temperature, a controller or processor device included in dispenser 2100 may turn off or otherwise deactivate heating element 2170. Once the fluid's temperature falls below a predetermined minimum temperature, dispenser 2100 may re-activate heating element 2170. A user may select the minimum and maximum fluid temperature with various user controls included in dispenser 2100. In at least one embodiment, dispenser 2100 includes a programmable thermostat.

Dispenser 2100 includes a power supply and/or power source. In a preferred embodiment, the power source provides alternating current to dispenser 2100. Other embodiments are not so constrained and can operate with a DC power supply, such as an internal battery. The power supply may include power cord 2104. Power cord 2104 provides electrical power from an external supply to dispenser 2100. The supplied power is employed by various components of dispenser 2100, including but not limited to a processor device, the actuator, heating element 2170, an embedded nightlight, as well as various user interfaces and user selection devices. Power cord 2104 may include a wall-plug AC adapter, employing prongs for North America, Europe, Asia, or any other such region. Finger trenches 2152 assist in inserting and removing reservoir 2152 from the fluid reservoir receptacle or cavity of dispenser 2100.

Various user controls and/or user interfaces are included in dispenser 2100. At least one of the controls may be a touch sensitive control or sensor. Touch sensitive controls may be capacitive touch sensors. Touch sensitive sensors, controls, or components may be housed within dispenser's 2100 housing. The touch sensitive components can sense at least one of a touch, proximity of, or motion of a user's hand through housing. In preferred embodiments, sensing the proximity or motion of a user's hand underneath the dispensing aperture turns on the heating element to prepare the dispenser for use. Once the dispenser has heated the fluid adequately, a second positioning of the user's hand triggers a single dispensing event. For instance, when a user places a hand underneath the dispensing aperture, a proximity sensor may trigger the dispensing mechanism such that a volume of fluid is dispensed onto the user's hand.

A dispensing event or trigger dispenses a predetermined volume of fluid from reservoir 2150 and out through dispenser 2100 by translating driveshaft 2148 a predetermined distance. The predetermined distance corresponds to the predetermined volume. In at least one embodiment, dispenser 2100 includes a timer. The timer may prevent a dispensing event from occurring unless a lockout time has elapsed since the previous dispensing event. This lockout mode limits a dispensing frequency of dispenser 2100. Accordingly, the likelihood of a user accidentally triggering multiple dispensing events is minimized. The lockout time or maximum dispensing frequency may be programmed by a user employing various user controls or selectors.

Other touch sensitive or proximity/motion controls or sensors include at least one of brightness selector 2118, color selector 2116, volume selector 2112, and ejector 2114. Some of the user controls may be marked by an indicator or icon, such as brightness icon 2128 or color icon 2126 to indicate the functionality of the corresponding user control. Some of the user controls or icons may be illuminated with electromagnetic energy sources, such as LEDs to indicate a user's selection or other functionality.

At least one of the user controls, such as brightness selector 2118 or color selector 2116, may be a touch-sensitive slide control that continuously varies a user selection when a user slides their finger across the slide control. For instance, the embedded nightlight may include multiple electromagnetic energy sources of various frequencies to provide multiple frequencies, or colors, of visible light. In preferred embodiments, the electromagnetic sources are LEDs. Some of the LEDs may emit different colors. For example, at least one red LED, at least one greed LED, and at least one blue LED may be included in the nightlight to provide a light source. Various colors of visible light may be generated by blending red, green, blue (RGB) components.

Thus, the embedded nightlight may be a selectable or otherwise tunable RGB nightlight or light source. A user may continuously blend the selection of LEDs to activate by sliding their finger along color selector 2116. For instance, the intensity of the one or more differently colored LEDs may be varied by color selector 2116 to produce various colors emitted by the nightlight. Likewise, an overall brightness or intensity of the nightlight may be selected by continuously varying by brightness selector 2118.

Other user selectors or controls include volume selector 2112. The user may select the dose of fluid to be dispensed by dispenser 2100. In a preferred embodiment, the user may select one of multiple predetermined volumes to be dispensed. In the embodiment illustrated in FIG. 21B, three predetermined volumes are available, such as a small, a medium, or a large dose, as indicated by the three differently sized fluid drop icons of volume selector 2112.

Volume selector 2112 is a touch sensitive user control, and thus a user can touch the fluid drop icon sized to correspond to the desired dose. Alternatively, with each touch of the icon, the dose selection cycles to the next amount, illuminating the selection. Thus, each of the small, medium, and large drop indicators may include an individual LED. The currently selected volume may be indicated by illuminating the corresponding fluid drop icon by activating the appropriate LED. In other embodiments, a continuous selection of volumes to be dispensed is available. In such embodiments, volume selector 2112 is a slide control touch sensitive selector.

Dispenser 2100 varies the volume dispended by dispenser 2100 in a single dispensing event by varying the length that driveshaft 2048 translates the piston in fluid reservoir 2150 due to triggering the actuator. Because in preferred embodiments, the cross section of reservoir 2150 is uniform, the amount of fluid dispensed in one dispensing event is linearly proportional to the length that the piston is translated. Accordingly, dispenser 2100 varies the length that the driveshaft 2148 is driven in one dispensing event based on a user selection of volume selector 2112.

Ejector 2114 may be a touch sensitive control. When ejector 2114 is activated, driveshaft 2148 is translated away from the driven mechanism of reservoir 2150 and backed away from reservoir 2150 to allow the user to remove reservoir 2150 from dispenser 2100. In at least one embodiment, dispenser 2100 includes a spring-loaded mechanism to automatically eject reservoir 2150 when driveshaft 2148 has cleared the body of reservoir 2150.

In some embodiments, when driveshaft 2148 has cleared the body of reservoir 2150, an LED included in ejector 2114 is illuminated to indicate that a user may safely remove reservoir 2150. In other embodiments, an LED embedded within or proximate to the receiving receptacle is activated to indicate that reservoir 2150 may be safely removed. If the body of reservoir 2150 is transparent or translucent, any remaining fluid within reservoir 2150 may be illuminated. In other embodiments, this LED embedded in the receiving receptacle may indicate other functionalities. By using finger trenches 2152, a user may remove reservoir 2150 from dispenser 2100.

Other indicators included in dispenser indicate when a heating mode of dispenser 2100 has been activated. For instance, one or more LEDS may be activated in a "blinking mode" or a slowing pulsing light mode when dispenser is heating fluid within reservoir 2150. When the fluid has reached a predetermined temperature, the blinking or pulsing LED may switch to a "solid" mode. Alternatively, the light may change color to indicate readiness. It is understood that other methods of operating indicators may serve to indicate modes or functionality of dispenser 2100. Another indicator may indicate that reservoir 2150 is approaching an empty state and thus needs to be replenished or replaced. Other indicators may indicate an error state of dispenser 2100. The embedded nightlight may serve as one or more indicators.

Figure 22A:
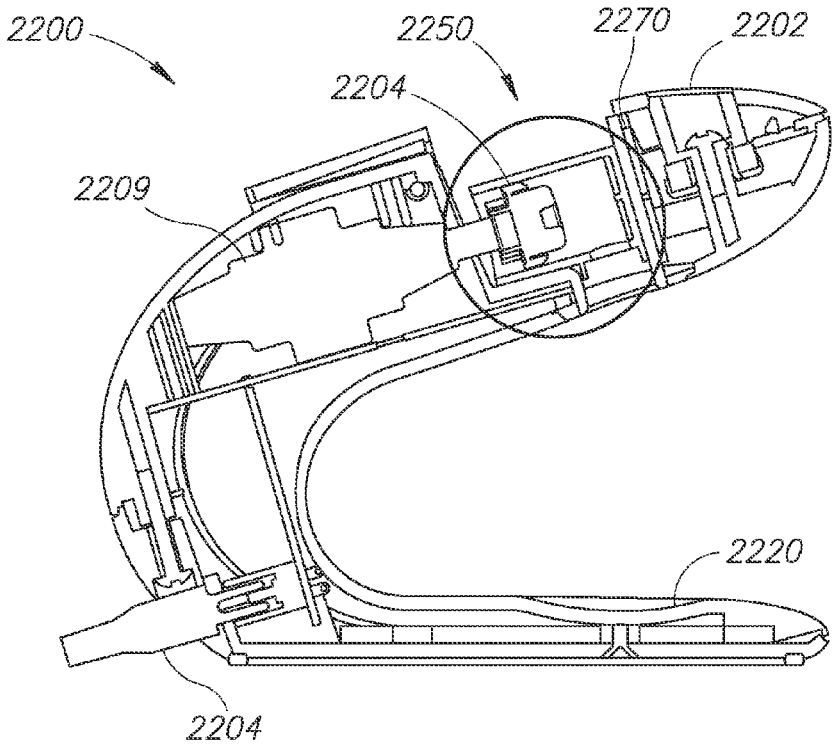
FIG. 22A illustrates a cutaway side view of a dispenser that has received a fluid reservoir.

FIG. 22A illustrates a cutaway side view of another embodiment of a dispenser and a received fluid reservoir consistent with the embodiments disclosed herein. Dispenser 2200 includes a removable power cord 2204. Dispenser 2200 includes power switch 2202. FIG. 22A illustrates a gap is in the housing. The gap defines a volume intermediate the dispensing aperture and containment depression 2220. The gap or volume receives a user's hand so that, during a dispensing event, the user's hand receives or otherwise intercepts fluid dispensed by dispenser 2200.

As disclosed herein, a motion or proximity sensor may detect when a user's hand is placed or moves within the volume. As illustrated in FIG. 23A, a nightlight included with dispenser 2200 may illuminate the volume that receives a user's hand. The first movement of a user's hand may activate the heating element. Once properly heated, further placement of a user's hand within the gap will activate the dispensing of the fluid. Any fluid that drops onto the lower base portion of the housing and is not intercepted by the user's hand is contained within containment depression 2220.

The housing of dispenser 2200 includes an actuator cavity 2209. Actuator cavity 2209 receives various components of dispenser's actuator, such as stepper motor 2246 of FIG. 22C. A driveshaft or pressing member of the actuator drives a piston 2204 included in received reservoir 2250. Deformed use tabs included on piston 2204 indicate that the driveshaft of the actuator has translated the piston and dispensed at least some of the fluid housed within reservoir 2250. Dispenser 2200 includes heating element 2270 to energize or heat fluid within reservoir 2250. Heating element 2270 induces a current in a heating structure within reservoir 2250.

Figure 22B:
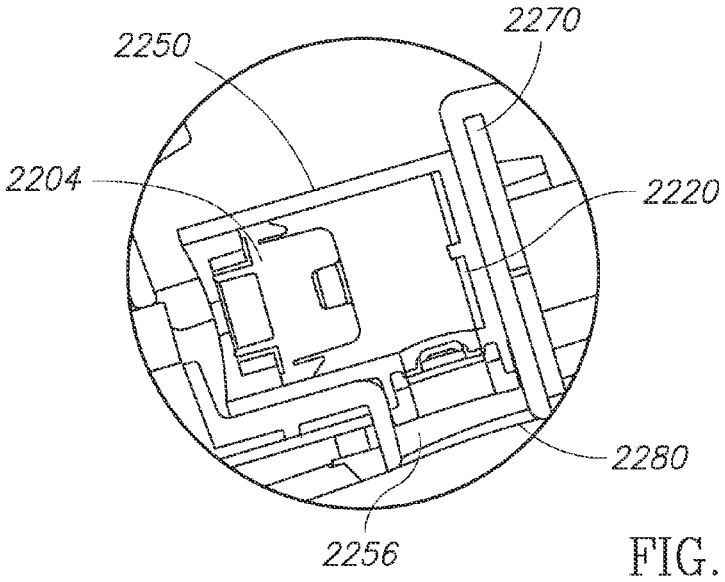
FIG. 22B is a close-up cutaway side view of FIG. 22A, where the dispenser's actuator has been shaft retracted.

FIG. 22B is a close-up view of fluid reservoir 2250. Fluid reservoir 2250 is received within dispenser 2200 that is consistent with the embodiments disclosed herein. In preferred embodiments, when dispenser 2200 receives reservoir 2250, heating element 2270 of dispenser 2200 is positioned in close proximity to heating structure 2220 included within reservoir 2250. However, there is no physical contact between heating element 2270 and the heating structure 2200 because a wall of the second end of reservoir 2250 isolates the two conductive components. Rather, alternating current in heating element 2270 induces a current in heating structure 2220. The induced current energizes fluid housed within reservoir 2250.

Dispenser 2200 includes dispensing aperture 2280 in an underside of dispenser 2200. Dispensing aperture 2280 may be located in a front piece of the housing of dispenser 2200, such as front piece 2122 of FIG. 21A. The outlet port of reservoir 2250 is recessed above the dispensing aperture of dispenser 2200. In addition, the perimeter 2256 of dispensing aperture 2280 is configured and arranged such that perimeter 2256 does not contact the valve of the outlet port of reservoir 2250. Accordingly, when a volume of fluid flows through the slits or openings of reservoir 2250, it is dispensed from dispenser 2200.

However, the dispensed volume of fluid does not make contact with any part of dispenser 2200, except for perhaps containment depression 2220. Accordingly, the only portion of dispenser 2200 that may require cleaning of dispensed fluid is containment depression 2220. Fluid reservoir 2250 is inserted into dispenser 2200. Furthermore, fluid reservoir 2250 may be depleted of the housed fluid over multiple dispensing events. Empty fluid reservoir 2250 may be removed from dispenser 2200 without leaving remnant or other traces of the fluid that was dispensed by dispenser 2200.

Figure 22C:
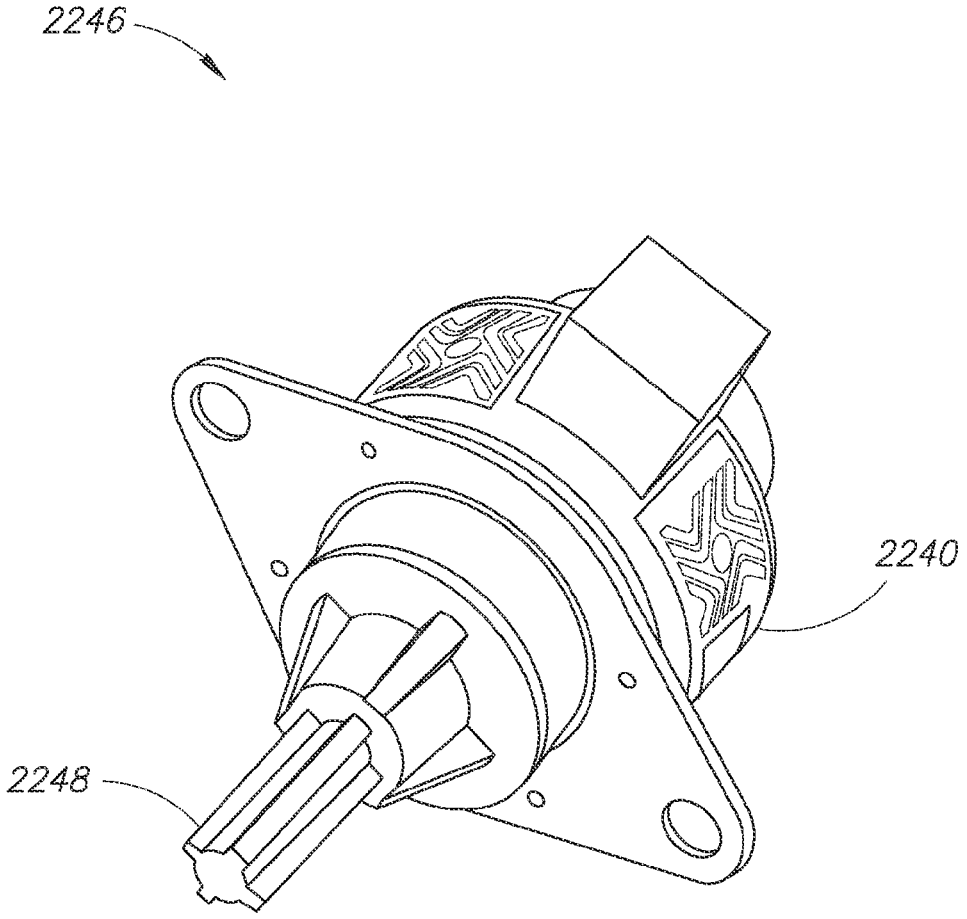
FIG. 22C illustrates a stepper motor that is included in an actuator consistent with the embodiments disclosed herein.

FIG. 22C illustrates stepper motor 2246 that is included in an actuator that is consistent with the embodiments disclosed herein. Stepper motor 2246 may be included in the actuator of various embodiments of dispensers disclosed herein. Stepper motor 2246 may include motor housing 2240. Motor housing 2240 houses conductive coils to convert electrical energy into mechanical work. The mechanical work drives driveshaft 2248. Pressing member or driveshaft 2248 may translate a piston in a reservoir to dispense fluid from a dispenser.

In various embodiments, stepper motor 2246 is enabled to accumulate a total distance, or a total number of steps that driveshaft 2248 has advanced. In a preferred embodiment, each step that driveshaft 2248 advances, driveshaft 2248 translates or displaces a piston included in a fluid reservoir a predetermined distance towards the second end of the reservoir's body. When the cross section of the reservoir's body is uniform along the translation axis, a predetermined volume of fluid housed within the reservoir is displaced by the piston and forced out of an outlet port of the reservoir. Accordingly, by accumulating a total driveshaft displacement distance or a total number of steps, the total amount of fluid dispensed from a dispenser can be determined. When an initial storage volume of the reservoir is known, a dispenser, such as dispenser 2200 of FIGS. 22A-22B, can determine how much fluid is left in the reservoir.

FIG. 23A illustrates a view of the dispenser 2300 consistent with the embodiments disclosed herein. An underside surface of the dispenser 2300 includes a dispensing aperture 2380. A nightlight included in dispenser 2300 illuminates the gap where a user's hand intercepts fluid dispensed by dispenser 2300. Electromagnetic energy sources, such as multi-colored LEDs, and a light guiding and/or focusing device, such as ring lens 2156 of FIG. 21A enables the functionality of the nightlight. A user may vary the color and/or intensity of the nightlight.

Figure 23B:
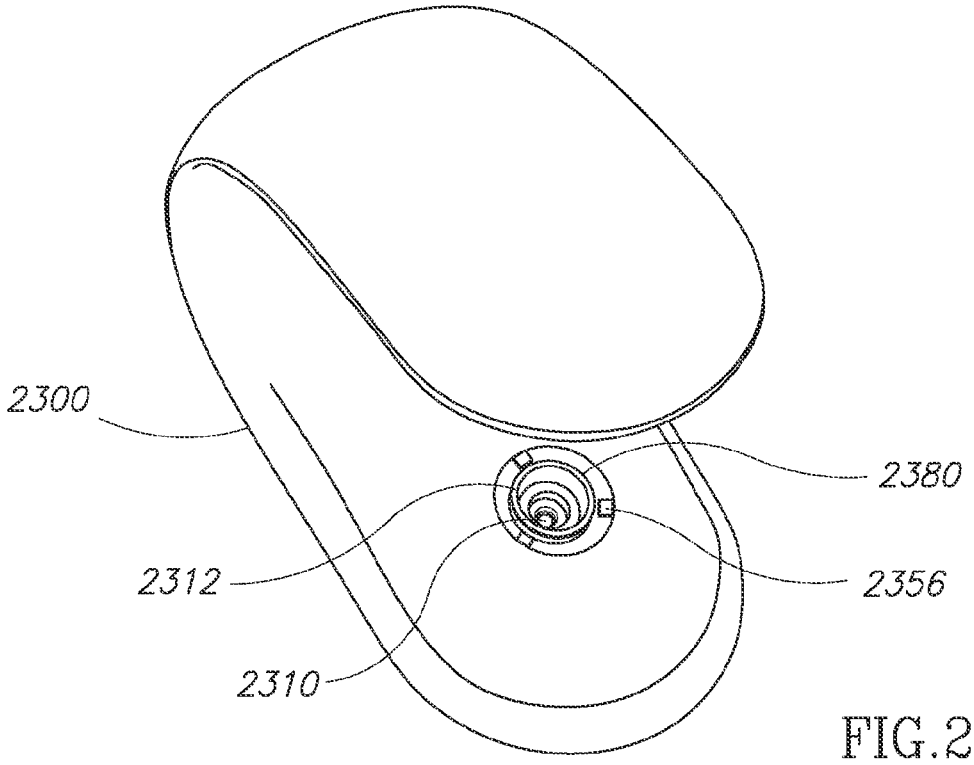
FIG. 23B illustrates an underside surface of the dispenser showing a dispensing aperture.

FIG. 23B illustrates another view of an embodiment of dispenser 2300 consistent with the embodiments disclosed herein. An underside surface of dispenser 2300 includes dispensing aperture 2380. FIG. 23B shows the perimeter 2356 of dispensing aperture 2380. An outlet port of a reservoir received by dispenser 2300 in exposed through dispensing aperture 2380. The valve 2310 of the outlet port is visible. Valve 2310 is recessed above aperture 2380. Note that a valve retainer 2312 of the outlet port isolates the slits or openings of valve 2310 from the dispensing aperture's outer perimeter 2312. Accordingly, when fluid flows through valve 2310, the fluid is isolated from dispenser 2300, including the perimeter 2356 of the dispensing aperture 2380. Accordingly, dispenser 2300 is not contaminated from the fluid that dispenser 2300 dispenses.

Figure 24A:
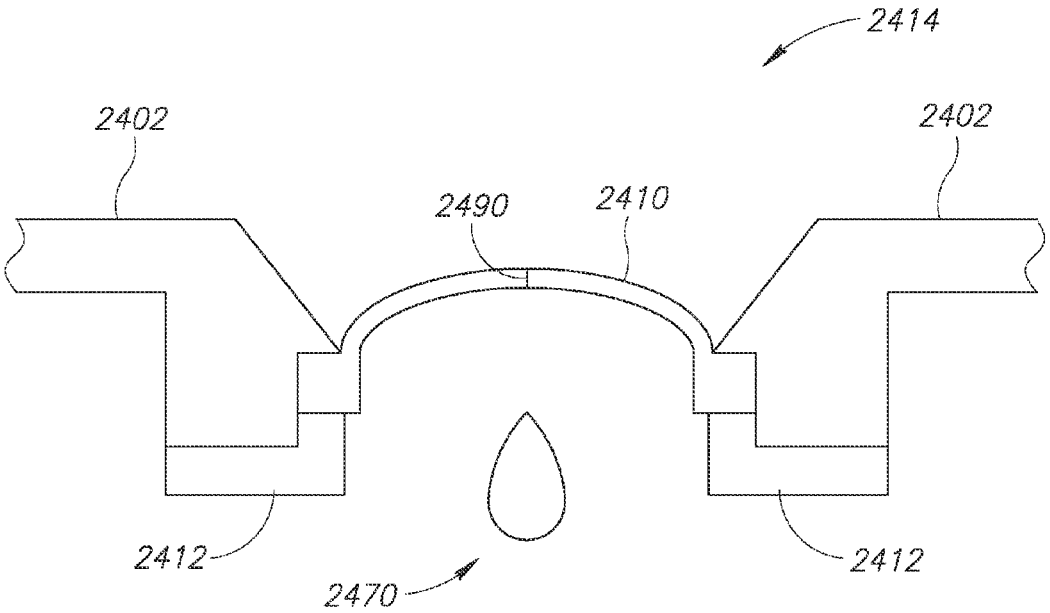
FIG. 24A illustrates a close-up cross-sectional side view of an outlet port of a fluid reservoir, such as the fluid reservoir of FIGS. 19A-19B.
Figure 24B:
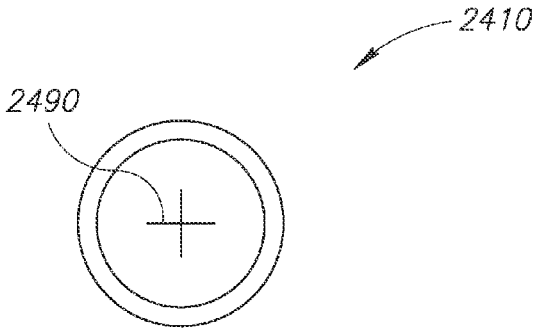
FIG. 24B illustrates a bottom view of a valve for an outlet port of a fluid reservoir, such as the fluid reservoir of FIGS. 19A-19B consistent with the embodiments disclosed herein.

FIG. 24A illustrates a close-up cross-sectional side view of outlet port 2414 of a fluid reservoir, such as the fluid reservoir of FIGS. 19A-19B consistent with the embodiments disclosed herein. FIG. 24A shows reservoir body 2402. Outlet port 2414 includes valve 2410 and valve retainer 2412. Valve 2410 and valve retainer 2412 mate with reservoir body 2402. Valve 2410 is recessed above valve retainer 2412. A dispensing force has displaced fluid housed within the reservoir. Accordingly, dispensed fluid volume 2470 has flowed through slit 2490 in valve 2419. During the transition from within the reservoir to outside the reservoir, dispensed fluid volume 2470 did not contact reservoir body 2404 nor valve retainer 2412. Surface tension and a gravitational field have formed dispensed fluid volume 2470 into a fluid drop.

FIG. 24B illustrates a bottom view of valve 2410 for an outlet port of a fluid reservoir, such as the fluid reservoir 1950 of FIGS. 19A-19B consistent with the embodiments disclosed herein. Valve includes slit 2490 to allow the flow of fluid from a first side of valve 2410 to a second side of valve 2410. In a preferred embodiment, the first side of valve 2410 faces an interior of the reservoir. The second side faces an exterior of the reservoir.

In various embodiments, multiple slits form slit 2490. The embodiment illustrated in FIG. 24B includes two transverse slits. The two slits may be orthogonal slits. In preferred embodiments, slit 2490 is a uni-directional slit, in that slit 2490. Uni-directional slits enable the flow of fluid from the first side to the second side but retard the flow of fluid from the second side to the first side. In other embodiments, slit 2490 is a bi-directional slit that allows the free flow of fluid in each direction.

Figure 25:
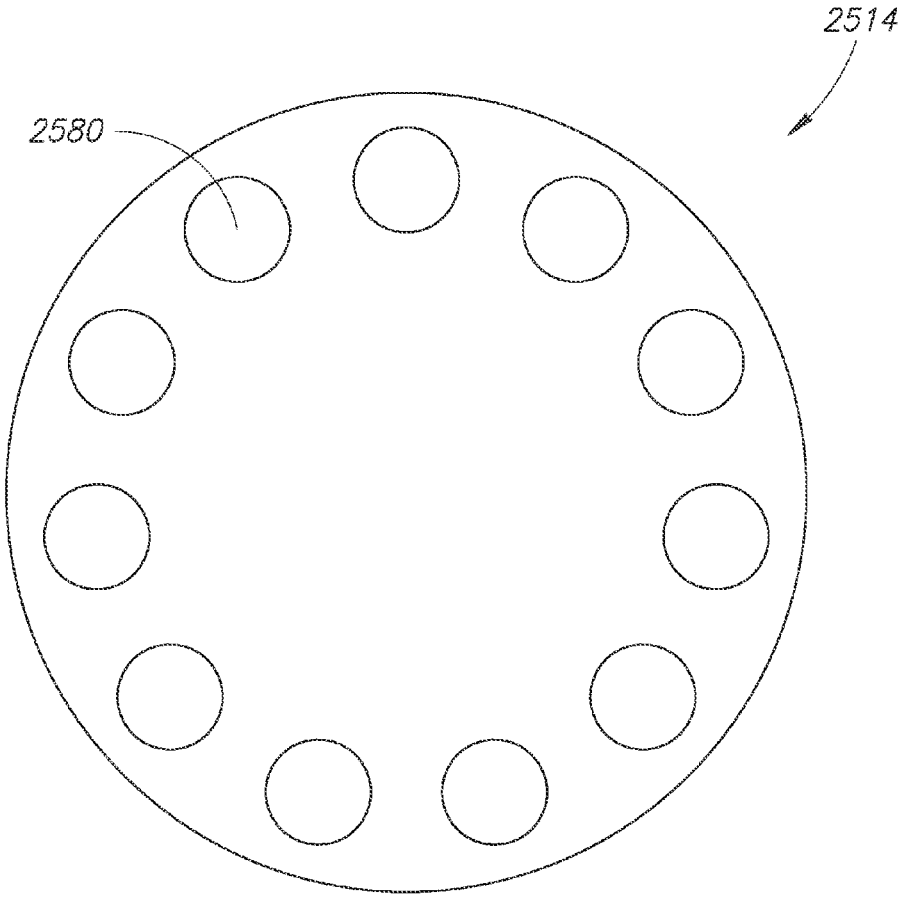
FIG. 25 illustrates a bottom view of an alternative embodiment of a fluid reservoir consistent with the embodiments disclosed herein.

FIG. 25 illustrates a bottom view of an alternative embodiment of a fluid reservoir consistent with the embodiments disclosed herein. Fluid reservoir 2514 is a rotatable fluid reservoir that includes a plurality of single serving fluid volumes 2580. In some embodiments, each single serving fluid volume 2580 is packaged in a blister-package style pod. Various embodiments of dispensers are enabled to rotate reservoir 2514 to successively align each single serving fluid volume 2580 with a pressing member or driveshaft of the actuator. The driveshaft can force the flow of or otherwise displace the fluid within each single serving fluid volume 2580.

In some embodiments, the displacement of the fluid punctures or ruptures a foil or thin film overlaying the single serving fluid volume 2580. In other embodiments, an actuator component, such as a needle or pin ruptures the foil or thin film. Once punctured or ruptured, the fluid will flow out of the dispensing aperture in the dispenser. The actuator can rotate fluid reservoir 2514 to await the next dispensing event. When each of the single serving fluid reservoirs 2580 have been depleted, a user can remove reservoir 2514 and provide the dispenser with a new fluid reservoir.

Figure 26A:
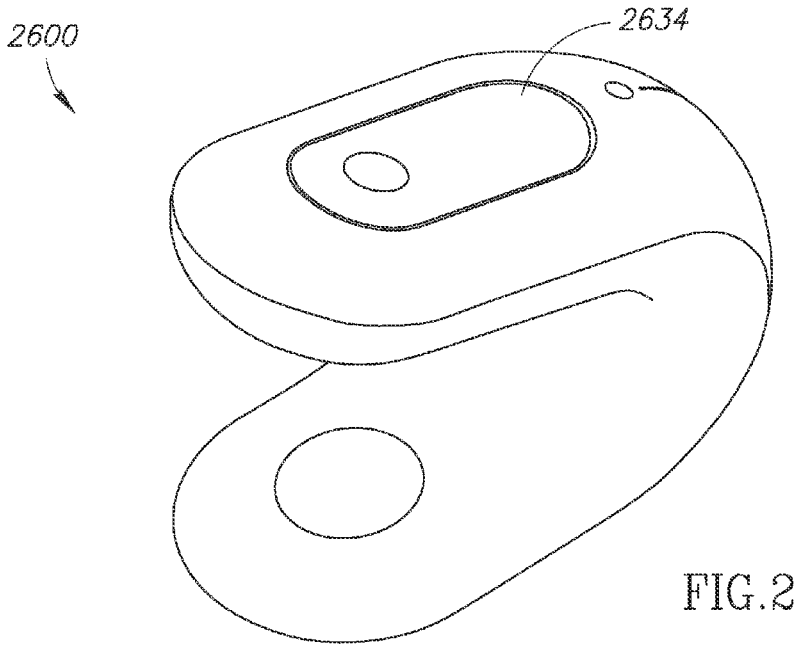
FIGS. 26A-26B provide views of another embodiment of a dispenser that includes a pivoting fluid reservoir receptacle assembly.
Figure 26B:
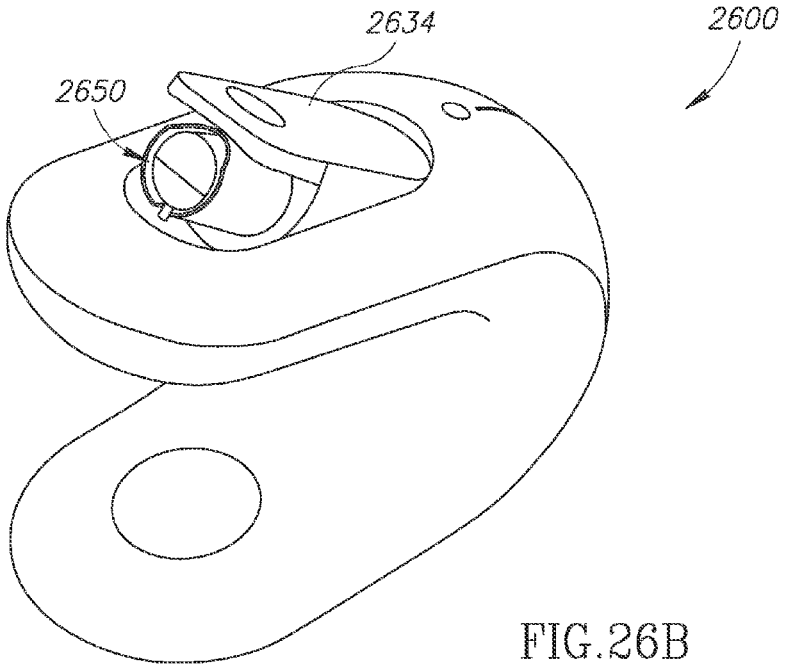

FIGS. 26A-26B provide views of another embodiment of a dispenser 2600 that includes a pivoting fluid reservoir receptacle assembly. Dispenser 2600 includes a housing and an aperture in the housing. In various embodiments, the pivoting assembly is included as part of the dispenser housing. The pivoting assembly includes a receptacle, such as fluid reservoir receptacle 2770 of FIG. 27. The receptacle is configured to removably receive a fluid reservoir, such as fluid reservoir 2650 of FIG. 26B. When the reservoir is received by the receptacle, an outlet port of the reservoir is exposed through the aperture. As discussed with other embodiments, dispenser 2600 includes an actuator, such as stepper motor 2246 of FIG. 22C. When actuated, the actuator provides a dispensing force that induces a flow of a predetermined volume of fluid within the reservoir through the outlet port and dispenses the fluid through the aperture. In at least some embodiments, dispenser 2600 includes a heating element, such as conductive coils 2780 of FIG. 27. The heating element is configured to heat at least a portion of the fluid within the reservoir.

In FIG. 26A, the pivoting fluid reservoir or receptacle assembly of dispenser 2600 is pivoted to a closed position. Because lid 2634 is closed, the fluid reservoir housed within dispenser 2600 is hidden from view in FIG. 26A. In FIG. 26B, the pivoting receptacle assembly of dispenser 2600 is pivoted to an open position. When open, lid 2634 of dispenser 2600 is pivoted to an upwardly angled position to reveal fluid reservoir 2650. In FIG. 26B, dispenser 2600 has slidably received fluid reservoir 2650, such that dispenser 2600 houses fluid reservoir 2650.

Figure 27:
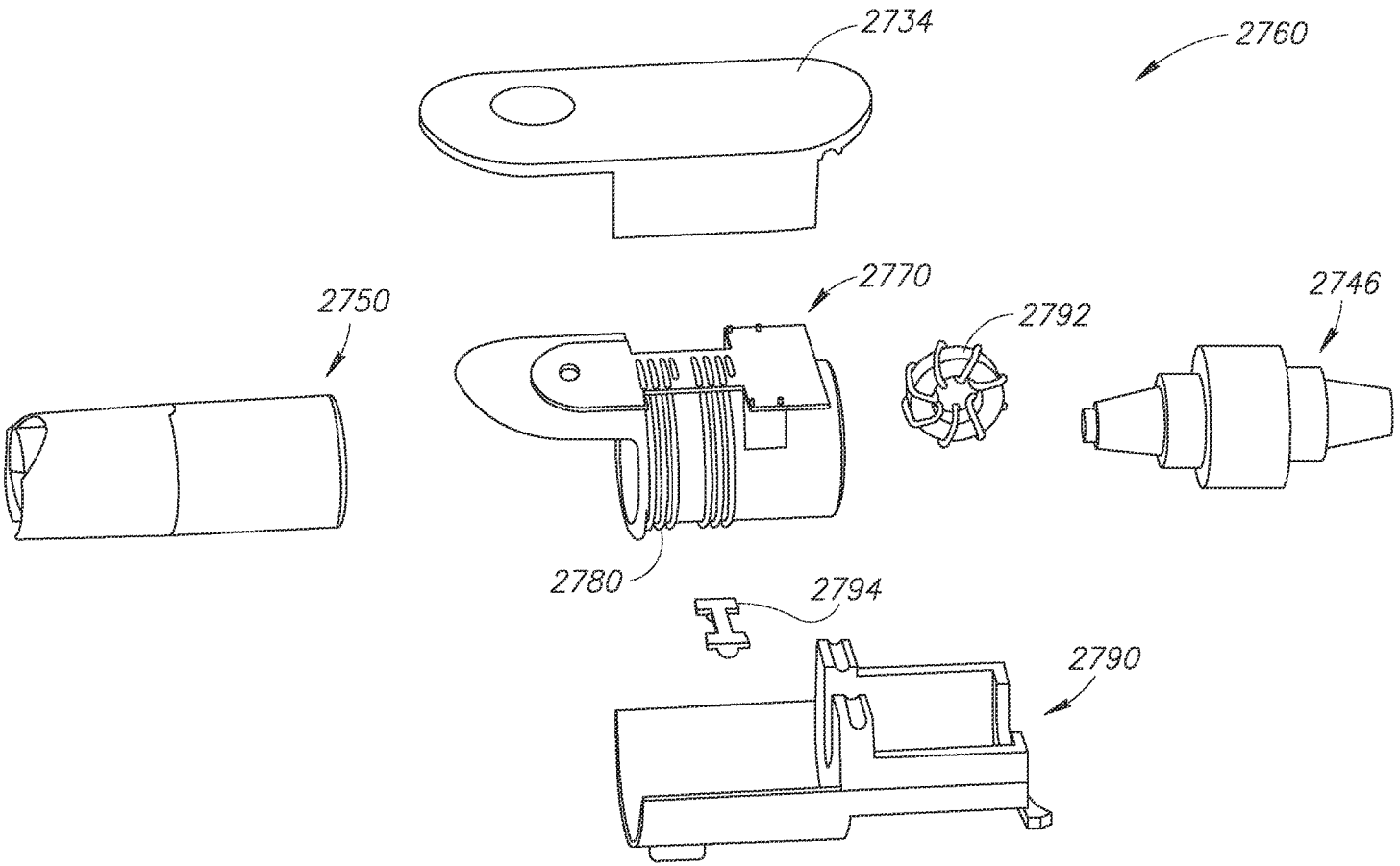
FIG. 27 illustrates an exploded view of pivot assembly 2760 that is consistent with various embodiments described herein.

FIG. 27 illustrates an exploded view of pivoting fluid reservoir assembly 2760 that is consistent with various embodiments described herein. In various embodiments, pivoting fluid reservoir assembly 2760 is a pivoting receptacle assembly, or simply a pivot assembly. Pivot assembly 2760 may be included in various embodiments of dispensers disclosed herein, including, but not limited to dispenser 2600 of FIGS. 26A-26B and dispenser 3100 of FIGS. 31A-31B. Pivot assembly 2760 includes a pivot assembly body 2790 that is configured and arranged to receive actuator 2746 and fluid reservoir receptacle 2770. Actuator 2746 may be similar to stepper motor 2245 of FIG. 2246.

Figure 31A:
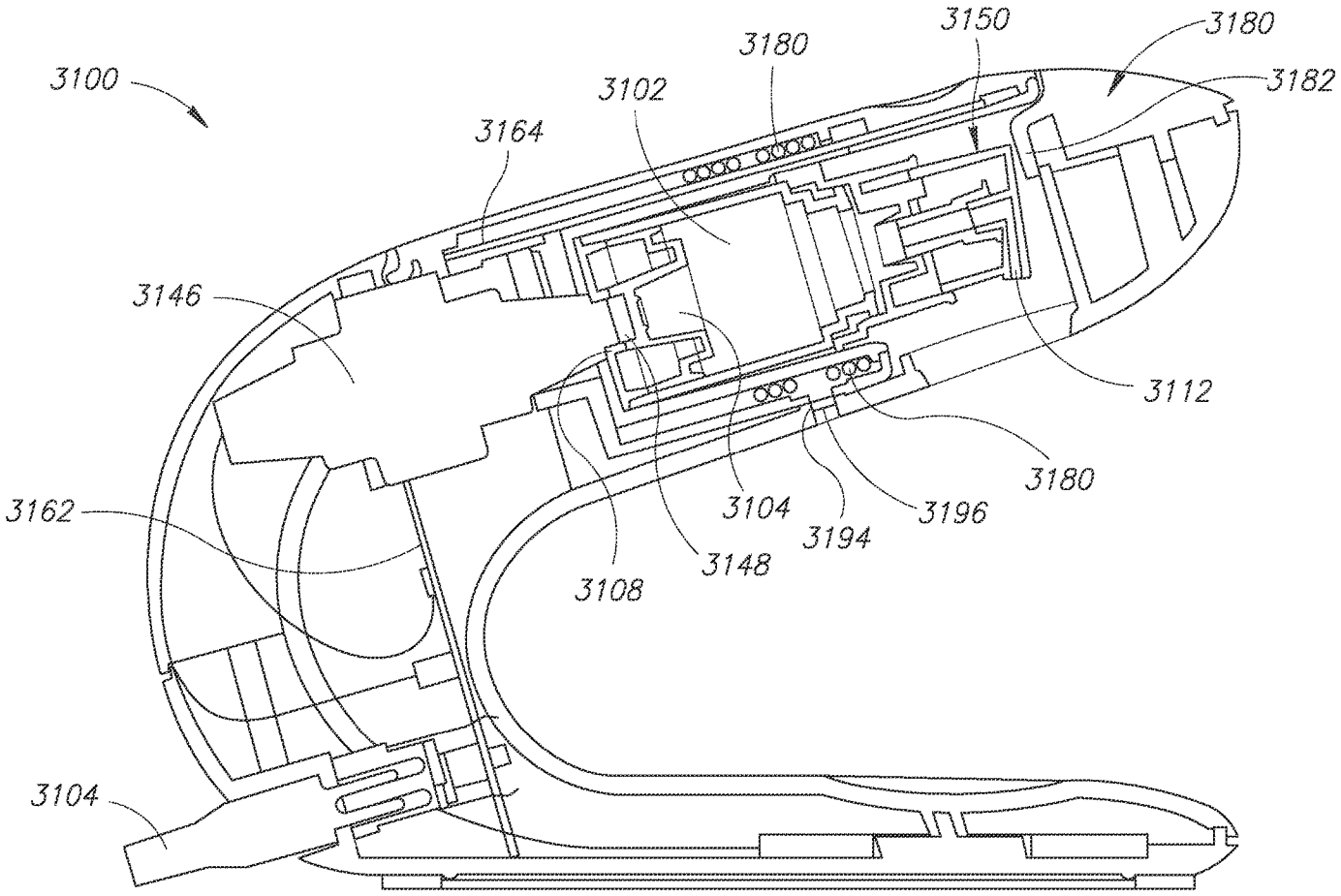
FIG. 31A provides a cutaway side view of a dispenser that includes a pivot assembly, where the pivot assembly has received a fluid reservoir and has been pivoted to a closed position.

When fluid reservoir 2750 is inserted into, or otherwise received by fluid reservoir receptacle 2770, a driveshaft of actuator 2746 is configured and arranged to engage with fluid reservoir 2750. For instance, as shown in FIG. 31A, reservoir 3150 is received by dispenser 3100. The actuator 3146 includes driveshaft 3148. Driveshaft 3148 engages with piston 3104 of piston 3150 through aperture 3108. This engagement enables the dispensing and/or discharge of the fluid housed within fluid reservoir 2750. Actuator 2746 is received in a cupped, rearward portion of pivot assembly body 2790. Fluid reservoir receptacle 2770 is received in a cupped, forward portion of pivot assembly body 2790. Thus, when assembly body 2790 is rotated or pivoted about its pivot axis, each of reservoir 2750, receptacle 2770, and actuator 2746 rotate together. Actuator 2746 engages with fluid reservoir 2750 through an aperture, U-channel, trench, or other opening in both assembly body 2790 and receptacle 2770. Actuator 2746 may be a linear actuator.

Receptacle 2770 includes conductive coils 2780. Conductive coils 2780 may be included in a dispenser heating element. Conductive coils 2780 are employed to inductively energize or heat fluid stored within fluid reservoir 2750. Conductive coils 2780 may inductively heat the fluid housed within reservoir 2750, in a similar inductive process to that as discussed in the context of FIGS. 20A-20B. In a preferred embodiment, conductive coils 2780 are positioned on an outer surface of receptacle 2770, so that the conductive coils 2780 do not physically contact the walls of fluid reservoir 2750. In other embodiments, conductive coils 2780 are located along an inner surface of receptacle 2770, or embedded within the walls of receptacle 2770. As shown in FIG. 27, conductive coils 2780 surround the body of fluid reservoir 2750. Conductive coils 2780 induce a current in a heating structure include in reservoir 2750. This induced current provides uniform inductive heating of the fluid contained within reservoir 2750.

Pivot assembly 2760 may include electrical choke 2792 to isolate noise or cross talk between conductive coils 2780, actuator 2746, and other frequency-sensitive electronic components housed within a fluid dispenser that includes pivot assembly 2760. Lid 2734 is included in pivot assembly 2734 to conceal fluid reservoir 2750, when pivot assembly is closed, in a manner similar to that as shown in FIG. 26A.

A photo-emitting circuit board 2794 is positioned in the bottom of pivoting body 2790. The photo-emitting circuit board 2794 includes at least one photo-emitter, such as an LED. The LED may be used as a nigh light feature, as discussed in the context of various embodiments herein. The photo-emitting circuit board 2794 may also include at least one of a motion sensor, another LED that points upward to illuminate at least a portion of receptacle 2770 when in an open position, or other LEDs to illuminate various control features. In other embodiments, the motion sensor is mounted on other circuit boards included in a dispenser. The motion sensor may be an infrared (IR) LED. Photo-emitting circuit board 2794 may engage with a corresponding aperture or lens that is at least partially transparent to the frequencies emitted by circuit board 2794. Such a configuration may be similar to photo-emitting circuit board 3194 and lens 3196 of FIGS. 31A-31B.

A latching element, or coupler may be included to fasten, secure, or otherwise hold pivot assembly 2760 in a closed position. In various embodiments, latching element is a magnetic element. Latching element secures pivot assembly in a closed position until disengaged by a user. In at least some embodiments, a user disengages latching element by a brief downward pressing on lid 2734. Latching element may provide tactile feedback to a user of an engage/disengage event. The latching element may be integrated into lid 2734.

Figure 28:
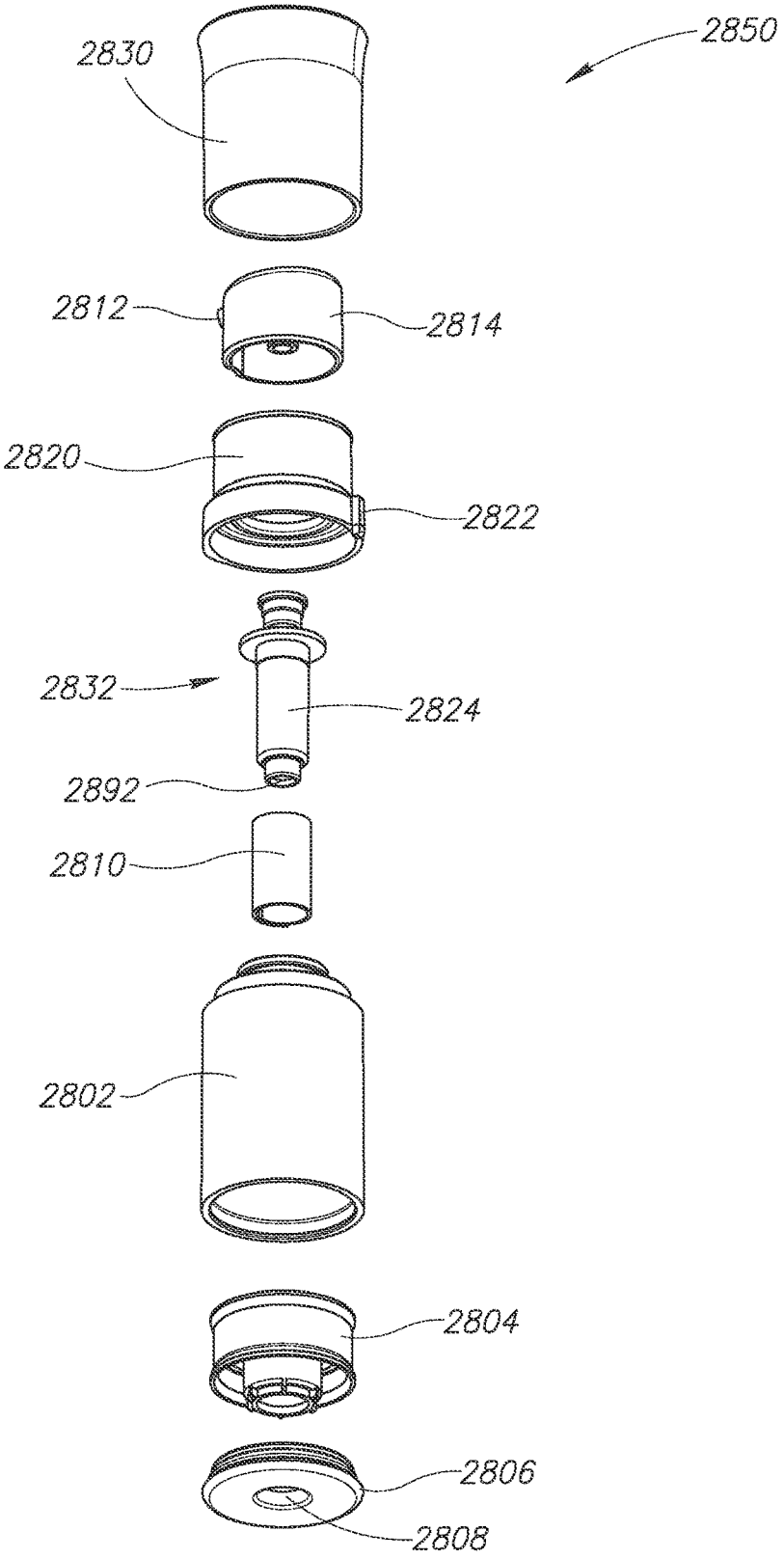
FIG. 28 provides an exploded view of another embodiment of a fluid reservoir used in conjunction with the various embodiments of fluid dispensers disclosed herein.

FIG. 28 provides an exploded view of another embodiment of a fluid reservoir used in conjunction with the various embodiments of fluid dispensers disclosed herein. For instance, dispenser 2600 of FIGS. 26A-26B may receive and dispense heated fluid from a fluid reservoir similar to fluid reservoir 2850. Fluid reservoir 2850 includes bottom cap 2806, translatable piston 2804, reservoir body 2802, pump or cap assembly 2820, nozzle assembly 2814, and over cap 2830. Reservoir 2850 may include a valve assembly 2832.

In a preferred embodiment, fluid reservoir 2850 is a customized airless pump reservoir or bottle. In various embodiments, valve assembly 2832 is integrated with pump or cap assembly 2820. Pump assembly 2820 may be a snap-on upper. In a preferred embodiment, valve assembly 2832 includes a lower valve assembly aperture 2892 that leads to an internal chamber, pathway, or cavity in valve assembly. An additional valve assembly upper aperture is included. For instance, valve assembly upper aperture 2994 of fluid reservoir 2950 shown in FIG. 29 may be similar to the upper aperture of valve assembly 2832. The upper aperture enables a flow pathway through the internal cavity of valve assembly 2832. This flow pathway is within the internal cavity of valve assembly 2832 and between lower aperture 2892 and the upper aperture. The flow pathway provides fluid communications between reservoir body 2802 and the nozzle 2812. One or more valves positioned within this flow path selectively block or otherwise inhibit flow through the flow path. A plurality of valves within valve assembly 2832 may enable a pumping action to bring fluid up from reservoir body 2802 and out through nozzle 2812. Various embodiments of valve assemblies are discussed in detail in regards to FIGS. 29-30.

Reservoir body 2802 may be a bottle, such as a 5 milliliter bottle. Reservoir body 2802 includes a first end, a second end, a cross section, and a longitudinal axis. In various embodiments, the longitudinal axis is a translation axis because piston 2804 is translated along the longitudinal axis. In a preferred embodiment, the cross section is substantially uniform along the translation axis for at least a portion of the length of reservoir body 2802. As shown in FIG. 28, the first end of body 2802 may be an open end to receive piston 2804. Reservoir body 2802 may be a cylindrical body, a tube-shaped body, or any other such configuration of a reservoir or bottle.

Bottom cap 2806 includes a centrally located aperture 2808 or other opening. Aperture 2808 enables engagement between a driveshaft of an actuator included in a dispenser with translatable piston 2804 of fluid reservoir 2850. The driveshaft is received by and passes through aperture 2808 to physically contact and engage with a mating portion of the bottom or rear portion of piston 2804. The bottom or rear portion of piston 2804 may be a driven structure. When mated or otherwise engaged with piston 2804, a translation of the driveshaft translates piston 2804, relative to reservoir body 2802. The translation of piston 2804 may be similar to the translation of a plunger that drives fluid through a hypodermic needle. As described in the context of at least FIGS. 29-30, a translation of piston 2804 towards a top or upper portion of body 2802 dispenses a portion of the fluid housed with fluid reservoir 2850. The fluid is dispensed from nozzle 2812, which is positioned on a lateral surface of nozzle assembly 2814. As shown in FIG. 28, nozzle 2812 may include a protrusion or tip positioned on the lateral or side surface of nozzle assembly 2814.

Nozzle 2812 may be included in an outlet port portion of reservoir 2850. The outlet port may include a valve retainer that mates with a dispenser's dispensing aperture when reservoir 2850 is received by a cavity and/or receptacle within the dispenser. In at least one embodiments, the valve retainer includes a retainer perimeter such that when fluid flows out through the outlet port, the flowing fluid flows without contacting the retainer perimeter.

In addition to the translation of piston 2804, a translation of nozzle assembly 2814 towards the top portion of reservoir body 2802 will also dispense a portion of the housed fluid through the outlet port or nozzle 2812. Accordingly, a user may dispense fluid from reservoir 2850 by supplying a pumping force on an upper surface of nozzle assembly 2814. This enables a hand operation of reservoir 2850. Thus, fluid may be dispensed from reservoir 2850 by either a hand operation of nozzle assembly 2814 or the translation of piston 2804. Over cap 2830 is provided to prevent an accidental triggering of a dispense event, such as a hand pumping or operation of nozzle assembly 2814 when reservoir 2850 is not in use or otherwise not received by a dispenser. In preferred embodiments, over cap 2830 is customized to account for a downward angle of nozzle 2812, as discussed below.

In some embodiments, reservoir 2850 initially includes a seal, such as a thin film, label, or other frangible/brittle element. The seal covers aperture 2808. On the initial use of reservoir 2850, a dispenser's driveshaft will puncture and/or perforate such a seal. The perforated seal on bottom cap 2806 provides a user a visual indication that reservoir 2850 has already been in use by a dispenser. Various embodiments may include one-time use tabs, similar to use tabs 1906 of FIGS. 19A-19B. These use tabs may be included with piston 2804, pump assembly 2820, valve assembly 2832, or on other structures of reservoir 2850. Use tabs may indicate if piston 2804 has been translated from its initial position.

Use tabs included on pump assembly 2820 or valve assembly 2832 are particularly advantageous because the use tabs signal a prior dispensing event triggered by either the translation of piston 2804 or a user initiated hand operation of nozzle assembly 2814. A heat shrink-type tamper seal may also provide an indication of prior use. In various embodiments describe herein, the actuator of a dispenser may sense a load or resistance on the driveshaft. Any of these prior-event signally mechanisms may provide a greater load on the actuator. Accordingly, the dispenser may auto-detect if a reservoir has been subject to a prior dispensing event or if the reservoir is a virgin reservoir. Furthermore, the dispensing force required by the driveshaft varies with the viscosity or other properties of the fluid. Also, the viscosity and other properties that affect the required dispensing force varies across the fluids that may be stored in a reservoir, such as reservoir 2850. For instance, the viscosity varies between a water-based, oil-based, and silicone-based lubricants. Accordingly, sensing the load on the actuator provides a means for determining the fluid housed within the reservoir. The dispenser may provide an indication to the user whether fluid reservoir 2850 has incurred a previous dispensing event and/or the fluid type.

In a preferred embodiment, pump assembly 2820 includes an alignment member 2822, or keyed portion, to insure proper alignment and/or orientation when inserted into a dispenser. The alignment member 2822 may include a protrusion, key, or other suitable structure that mates or engages with a corresponding structure in a fluid reservoir receptacle of the dispenser, such as fluid reservoir receptacle 2770 of FIG. 27. In such embodiments, fluid reservoir 2850 can only be inserted into the receptacle when alignment member 2822 is properly aligned with the corresponding keyed structure in the dispenser's receptacle. This insures that when received by the dispenser, reservoir 2850 is rotated about its longitudinal axis in the proper orientation. The proper rotation is required so that nozzle 2812 is oriented in a downward position and in alignment with a dispensing aperture of the dispenser.

In some embodiments, nozzle 2812 is angled downward (when reservoir 2850 is positioned in a vertical orientation). When fluid reservoir 2850 is received by a dispenser, such as dispenser 2600 of FIG. 26A, the reservoir's longitudinal axis is oriented, within the dispenser's dispensing arm, at an angle above the horizontal. The downward angle of nozzle 2812 orients nozzle 2812 substantially vertical and downward facing when reservoir 2850 is housed within a dispenser and a pivot assembly, such as when pivot assembly 2760 of FIG. 27 is pivoted to a closed position.

For instance, as shown in FIG. 31A, reservoir 3150 is received by dispenser 3100. Reservoir 3150 includes a downwardly angled (when oriented in a vertical position) nozzle 3112. When received in the upwardly angled dispenser arm 3180, angled nozzle 3112 is oriented substantially vertical. This vertical orientation of nozzle 3112 enables a clear line of sight with the vertical for the dispensed fluid to flow into the hands of a user. The clear line of sight prevents dispensed fluid from contacting surfaces of the dispenser, thus decreasing the need for periodic cleaning of a dispenser's dispensing aperture, such as dispensing aperture 2380 of FIGS. 23A-23B. In a preferred embodiment, the downward angle of nozzle 2812, as measured below the horizontal when reservoir 2850 is oriented upright, is substantially equivalent to the angle of a dispenser's dispensing arm, as measured above the horizontal. Nozzle 2812 may include a valve retainer that mates with the dispenser's aperture when the reservoir is inserted into a cavity or receptacle, such as receptacle 2770 of FIG. 27. The outlet port of nozzle 2812 may be oriented substantially perpendicular to the longitudinal axis of reservoir 2850.

Reservoir body 2802 includes a volume to house at least a portion of the fluid housed in reservoir 2850. The volume available to house the fluid may be substantially defined by the distance between piston 2804 and the other end of body 2802. In preferred embodiments, reservoir body 2802 includes a conductive heating structure 2810. A heating element, such as conductive coils 2780 of FIG. 27 may inductively generate a current in such a heating structure 2810, as described in at least the context of FIGS. 20A-20B. Conductive heating structure 2810 may be located around an outer surface of body 2802. In some embodiments, the heating structure 2810 is an internal structure.

Figure 29:
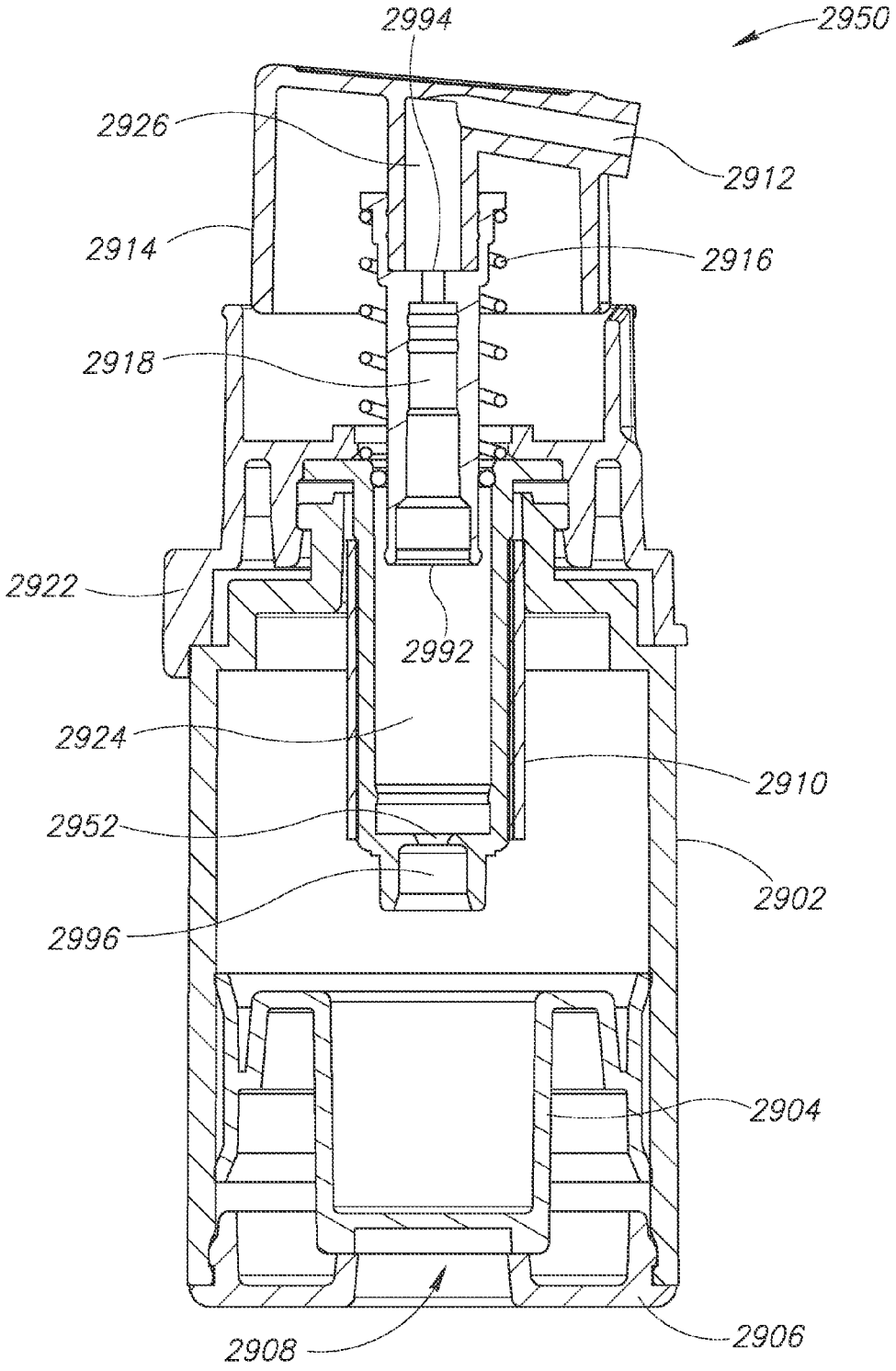
FIG. 29 shows a cut-away side view of another embodiment of a fluid reservoir used in conjunction with various embodiments of fluid dispensers disclosed herein. The nozzle assembly of the fluid reservoir is an uncompressed state.

Heating structure 2810 may be a conductive tube. In preferred embodiments, heating structure 2810 is configured and arranged, such that when reservoir 2850 is assembled, heating structure 2810 surrounds at least a portion of lower chamber 2824 of valve assembly 2832. At least a portion of heating structure 2810 is exposed to the fluid housed in reservoir body 2802. For instance, FIG. 29 shows that portions of heating structure 2910 are exposed to the volume of reservoir body 2902 of reservoir 2950. In other embodiments, heating structure 2810 is a conductive tube that substantially lines at least a portion of the outer surface of lower chamber 2824 of pump assembly 2820. In other embodiments, the conductive tube lines at least a portion of the inner surface of reservoir body 2802, including at least a portion of the fluid containing volume within body 2802. The heating structure 2810 is thermally coupled to the fluid housed within reservoir 2850.

The heating element 2810 may be constructed from any conductive material, such as copper, silver, gold, and the like. In preferred embodiments, the heating element 2810 is constructed from stainless steel. Heating element 2810 may be a stainless steel coil. Stainless steel is an advantageous material because stainless steel will not corrode and contaminate any of the fluid housed within body 2802. Also in preferred embodiments, heating element 2810 is preferably a magnetic element. When reservoir 2850 is received by a pivot assembly, such as pivot assembly 2760 of FIG. 27, inductive coils, such as coils 2780 of FIG. 27, surround the heating structure 2810. The conductive coils provide substantially uniform heating of the fluid contained within reservoir 2850. Furthermore, the tube-like configuration of the heating element 2810 will enable a quicker heating cycle. In at least one embodiment, heating element 2810 is integrated with valve assembly 2832.

FIG. 29 shows a cut-away side view of another embodiment of a fluid reservoir used in conjunction with various embodiments of fluid dispensers disclosed herein. The nozzle assembly of fluid reservoir is an uncompressed state. Reservoir 2950 includes bottom cap 2906. Bottom cap 2906 includes a central aperture 2908 to enable the engagement of a driveshaft with piston 2904.

Reservoir 2950 includes reservoir body 2902 that defines an internal volume that houses fluid. At least a portion of the internal volume is exposed to a conductive tube-like heating structure 2910. As shown in FIG. 29, in preferred embodiments, heating structure 2910 lines an outer surface of a lower chamber 2924 of a valve assembly, such as valve assembly 2832 of FIG. 28. As described throughout, a current is inductively generated in heating structure 2910 to heat the fluid contents. The internal volume of reservoir body 2902 is in fluid communication with the valve assembly and a pump assembly, such as pump assembly 2820 of FIG. 28. At least one of the valve or pump assembly is in fluid communication with nozzle assembly 2914, and in particular, downward angled nozzle 2912.

As discussed in the context of FIG. 28, a flow pathway exists through the valve assembly. One or more valves may selectively inhibit or enable the flow through the flow pathway. A lower valve assembly intake port intakes pressurized fluid from reservoir body 2902. Valve housing 2952 houses a lower valve, such as a ball valve that inhibits or enables fluid flow between intake port 2996 into the lower valve assembly chamber 2924. Upper spring valve 2918 inhibits or enables fluid flow between lower valve assembly chamber 2924 and a flow volume 2926 of nozzle assembly 2914, as discussed below. Spring valve includes a restoring spring 2916, a lower intake orifice or aperture 2992 and an upper output orifice or aperture 2994. Lower intake orifice 2992 and upper output orifice 2994 are in fluid communication through an internal cavity, or flow path, of spring valve 2918. A one-way valve may be positioned within valve 2918. Fluid flowing through the valve assembly flow path and into flow volume 2926 of nozzle assembly will be dispensed from reservoir 2950 through angled nozzle 2912.

Figure 30:
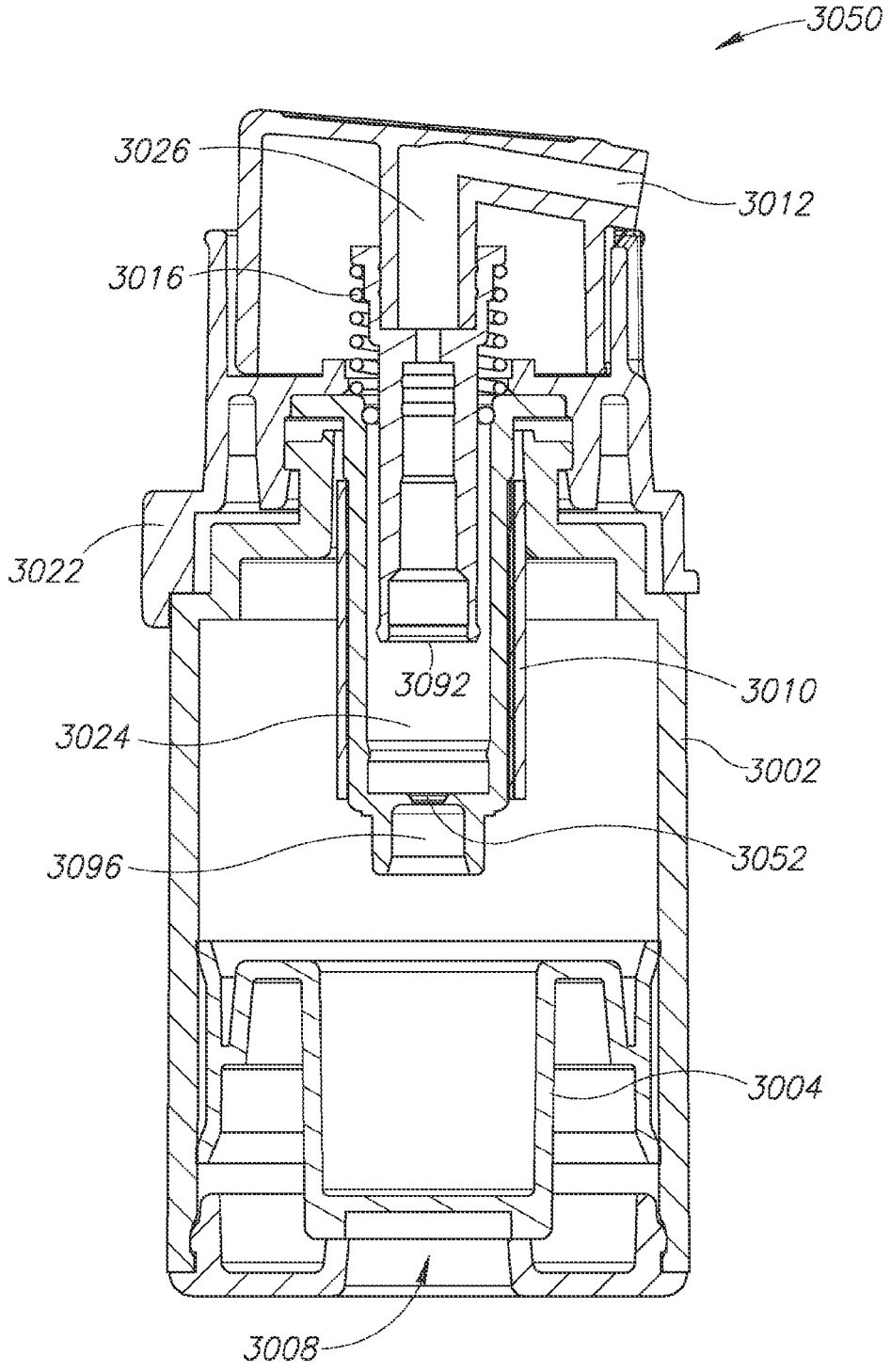
FIG. 30 shows another cut-away side view of a fluid reservoir used in conjunction with various embodiments of fluid dispensers disclosed herein. The nozzle assembly of the fluid reservoir is a compressed state.

The lower ball valve housed within housing 2952 and the upper spring valve 2918 prevent fluid communication between nozzle 2912 and body 2902 unless a dispensing event is triggered, such as when piston 2904 is translated upwards or nozzle assembly 2914 is translated downwards. FIG. 30 illustrates the downward translation of a nozzle assembly of reservoir 3050.

During a dispensing event, due to the displacement of piston 2904, the increased pressure of the fluid within body 2902 displaces the lower ball valve 2952. When ball valve 2952 is displaced and fluid flows from the higher pressure in body 2902 into lower valve assembly intake port 2926 and into the lower pressure chamber 2924 within the pump assembly.

When reservoir 2950 is positioned within or otherwise received by a dispenser, such as dispenser 3100 of FIG. 31A, nozzle assembly 2914 is prevented from translating forward by a dispensing member. As shown in FIG. 31A, the nozzle assembly of reservoir 3150 is prevented from translating by dispensing member 3182. As piston 2904 is continued to be translated, fluid flowing into lower chamber 2924 will increase the pressure within chamber 2924, overcoming the restoring force of internal spring 2916. Because the dispensing member is preventing the translation of the nozzle assembly, when the restoring force associated with internal spring 2916 is overcome, body 2902 translates toward nozzle assembly 2914.

When the restoring force of internal spring 2916 is overcome and reservoir body 2902 is translated toward nozzle assembly 2914, spring valve 2918 will be translated deeper into lower chamber 2924. For instance, as show in FIG. 30, a spring valve is translated into lower chamber 3024, exposing the lower intake aperture 3092 of the spring valve to the pressurized fluid in lower chamber 3024. When plunged into the pressurized fluid, lower intake orifice 2992 intakes or receives a portion of the pressurized fluid in lower chamber 3024. Due to the pressure differential, fluid flows through an internal cavity of spring valve 2918 into upper flow volume or chamber 2926 of nozzle assembly 2914.

From upper chamber 2926, the fluid flows out through angled nozzle 2912. Accordingly, a translation of piston 2904 upwards and a relative translation between body 2902 and nozzle assembly 2914 enables fluid flow from reservoir body 2902 and out of reservoir 2950 through nozzle 2912.

As the displacing force is removed from piston 2904, either by reduced pressure from fluid dispensed, reduction of mechanical load, or combination thereof, internal spring 2916 will restore the initial position of spring valve 2918, inhibiting the further flow of fluid from nozzle 2912. As the pressure within chamber 2924 subsides, the ball valve within housing 2952 will reseat to its initial position, inhibiting the flow of additional fluid into chamber 2924, thus cutting off the flow of fluid out through nozzle 2912 or outlet port. Thus, the ball valve within housing 2952 and the spring valve 2918 resist the output of fluid through nozzle 2912 unless a dispensing force increases an internal pressure of the fluid to overcome the resistance of the valves.

A hand operation of reservoir 2950 works on a similar principle; however, the nozzle assembly 2914 is translated toward body 2902. In a hand operation of reservoir 2950, only a predetermined volume of fluid may be dispensed in a single dispensing event. The predetermined volume of fluid is based on the total amount of fluid that is displaced by one pump of nozzle assembly 2914. Furthermore, in a hand operation of reservoir 2902, ball valve within housing 2952 prevents a backflow of pressurized fluid in lower chamber 2924 back into reservoir body 2902. In a dispensing event triggered by a translation of piston 2904, a lower ball valve is not needed because there will be no backflow from the lower chamber 2924 into the body 2902. Accordingly, some embodiments do not include a lower valve, such as a ball valve.

Another advantage of a dispensing event that is triggered by the translation of piston 2904 is that fluid will continue to be dispensed as long as the translation or displacing force is applied to piston 2904. Accordingly, any desired, or predetermined amount of fluid may be displaced in a single dispensing event, where a driveshaft applies a displacing and/or dispensing force on piston 2904. In preferred dispensing events, approximately a dosage of 0.1-0.2 ml of fluid is dispensed. However, as discussed herein, other embodiments are not so constrained and various dispensers enable a dosage selection from a user. Furthermore, reservoir 2950 may include an alignment member 2922 to prevent a misalignment when inserting reservoir 2950 into a dispensing unit. For instance, alignment member 2922 may be similar to alignment member 2822 of FIG. 28.

FIG. 30 shows another cut-away side view of a fluid reservoir used in conjunction with various embodiments of fluid dispensers disclosed herein. The nozzle assembly of the fluid reservoir 3050 is shown in a compressed state. The compression of spring 3016 has translated the spring valve downwards relative to reservoir body 3002, exposing intake orifice 3092 to the pressurized fluid in lower chamber 3024. As noted above, the fluid flows through the spring valve into upper chamber or flow volume 3026 of the nozzle assembly and out through angled nozzle 3012.

Accordingly, FIG. 30 illustrates a relative translation between the downwardly angled nozzle 3012 (or outlet port) and the reservoir body 3002. Such a translation is due to a dispensing event. In a hand operation dispensing event, a user translates the nozzle assembly downwards relative to the reservoir body 3002. If the dispensing event is triggered by a translation of piston 3004 upwards toward the nozzle assembly, the reservoir body 3002 is translated relative to the nozzle assembly. Such a translation of piston 3004 is enabled by the engagement of a driveshaft through aperture 3008. A tube-like heating structure 3010 that heats the fluid stored within fluid reservoir 3050, the intake port 3096, and a valve housing 3052 that houses an internal lower ball valve are also shown. Also shown is a keyed or alignment member 3022 to insure proper alignment when inserted into a fluid dispenser.

FIG. 31A provides a cutaway side view of a dispenser that includes a pivot assembly, where the pivot assembly has received a fluid reservoir and has been pivoted to a closed position. The view of dispenser 3100 in FIG. 31A may be similar to the view of dispenser 2200 shown in FIG. 22A. Dispenser 3100 may include similar features to dispenser 2600 of FIGS. 26A-26B and any other embodiments of dispensers disclosed herein. For instance, dispenser 3100 includes a dispenser housing that includes an upwardly angled dispensing arm 3180. The pivot assembly of dispenser 3100 may be similar to the pivot assembly 2760 of FIG. 27. Dispenser 3100 includes a pivoting actuator 3146 and a driveshaft. The driveshaft 3148 engages with piston 3104 of reservoir 3150 through the central aperture 3108 of reservoir 3150.

The pivot assembly includes conductive coils 3180 that surround the fluid containing body of reservoir 3150. The body of reservoir 3150 includes a conductive heating structure. In various embodiments, conductive coils 3180 substantially surround the portion of reservoir 3150 that includes the heating structure to induce an electrical current in the heating element. For instance, see the positioning of heating structure 2910 in FIG. 29 or reservoir 2950. The induced electrical current heats or warms the fluid contents of reservoir 3150 that are stored in reservoir body 3102. Because electric coils 3180 uniformly surround the heating element, the fluid is uniformly heated. Pivot assembly includes photo-emitting circuit board 3194 that is in alignment with at least partially transparent element 3196 of the housing of dispenser 3100. Photo-emitting circuit board 3194 includes at least one photon emitting device, such as an LED. As discussed herein, a latching element may also be included to fasten, or otherwise coupled, the pivot assembly in the closed position. The latching element may be magnetic latching element at least partially embedded in lid 3134 of FIG. 31B.

When the pivot assembly is in the closed position, reservoir's 3150 angled nozzle 3112 is oriented in a substantially vertical orientation, inhibiting the dispensed fluid from contact surfaces of the dispensing aperture of dispenser 3100. Because nozzle 3112 is positioned adjacent to rigid dispensing member 3182, nozzle 3112 is not translated in a dispensing event. Rather, the body 3102 of dispenser 3150 is displaced forward, relative to nozzle 3112. Such a displacement of the body dispensed the flow of fluid from reservoir 3150, as discussed in the context of FIGS. 29-30.

In addition to photo-emitting circuit board 3194, dispenser 3100 includes one or more circuited boards that are populated with electronic components to control the operation of dispenser 3100. At least one of the circuit boards may be a printed circuit board (PCB). For instance, dispenser 3100 includes an upper PCB 3164 that is populated with electronic components to control dispenser's 3100 night light, motion/touch sensors, various LED indicator's, inductive heating coils 3180, user controls, and the like. Similarly, lower PCB 3162 houses electronics to control actuator 3146. Power cord 3104 provides electric power to upper PCB 3164, lower PCB 3162, actuator 3146, and other electrically driven elements of dispenser 3100. In preferred embodiments, power cord 3104 provides alternating current (AC) electrical power.

Figure 31B:
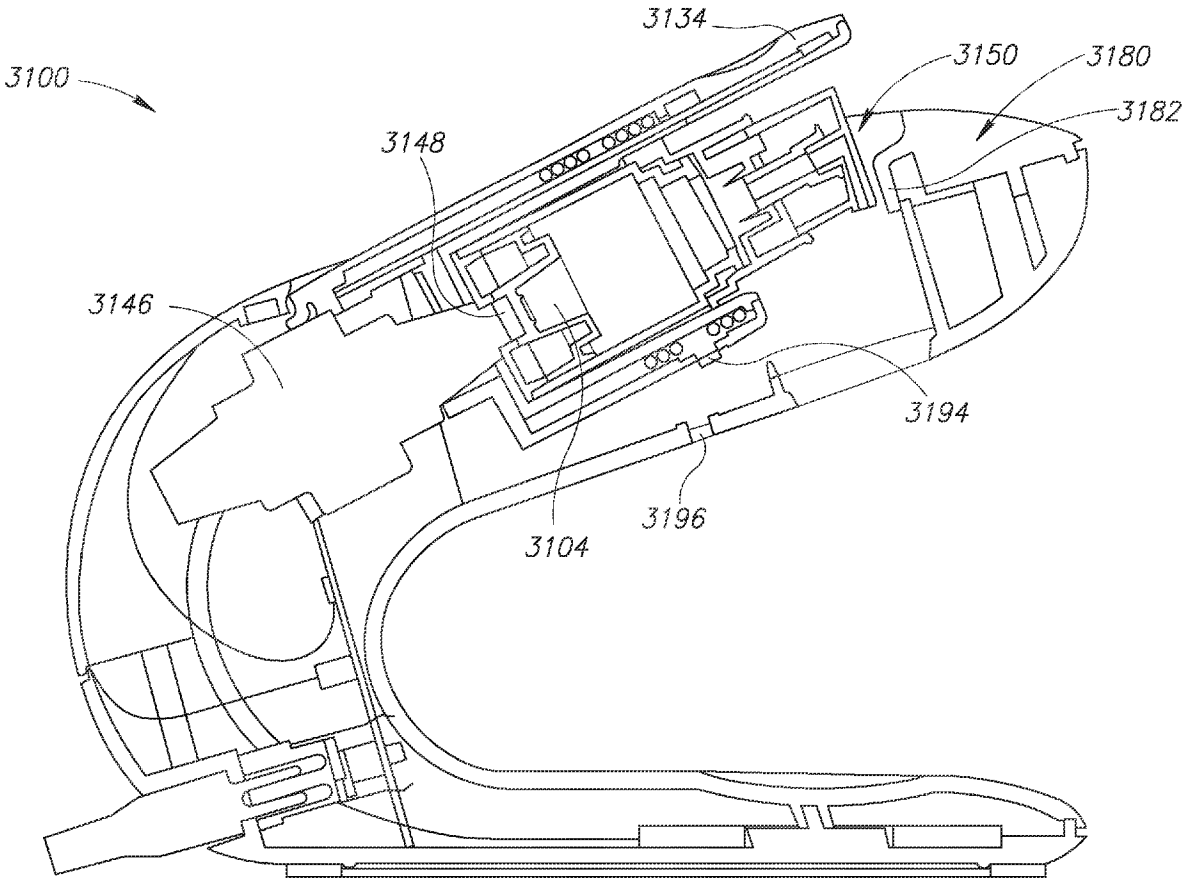
FIG. 31B provides a cutaway side view of the dispenser of FIG. 31A, where the pivot assembly has been pivoted to a partially open position to show adequate clearance of the angled nozzle.

FIG. 31B provides a cutaway side view of the dispenser 3100 of FIG. 31A, where the pivot assembly has been pivoted to a partially opened position. As partially opened, FIG. 31B illustrates adequate clearance of angled nozzle 3112 (of FIG. 31A) with dispensing member 3182 of angled dispensing arm 3180, as the pivot assembly in pivoted open and closed. In some embodiments, the pivot assembly is spring-loaded such that when latching elements are decoupled, the pivot assembly is automatically pivoted to the open position. When fully opened, reservoir 3150 may be removed from dispenser 3100. Note that actuator 3146, driveshaft 3148, photo-emitter board 3194, reservoir 3150, and lid 3134 pivot with the pivoting assembly. When pivoted to an open position, driveshaft 3148 may automatically retract from piston 3104 of reservoir 3150.

Figure 32A:
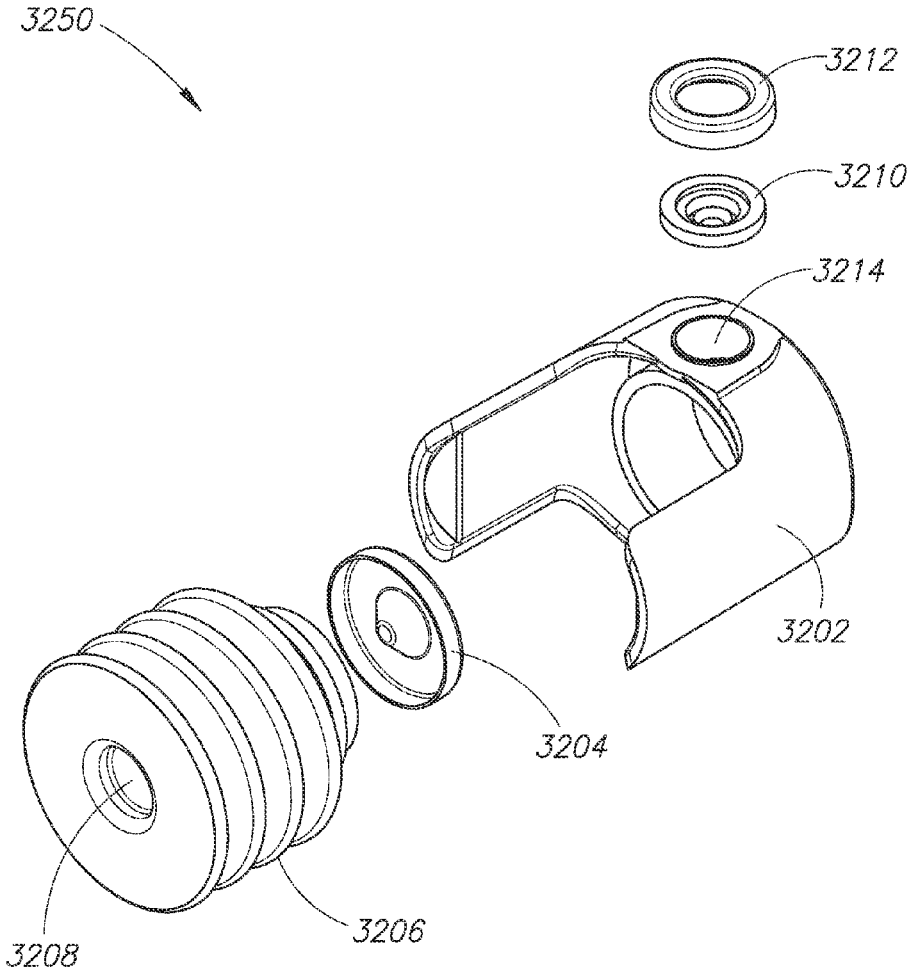
FIG. 32A illustrates an exploded view of another embodiment of a fluid reservoir consistent with embodiments disclosed herein.

FIG. 32A illustrates an exploded view of another embodiment of a fluid reservoir consistent with embodiments disclosed herein. Fluid reservoir 3250 may be a collapsible, or accordion-style reservoir. Fluid reservoir 3250 includes rigid reservoir body 3202 that is configured and arranged to receive or otherwise mate with flexible reservoir body 3206 to form the body of fluid reservoir 3250. Flexible reservoir body 3206 includes a flexible, accordion-like bellow body. Flexible body 3206 expands and contracts to accommodate the amount of fluid stored in reservoir 3250.

Fluid reservoir 3250 includes outlet port 3214. In various embodiments, outlet port 3214 includes valve 3210 and valve retainer 3212. Each of outlet port 3214, valve 3210, and valve retainer 3212 may be similar to outlet port 1914, valve 1910, and valve retainer 1912 of FIG. 19A-19B or outlet port 2414, valve 2410, and valve retainer 2412 of FIG. 24A-24B. Fluid reservoir 3250 includes translatable piston 3204. In preferred embodiments, piston 3204 is configured and arranged to mate with a distal end of flexible reservoir body 3206. Flexible body 3206 may include a trench or indent 3208 to engage with a driveshaft of a fluid dispenser. In various embodiments, piston 3204 engages with an inner service of flexible body 3206, so that when a driveshaft engages with indent 3208, the driveshaft translates piston 3204.

In a preferred embodiment, piston 3204 includes a centrally located protrusion or indent to engage with indent 3208 of reservoir 3208. As piston 3204 is translated towards outlet port 3214, fluid is dispensed and flexible body 3206 collapses to accommodate the decreased amount of fluid housed within reservoir 3250. Preferred embodiments include a heating structure, such as heating structure 1920 of FIGS. 19A-19B, heating structure 2020 of FIG. 20A, heating structure 2910 of FIG. 29, or any other heating structure discussed herein.

Figure 32B:
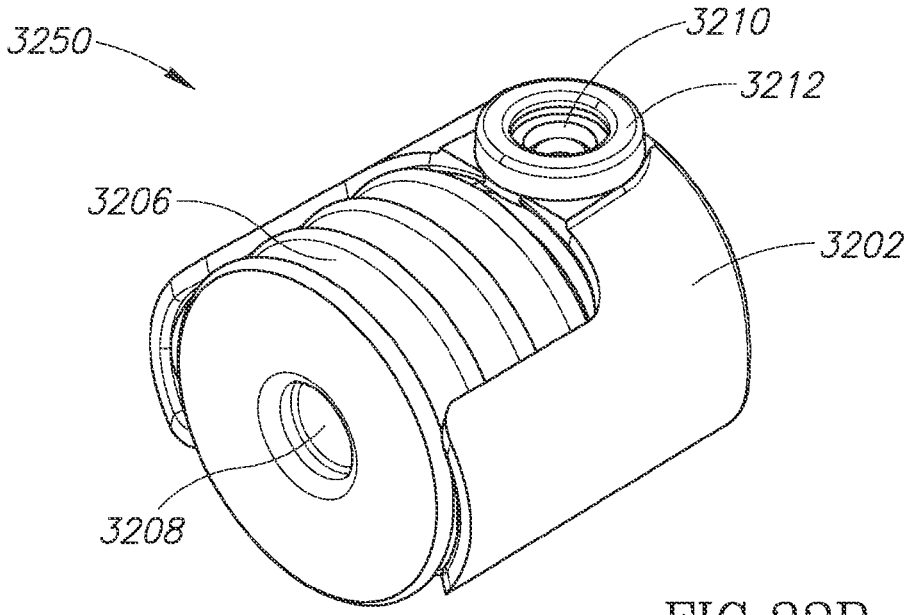
FIG. 32B illustrates an assembled isometric view of the assembled fluid reservoir of FIG. 32A.
Figure 32C:
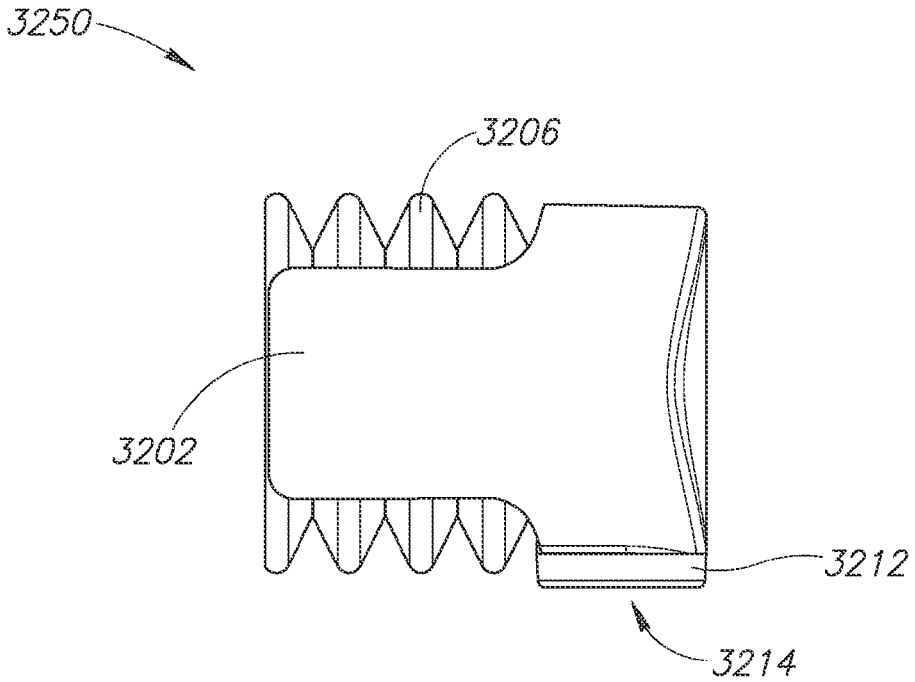
FIG. 32C illustrates a side view of the assembled fluid reservoir of FIGS. 32A-32B.

FIG. 32B illustrates a bottom view of the assembled fluid reservoir 3250 of FIG. 32A. FIG. 32C illustrates a side view of the assembled fluid reservoir 3250 of FIGS. 32A-32B.

Figure 33:
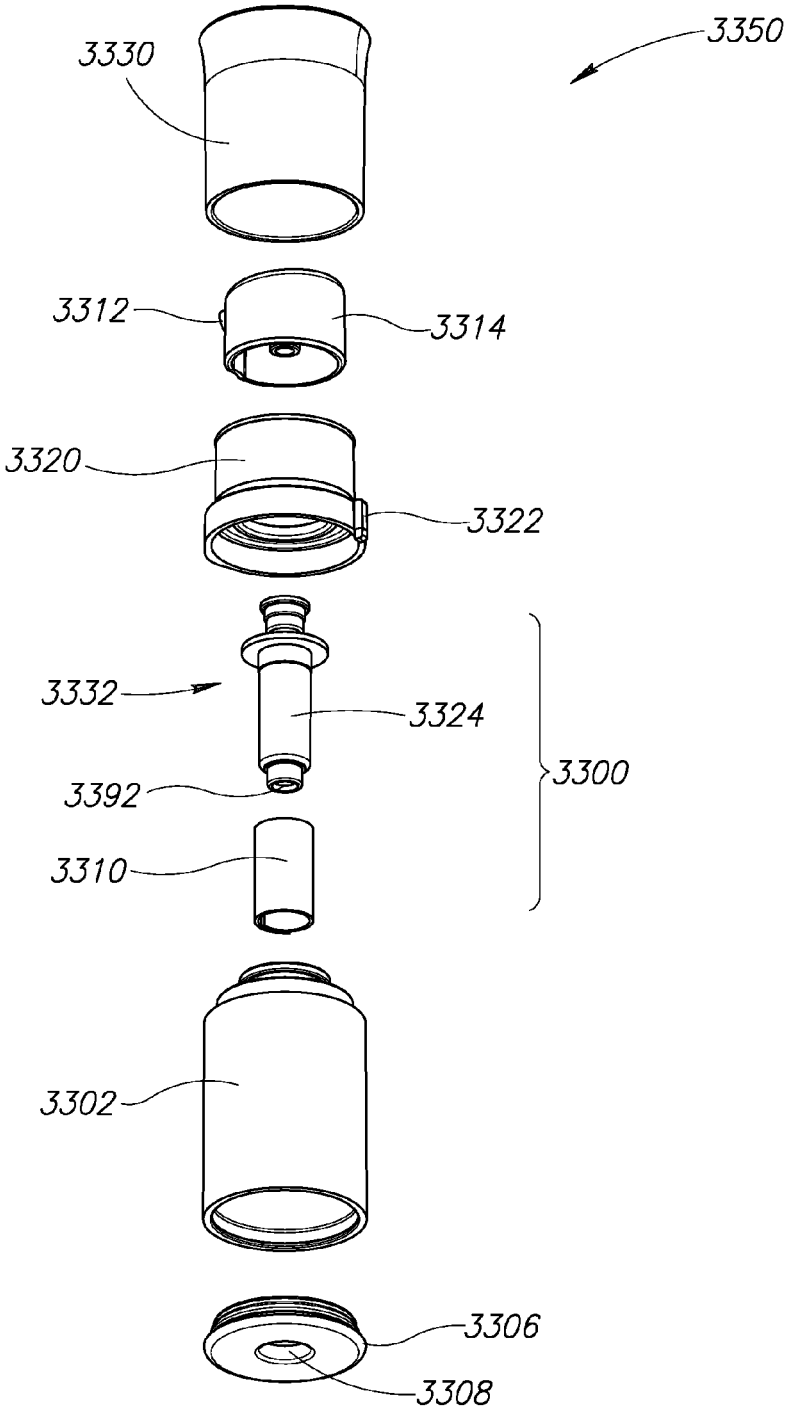
FIG. 33 provides an exploded view of an alternative embodiment of a fluid reservoir used in conjunction with the various embodiments of fluid dispensers disclosed herein.

FIG. 33 provides an exploded view of an alternative embodiment of a fluid reservoir used in conjunction with the various embodiments of fluid dispensers disclosed herein. Fluid reservoir 3350 may include similar features to fluid reservoir 2850 of FIG. 28. As such, fluid reservoir 3350 includes bottom cap 3306, reservoir body 3302, pump or cap assembly 3320, nozzle assembly 3314, over cap 3330, and valve assembly 3332. Any of the various embodiments of fluid reservoirs discussed herein may be a fluid delivery pod, or simply a pod.

When assembled, reservoir 3350 may include similar features to reservoirs 2950 or 3050 of FIGS. 29 and 30 respectively. As such, fluid reservoir may be used in conjunction with various dispensers discussed here. For example, reservoir 3350 may be received by any of fluid dispensers 1800, 2100, 2200, 2300, 2600, or 3100 of FIGS. 18, 21A-21B, 22A-22B, 23A-23B, 26A-26B, and 31A-31B respectively.

Similar to reservoir 2850, fluid reservoir 3350 is a customized airless pump reservoir or bottle. Thus, reservoir 3350 includes a pumping action that is triggered by a compressive force between nozzle assembly 3314 and reservoir body 3302. The compressive force is directed along a longitudinal axis of reservoir 3350.

To induce the pumping action, valve assembly 3332 may be similar to valve assembly 2832. As such, valve assembly 3332 includes lower valve chamber 3324. A lower valve assembly aperture 3392, positioned at the bottom of lower chamber 3324, leads to an internal chamber, pathway, or cavity in valve assembly 3332. An upper aperture is included in valve assembly 3332. The upper aperture enables a flow pathway through the internal cavity of valve assembly 3332.

This flow pathway is within the internal cavity of valve assembly 3332 and between lower aperture 3392 and the upper aperture. The flow pathway provides fluid communications between reservoir body 3302 and the nozzle 3312. One or more valves positioned within this flow path selectively block or otherwise inhibit flow through the flow path. A plurality of valves within valve assembly 3332 may enable a pumping action to bring fluid up from reservoir body 3302 and out through nozzle 3312.

In reservoir 2850 of FIG. 28, the compression force that triggers a dispensing event may be supplied by translating the piston 2804, along reservoir body 2802, towards nozzle assembly 2814. In contrast, reservoir 3350 does not include a translatable piston. Rather, as discussed below, the dispensing triggering compression force may be provided between the upper surface of the nozzle assembly 3314 and bottom cap 3308.

When placed in a dispenser, such as dispenser 3100 of FIGS. 31A-31B, a dispensing member of the dispenser, such as dispensing member 3182 of dispenser 3100, prevents the forward translation of nozzle assembly 3314 with respect to dispenser 3100. However, because reservoir body 3302 is translatable, with respect to nozzle assembly 3214, reservoir body 3302 may translate forward, via driveshaft 3148 of actuator 3146 because nozzle assembly 3314 is prevented from translating forward with respect to dispenser 3100. The driveshaft 3148 and the dispensing member 3182 provide the compression forces on the top and bottom of reservoir 3350. A shortening of the distance between the nozzle assembly 3314 and reservoir body 3302 induces a pumping action, which dispenses the fluid out of nozzle 3312.

To enable such a dispensing event, bottom cap 3306 includes a centrally located indent 3308 or other mating structure. Indent 3308 enables engagement between a driveshaft of an actuator included in a dispenser, such as driveshaft 3148 of dispenser 3100, and the reservoir 3350. The driveshaft is received by and mates with indent 3308 to physically contact and engage with indent 3308 on the lower surface of bottom cap 3306. When mated or otherwise engaged with bottom cap 3306, a translation of the driveshaft applies a force on the bottom of reservoir 3350. Such a force induces a translation of reservoir body 3302. When the nozzle assembly 3314 is prevented from translating forward, via dispensing member 3182, reservoir body 3302 translates relative to nozzle assembly 3314. This translation shortens the relative distance between body 3302 and nozzle assembly 3314, triggering a pumping action of valve assembly 3332. Thus, such a translation triggers a dispensing event and fluid flows from nozzle 3312.

For instance, decreasing the distance between nozzle assembly 3314 and reservoir body 3302 may be similar to the translation of a plunger that drives fluid through a hypodermic needle. In at least one embodiment, decreasing the distance between nozzle assembly 3314 and reservoir body 3302 may be similar to a translations of piston 2804 of reservoir 2850, resulting in a dispensing event.

Any force that results in a relative translation between the nozzle assembly 3314 and reservoir body 3302 and shortens the distance between the two components may trigger a dispensing event. Accordingly, a user may dispense fluid from reservoir 3350 by supplying a pumping force on an upper surface of nozzle assembly 3314. This enables a hand operation of reservoir 3350. Thus, similar to reservoir 2850, fluid may be dispensed from opposing (compression) forces on nozzle assembly 3314 and bottom cap 3306. Over cap 3330 is provided to prevent an accidental triggering of a dispense event, such as a hand pumping or operation of nozzle assembly 3314 when reservoir 3350 is not in use or otherwise not received by a dispenser.

In some embodiments, reservoir 3350 initially includes a seal, such as a thin film, label, or other frangible/brittle element. The seal spans the nozzle assembly 3314 and reservoir body 3302. If the relative distance has been previously shortened, the seal is broken. A broken seal provides a user a visual indication that reservoir 3350 has already been in use by a dispenser or been manually operated by a user.

In a preferred embodiment, pump assembly 3320 includes an alignment member 3322, or keyed portion, to insure proper alignment and/or orientation when inserted into a dispenser. The alignment member 3322 may include a protrusion, key, or other suitable structure that mates or engages with a corresponding structure in a fluid reservoir receptacle of the dispenser, such as fluid reservoir receptacle 2770 of FIG. 27. In such embodiments, fluid reservoir 3350 can only be inserted into the receptacle when alignment member 3322 is properly aligned with the corresponding keyed structure in the dispenser's receptacle. This insures that when received by the dispenser, reservoir 3350 is rotated about its longitudinal axis in the proper orientation. The proper rotation is required so that nozzle 3312 is oriented in a downward position and in alignment with a dispensing aperture of the dispenser. Similar to reservoir 2850, in some embodiments, nozzle 3312 is angled downward (when reservoir 3350 is positioned in a vertical orientation). Such a downward angling of nozzle 3312 enables a vertical orientation of nozzle 3312 when reservoir 3312 is placed within a dispenser.

Reservoir body 3302 includes a volume to house at least a portion of the fluid housed in reservoir 3350. In preferred embodiments, reservoir 3350 includes a conductive heating element 3310 that is at least partially positioned within reservoir body. Conductive heating structure 3310 may be similar to heating structure 2810 of reservoir 2850. A heating element, such as conductive coils 2780 of FIG. 27 may inductively generate a current in such a heating structure 3310, as described in at least the context of FIGS. 20A-20B.

In various embodiments, a valve/heating structure subsystem 3300 of reservoir 3350 includes the combination of heating structure 3310 and valve assembly 3332. In preferred embodiments, heating structure 3310 is configured and arranged, such that when reservoir 3350 is assembled, heating structure 3310 surrounds at least a portion of lower chamber 3324 of valve assembly 3332. At least a portion of heating structure 3310 is exposed to the fluid housed in reservoir body 3302. The heating structure 3310 is thermally coupled to the fluid housed within reservoir 3350.

In various embodiments, reservoir 3350 is similar to at least one of reservoir 2850, reservoir 2950, or reservoir 3050 of FIG. 28, 29, or 30 respectively, except for the inclusion of a translatable piston, such as piston 2804, 2904, or 3004 to dispense the fluid within. Rather, to dispense the fluid in reservoir 3350 requires a compression force between the top and bottom of reservoir 3350. The compression force will shorten the distance between nozzle assembly 3314 and reservoir body 3302. Such a shortening triggers the pumping action of reservoir 3350 and dispenses the fluid within. In reservoirs 2850, 2950, and 3050, the compression force is provided by translating the corresponding piston.

The specific heat capacity of the various fluid types that may be stored in any of the reservoirs disclosed herein vary with the type of fluid. Fluids that are more viscous may have a larger specific heat capacity than less viscous fluids. For example, water-based lubricants are typically more viscous than silicone-based lubricants, and thus typically have a larger specific heat capacity. In other words, to raise the temperature, by a predetermined amount, of a more viscous fluid (water-based lubricants) requires more energy than the same temperature change would require for a less viscous fluid (silicone-based lubricants).

For fluids that are inductively heated in reservoirs, such as any of fluid reservoirs 1950, 2850, 2950, 3050, 3350 of FIGS. 19A-B, 28, 29, 30, and 33 require different amounts of energy to raise the temperature of the fluid, based on the type of fluid that is inductively heated. Thus, a more viscous fluid may take longer to be heated within one of the dispensers. In some embodiments, a more efficient heating structure may be employed, in reservoirs intended to house fluids with a greater specific heat capacity. These more efficient heating structures ensure that the fluids housed within are heated by a dispenser within approximately the same amount of time that fluids with a less specific heat capacity are heated.

Essentially, multiple configurations of heating structures may be employed to compensate for the variances in the specific heat capacity of the fluids to be housed within the various reservoirs. A heating structure may be formed specific to a specific fluid type. For instance, for a given specific heat capacity, a heating structure may be formed to draw a certain amount of induced current to heat the fluid within the reservoir by a predetermined amount within a predetermined period of time.

To provide various efficiencies of the heating structures employed in reservoirs disclosed herein, the electrical conductance or electrical resistance of the heating structure that is internal to the reservoir is varied, depending on the type of fluid to be housed. The conductance or resistance may be varied by varying the material that the heating structure is fabricated from. For instance, the heating structure may include silver, copper, gold, stainless steel, surgical steel, or aluminum, depending upon the fluid to be housed.

In some embodiments, the surface area of the heating structure is varied to vary the amount of heat energy that is transferred to the housed fluid. A greater current is induced in a larger heating structure than in a smaller heating structure. Accordingly, a larger heating structure may be employed for reservoirs that are to house more viscous fluids, as compared to the smaller heating structures that are employed for reservoirs that house less viscous fluids.

Furthermore, heating structures that include a greater surface area transfer heat more efficiently to the fluid because more surface area is in thermal contact with the fluid.

For cylindrical or tube-shaped heating structures, such as 2810, 2910, 3010, 3310, and the like, the length of cylindrical heating structure may be varied based on the type of fluid to be housed. A longer heating structure results in a heating structure with a greater surface area. These heating structures are more efficient because a greater current may be induced and a greater surface area is in thermal contact with the fluid. Assuming a constant length of inductive coils, such as conductive coils 2780 of FIG. 27 (and assuming the length of the conductive coils is longer than the coaxial heating structure), a greater current will be induced in a longer heating structure. A smaller current will be generated in heating structures that are of a lesser length. In some embodiments, the surface area of the heating structure is varied by varying the inner and/or outer radii of the cylindrical heating structure.

Another advantage for varying the length of the heating structure is that reservoirs may be constructed to heat different fluid types by only varying the construction of the heating coil, such as the length of the heating structure. Each of the other components included in a reservoir may be the same, whether the reservoir is to house a silicone-based lubricant or a water-based lubricant. The only variance is the length of the heating structure. Accordingly, the manufacturing process is simplified, streamlined, and less expensive than creating multiple reservoir types for various fluid types. Furthermore, the dispenser itself does not have to have programming with differing heating times. The construction of the dispenser apparatus is thus simplified and made easier to use.

Still yet another advantage of forming a heating structure specific to a fluid type is the ability to auto-detect the type of fluid being heated. For instance, any of the various dispensers disclosed herein, including at least dispenser 3100 of FIG. 31 may detect the amount of current induced in the heating structure of a received reservoir. A dispenser may detect the corresponding energy drop in the current of heating coils, such as conductive coils 2780 of FIG. 27, to determine the current induced in the heating structure. From the detected energy loss, the length of the heating structure, and thus the type of housed fluid may be determined. The dispenser may provide an indication, via the user interface, of the type of fluid in the received reservoir.

Figure 34:
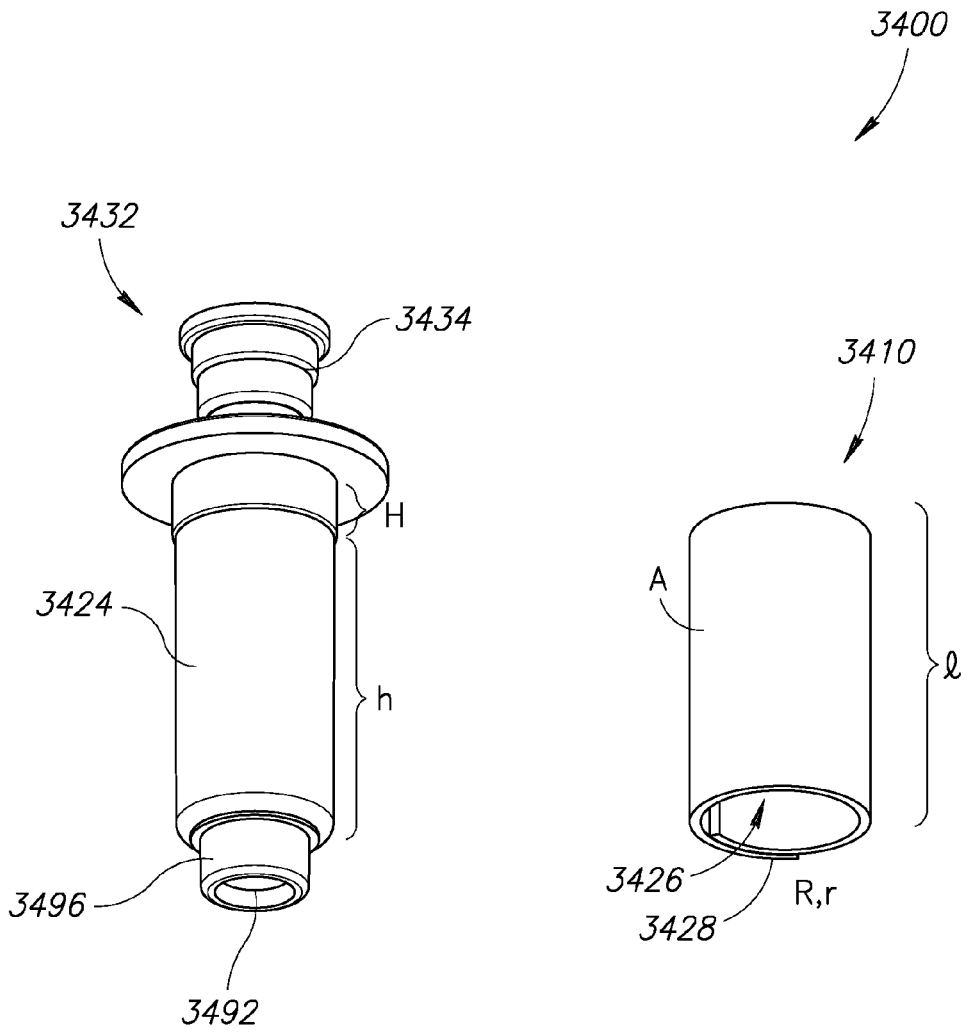
FIG. 34 illustrates a valve/heating structure sub-system that may be included in various fluid reservoir embodiments disclosed herein.

FIG. 34 illustrates a valve/heating structure sub-system 3400 that may be included in various fluid reservoir embodiments disclosed herein. For instance, sub-system 3400 may be included in any of reservoirs 2850, 2950, 3050, or 3350 of FIG. 28, 29, 30, or 33 respectively.

Sub-system 3400 may be similar to sub-system 3300 of FIG. 33. Thus, sub-system 3400 includes valve assembly 3432 and conductive heating structure 3410. Sub-system 3400 is a modular sub-system, in that various lengths of heating structures may be included in sub-system 340. Valve assembly 3432 may be similar to valve assembly 2832 or valve assembly 3332 of reservoir 2850 or reservoir 3350 respectively. Likewise, heating element 3410 may be similar to heating element 2810 or heating element 3310 of reservoir 2850 or reservoir 3350 respectively. As discussed below, a valve/heating structure subsystem, such as valve/heating structure sub-system 3400 enables the efficient heating of various fluid types, by enabling the variance of the surface area of the heating structure.

In valve/heating structure sub-system 3400, valve assembly 3432 includes a lower chamber 3424, which terminates in a valve intake port 3496 that includes a lower valve assembly aperture 3492. Valve assembly 3432 additionally includes a valve assembly trigger 3434. Valve assembly 3432 includes a fluid flow pathway between lower valve assembly aperture 3492 and an upper valve assembly aperture on the top of trigger 3434. A triggering or compression of trigger 3434 induces fluid to flow from below lower aperture 3492, through the fluid flow pathway, and out of the upper aperture. In various embodiments, a triggering of trigger 3434 induces a pumping action to draw the fluid up and through the fluid flow path.

As shown in FIG. 34, heating structure 3410 may be a conductive tube or hollow cylinder that includes heating structure aperture 3426. The heating structure 3410 is received over and is concentric or coaxial with lower chamber 3424. In at least one embodiment, the heating structure aperture 3426 slidably receives at least a portion of lower chamber 3424. Heating element 3410 includes an overlapped region 3428 where the longitudinal edges of the tube overlap to create the tube structure. In some embodiments, heating element 3410 does not include an overlapped region. Some embodiments a gap may exist between the longitudinal edges of the tube, i.e. a split tube. In at least one embodiment, the longitudinal edges are welded or crimped to join the edges.

Heating structure 3410 may be of length l. Furthermore, the outer and inner radii of the heating structure may be characterized by R and r respectively. Accordingly, the thickness (t) of the tube is approximated as $t \approx (R-r)$. The outer surface area (A) of heating structure 3410 is approximated as $A \approx l\pi R^2$. Likewise, the inner surface area of the heating structure 3410 is approximated as $l\pi r^2$. Any of l, R, r may be varied to create a heating structure that is specific to the fluid to be housed with a reservoir, i.e. customized to compensate for the specific heat capacity of the housed fluid. Varying l, R, r will result in a greater or less induced current to heat the fluid within, thus requiring greater or less heating time within the dispenser.

In at least one embodiment, heating structure 3410 is positioned over lower chamber 3424, such that heating structure 3410 covers a length of h of the lower chamber 3410 ($l \approx h$). Another length, H, of the lower chamber 3424 is above and not covered by heating element 3410. In some embodiments, a total length (L) of the lower chamber 3424 is approximated as $L \approx H+h$. In other embodiments, a portion of the lower chamber 3424 is below heating element 3410. Heating structure 3410 may be positioned anywhere along lower chamber 3424, depending on the amount of surface area of heating structure 3410 is to be in contact with the fluid. In at least one embodiment, a portion of the heating structure 3410 extends below lower aperture 3492.

Figure 35:
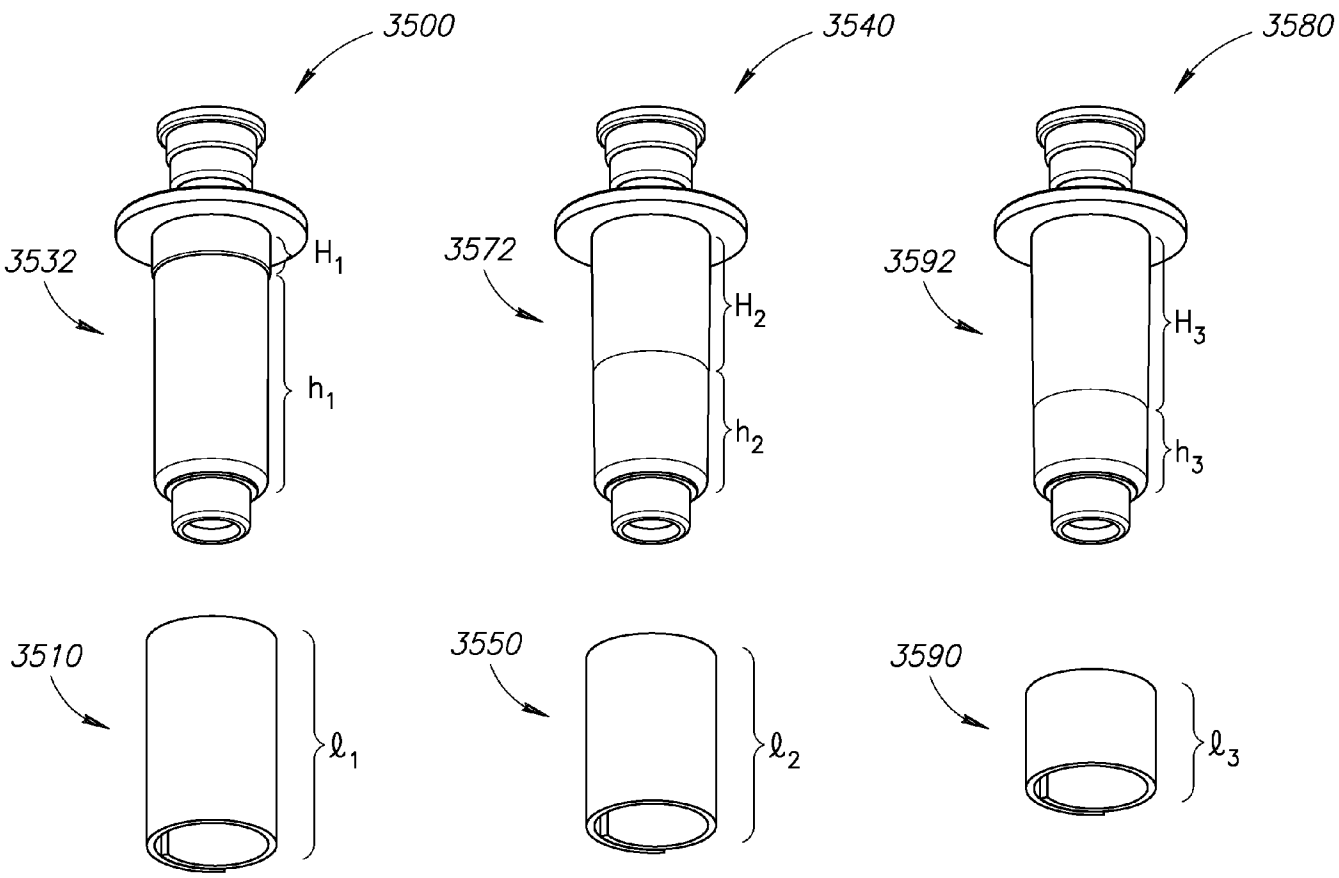
FIG. 35 shows three embodiments of valve/heating structure sub-systems that may be integrated into various fluid reservoirs disclosed herein, where the length of the heating structure is varied based on the type or viscosity of the housed fluid.

FIG. 35 shows three embodiments of valve/heating structure sub-systems that may be integrated into various fluid reservoirs disclosed herein, where the length of the heating structure is varied based on the type or viscosity of the housed fluid. Sub-systems 3500, 3540, and 3580 include valve assemblies 3532, 3572, and 3592 respectively. Likewise, sub-systems 3500, 3540, and 3580 include heating structures 3510, 3550, and 3590 respectively.

Heating structures 3510, 3550, and 3590 are of lengths $l_1$, $l_2$, and $l_3$ respectively, where $l_1 > l_2 > l_3$. Accordingly, heating structure 3510 may be used in a reservoir that houses a viscous fluid (such as a water-based lubricant). Heating structures 3590 may be used in a reservoir that houses a less viscous fluid (such as a silicone-based lubricant). Heating structure 3550 may be used in a reservoir that houses a fluid that is of a specific heat capacity somewhere between a water-based lubricant and a silicone-based lubricant. Heating structures that draw less induced current are desirable for less viscous fluid to avoid excessive heat transfer to the lower chamber of the valve assemblies.

In various embodiments, 10 mm<$l_1$<20 mm. In various preferred embodiments, 13 mm<$l_1$<17 mm. In a specific preferred embodiment, l≈15.2 mm. In various embodiments, 1 mm<$l_3$<10 mm. In preferred embodiments, 3 mm<$l_3$<7 mm. In a specific preferred embodiment, 5 mm. In various embodiments, 5 mm<$l_2$<15 mm. In preferred embodiments, 7 mm<$l_2$<13 mm. In some embodiments, the outer diameter of at least one of heating structures 3510, 3550, or 3590 is between 6 and 10 mm. In a preferred embodiment, the outer diameter is approximately 8 mm. It should be understood that other values are possible for the length and other linear dimensions of any heating structures, depending on the type or viscosity of the housed fluid.

In some embodiments, the length of the lower chamber of the valve assembly is subdivided into two lengths, designated by H and h, where the heating element covers the length designated by h and the length designated by H is not covered by the heating element. In FIG. 35, each of the $H_1$, $H_2$, and $H_3$ lengths, as well as the corresponding lengths $h_1$, $h_2$, and $h_3$ are shown on each of valve assemblies 3532, 3572, and 3592. Although each of the heating structures is places at the lower end of the corresponding lower chamber of the valve assemblies in FIG. 35, other embodiments are not so constrained, and the heating structure's may be positioned anywhere on the corresponding lower chamber.

In at least one embodiment, each of valve assemblies 3532, 3572, and 3592 is identical so that only the length of the corresponding heating structures 3510, 3550, and 3590 need be varied to accommodate various fluid types. Accordingly, the manufacturing process of reservoirs to house various types or viscosities of fluids is simplified and/or streamlined. The manufacturing process of the dispenser is also simplified as the heating structure in the reservoir itself accounts for the heating times of the differing fluids without any differing programming of the dispenser that the reservoir may be placed in.

Figure 36:
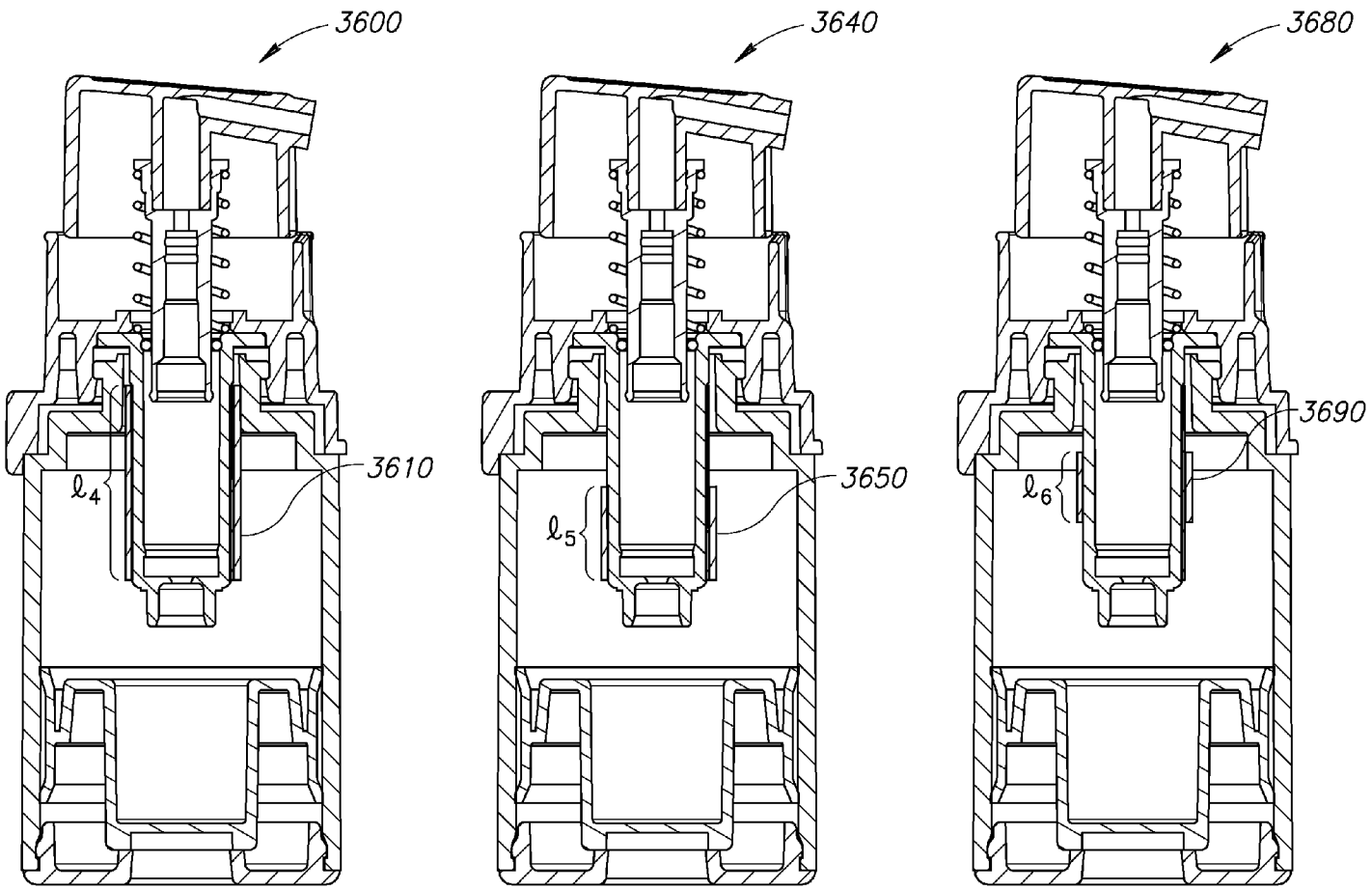
FIG. 36 shows three fluid reservoirs that include heating structures of various lengths and positioning to compensate for the specific heat capacity of the fluid stored in the corresponding reservoir.

FIG. 36 shows three fluid reservoirs that include heating structures of various lengths and positioning to compensate for the specific heat capacity of the fluid stored in the corresponding reservoir. Each of fluid reservoirs 3600, 3640, and 3680 may be similar to any of reservoirs 2850, 2950, and 3050 of FIGS. 28, 29, and 30 respectively because each of fluid reservoirs 3600, 3640, and 3680 includes a piston. However, it should be understood that alternatively, each of fluid reservoirs 3600, 3640, and 3680 may not include a piston. Thus reservoirs 3600/3640/3680 could be similar to fluid reservoir 3350 of FIG. 33. Each of fluid reservoirs 3600/3640/3680 includes a valve/heating structure sub-system similar to valve/heating structure sub-systems 3400, 3500, 3540, and 3580 of FIGS. 34 and 35.

The only difference between reservoirs 3600, 3640, and 3680 is the length and positioning of the corresponding heating structures 3610, 3650, and 3690. Heating structure 3610 includes a length of $l_4$ and is positioned to run the length of the lower chamber of the valve assembly. Heating structure 3650 includes a length of $l_5$ and is positioned near the bottom of the lower chamber of the valve assembly. Heating structure 3690 includes a length of $l_6$ and is positioned near the middle of the lower chamber of the valve assembly, where $l_4$>$l_5$, $l_6$. At least a portion of each of heating structures 3610, 3650, and 3690 is positioned within the reservoir body and is in thermal contact with the fluid stored in the reservoir body. It should be understood that the length of the heating structure, as well as the positioning, may be varied in each of the embodiments discussed throughout. For instance the length and positioning may be varied in reservoir embodiments that include a piston (such as fluid reservoir 2850 of FIG. 28), as well as reservoir embodiments that do not include a piston (such as fluid reservoir 3350 of FIG. 33) based on the type of fluid to be housed in the reservoir.

Figure 37:
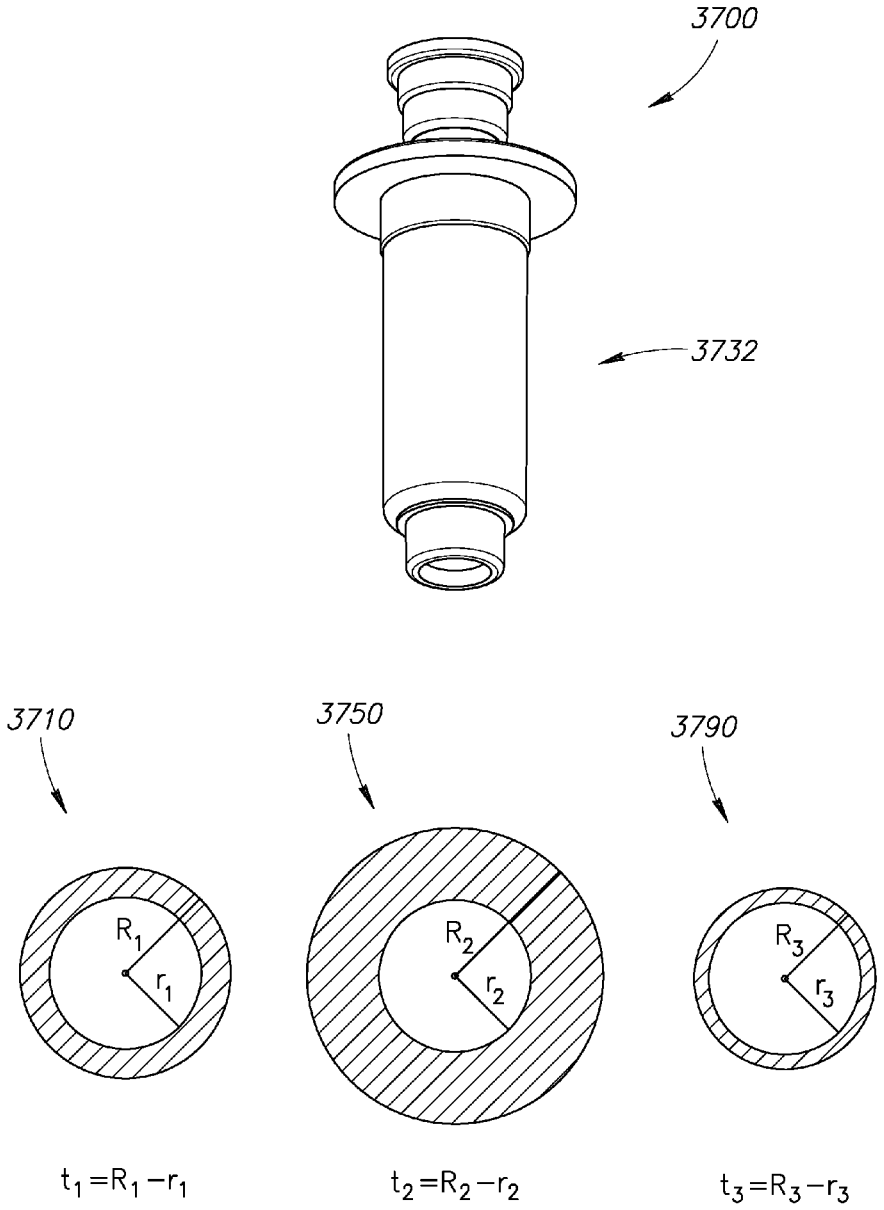
FIG. 37 illustrates a valve/heating structure sub-system where the inner and outer radius of the heating structure is varied to compensate for the specific heat capacity of the fluid stored in the corresponding reservoir.

FIG. 37 illustrates a valve/heating structure sub-system 3700 where the inner and outer radius of the heating structure is varied to compensate for the specific heat capacity of the fluid stored in the corresponding reservoir. Each of heating structure 3710, 3750, and 3790 are shown in a bottom view to demonstrate the variances of the outer and inner radii: ($R_1$, $r_1$), ($R_2$, $r_2$), and ($R_3$, $r_3$) respectively. The thickness (t) of each of the heating structures is equivalent to the difference of the corresponding outer and inner radii.

As noted above, a variance in the outer radius of a heating structure increases the surface area of the heating structure that is in thermal contact with the fluid. Thus, increasing the outer radius may be applicable for heating structures that are employed to heat more viscous fluids. Varying the thickness of a heating structure varies the electrical conductance of the heating structure, resulting in differing amounts of induced currents. Thus, the thickness may be varied to compensate for different fluid types. The radius of the lower chamber of valve assembly 3732 may be varied to compensate for variances in the inner radii $r_1$, $r_2$, and $r_3$ of heating structures 3710, 3750, and 3790 respectively. In alternate embodiments, the heating structure may be of other shapes and sizes than those discussed above, with differing sizes to compensate for the differing fluids in reservoirs.

Figure 38:
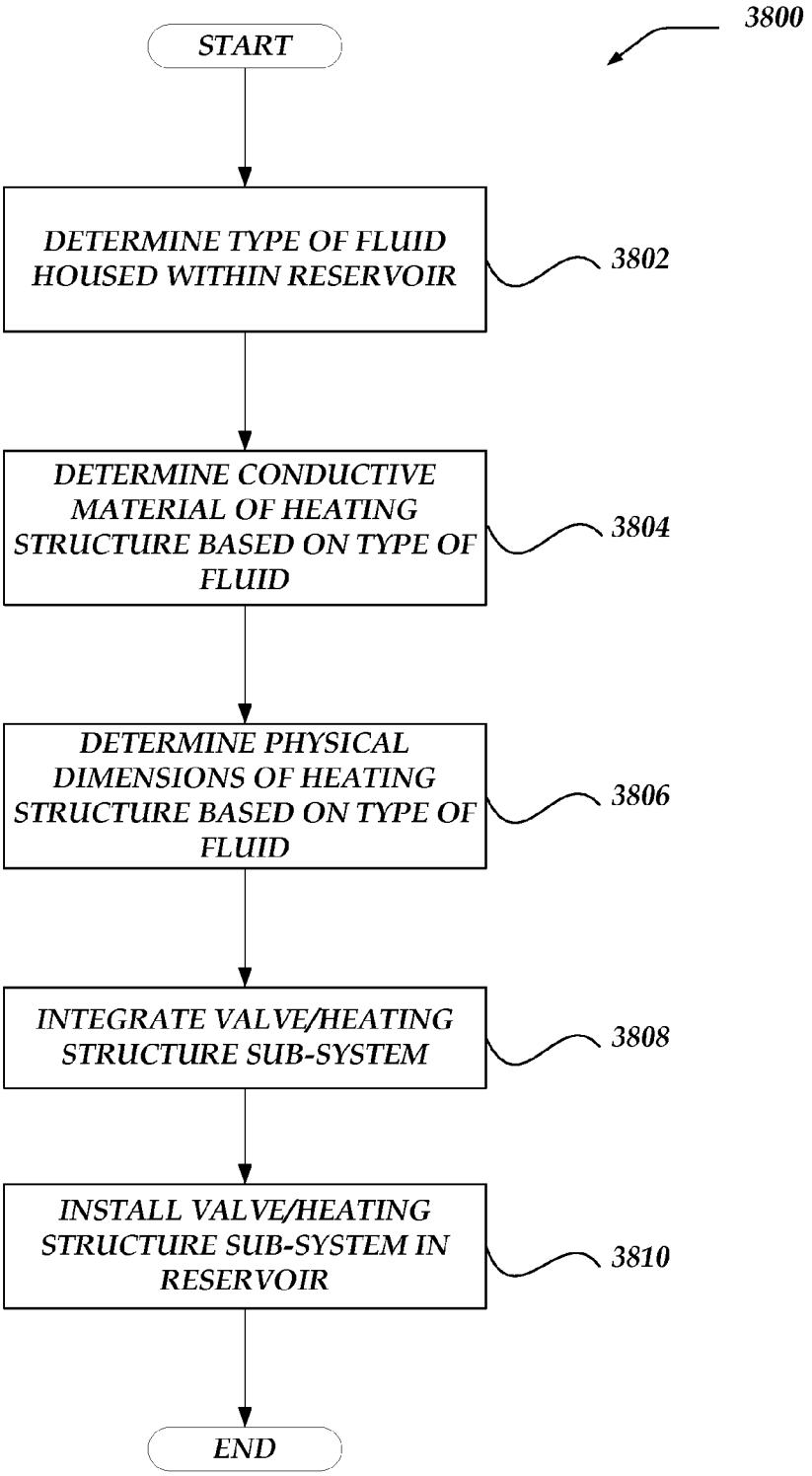
FIG. 38 shows a method for providing a fluid reservoir customized to house a specific fluid type.

FIG. 38 shows a method 3800 for providing a fluid reservoir customized to house a specific fluid type. After a start block, process 3800 proceeds to block 3802, where a fluid type to be housed within the reservoir is determined. For example, at block 3802, it may be determined whether a water-based lubricant or a silicone-based lubricant is to be housed within the reservoir.

At block 3804, a type of conductive material of the heating elements is determined based on the type of fluid. For instance, depending on the type of fluid to be heated, a conductive material such as silver, gold, stainless steel, or surgical steel, copper, or the like may be determined. The type of material may be based on the electrical conductance or resistance of the material type.

At block 3806, the physical dimensions of the heating structure are determined based on the fluid type. For instance, as discussed herein, the length, as well as the inner and/or outer radii of the heating structure may be determined to compensate for the specific heat capacity of the fluid type. At block 3808, the valve/heating structure sub-system is integrated. As with sub-systems 3500, 3540, or 3580, the heating structure is positioned over the lower chamber of the valve assembly. Additionally at block 3808, the position of the heating structure on the lower chamber of the valve assembly may be determined. For instance, FIG. 36 shows various positioning of the heating structure to compensate for the specific heat capacity of the fluid type. At block 3810, the valve/heating structure sub-system is installed in the reservoir, such as reservoir 2850 or 3350 of FIG. 28 or 33 respectively.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A fluid delivery pod comprising:

a first surface;

a second surface that opposes the first surface;

a reservoir body intermediate the first and the second surfaces, wherein the reservoir body is configured to house a fluid;

an outlet port in fluid communication with the reservoir;

a heating structure within the reservoir body and being electrically conductive to wirelessly receive inductive energy from an energy source that is external to the fluid reservoir to heat at least a portion of the fluid within the reservoir body; and a valve assembly that is operative to, in response to an application of compression forces on the opposing first and the second surfaces, dispense at least a portion of the heated fluid through the outlet port;

wherein the first surface further comprises a piston that translates along at least a portion of the reservoir body.

2. The pod of claim 1, wherein a physical dimension of the heating structure is based on a fluid type of the fluid housed within the reservoir body.

3. The pod of claim 2, wherein another fluid delivery pod houses fluid of another fluid type and includes another heating structure, wherein a physical dimension of the other heating structure is based on the other fluid type.

4. The pod of claim 1, wherein the valve assembly includes a lower chamber and the heating structure is positioned around at least a portion of the lower chamber of the valve assembly.

5. The pod of claim 4, wherein the lower chamber of the valve assembly and the heating structure are coaxial along an axis that extends between the first and the second surfaces.

6. The pod of claim 1, wherein the heating structure is a conductive tube that includes a length, an inner radius, and an outer radius.

7. The pod of claim 6, wherein the length of the heating structure is between 13 and 17 millimeters.

8. The pod of claim 6, wherein the length of the heating structure is between 3 and 7 millimeters.

9. The pod of claim 1, wherein a lower chamber of the valve assembly slidably receives the heating structure.

10. A fluid reservoir comprising:

a reservoir body that includes a first end, a second end, and a volume, wherein the reservoir body is configured and arranged to house a fluid in the volume, wherein the first end includes at least one of an aperture or an indent that is configured and arranged to receive an actuator;

a piston housed within the volume of the reservoir body and configured and arranged to translate along a translation axis;

a nozzle that communicates with an interior volume of the reservoir body and is configured and arranged to output the fluid housed within the reservoir;

a valve assembly that includes a lower chamber and a first valve that resists the output of the fluid through the nozzle unless a dispensing force is applied to the reservoir, wherein the dispensing force increases an internal pressure of the fluid to overcome a resistance of the first valve; and a heating structure that is disposed within the reservoir body and that surrounds an outer surface of the lower chamber of the valve assembly, wherein when fluid is housed in the volume of the reservoir body, the heating structure is thermally coupled to the fluid and configured and arranged to heat at least a portion of the fluid housed within the body.

11. The reservoir of claim 10, wherein the heating structure is a conductive tube that includes a length, an aperture of an inner radius, and an outer radius, wherein the aperture is configured and arranged to receive at least a portion of the lower chamber of the valve assembly.

12. The reservoir of claim 11, wherein the length of the heating structure is based on a fluid type of the fluid housed in the volume of the reservoir body.

13. The reservoir of claim 11, wherein at least one of the outer radius or the inner radius of the heating structure is based on a fluid type of the fluid housed in the volume of the reservoir body.

14. The reservoir of claim 11, wherein the outer radius of the heating structure is between 6 mm and 10 mm.

15. The reservoir of claim 11, wherein the tube includes at least one of an overlapped region, a welded region, or a gapped region.

16. The reservoir of claim 10, wherein the first end of the reservoir body includes the aperture, and when the aperture receives the actuator, the actuator mates with the piston and the actuator provides the dispensing forces on the piston.

17. A fluid reservoir that houses fluid, the reservoir comprising:

a reservoir body that includes a longitudinal axis and a volume, wherein the reservoir body is configured and arranged to house at least a portion of the fluid in the volume;

a piston configured and arranged to translate along at least a portion of the longitudinal axis of the reservoir body;

a heating structure disposed within the reservoir body, wherein when fluid is housed in the volume of the reservoir body, the heating structure is thermally coupled and configured and arranged to energize at least a portion of the fluid housed within the body, wherein a length of the heating structure is based on fluid type of the housed fluid;

a nozzle that communicates with an interior volume of the reservoir and is configured and arranged to output the housed fluid; and a valve assembly that resists the output of the fluid through the nozzle unless a compression force is applied to the reservoir along the longitudinal axis.

18. The reservoir of claim 17, wherein the heating structure and a lower chamber of the valve assembly are coaxial with the longitudinal axis.

19. The reservoir of claim 17, wherein the length of the heating structure is a first length when a first fluid type of a first specific heat capacity is housed within the reservoir body and the length of the heating structure is a second length when a second fluid type of a second specific heat capacity is housed within the reservoir body, wherein the first length is greater than the second length and the first specific heat capacity is greater than the second specific heat capacity.

20. The reservoir of claim 17, wherein a thickness of the heating structure is based on the fluid type of the housed fluid.

21. A method for providing a fluid delivery pod of claim 1, the method comprising:

determining a type of fluid to house within the pod;

determining one or more physical dimensions of the heating structure based on the determined type of fluid, wherein a variance in the one or more physical dimensions varies at least an electrical conductance of the heating structure; and providing the heating structure with the pod, wherein the heating structure includes the determined one or more physical dimensions based on the type of fluid.

22. The method of claim 21, further comprising:

determining a type of conductive material based on the type of fluid, wherein the heating structure is constructed from the determined type of conductive material and a variance in the type of conductive material varies at least the electrical conductance of the heating structure.

23. The method of claim 22, wherein the type of conductive material includes at least one of stainless steel or surgical steel.

24. The method of claim 21, wherein the type of fluid includes at least one of a water-based lubricant or a silicone-based lubricant.

25. The method of claim 21, wherein the determined one or more physical dimensions of the heating structure includes a length of the heating structure.

26. The method of claim 25, wherein the determined length of the heating structure is between 13 and 17 millimeters.

27. The method of claim 25, wherein the determined length of the heating structure is between 3 and 7 millimeters.

28. The method of claim 21, wherein the determined one or more physical dimensions of the heating structure includes a diameter of the heating structure and the determined diameter is between 6 and 10 millimeters.

29. The method of claim 21, wherein the heating structure is cylindrical heating structure.

* * * * *